US008069785B2

(12) United States Patent
Schäfer et al.

(10) Patent No.: US 8,069,785 B2
(45) Date of Patent: Dec. 6, 2011

(54) PRINTING GROUPS OF A PRINTING PRESS

(75) Inventors: Karl Robert Schäfer, Kürnach (DE); Georg Schneider, Würzburg (DE); Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 473 days.

(21) Appl. No.: 12/224,441

(22) PCT Filed: Mar. 1, 2007

(86) PCT No.: PCT/EP2007/051954

§ 371 (c)(1),
(2), (4) Date: Nov. 12, 2008

(87) PCT Pub. No.: WO2007/099147

PCT Pub. Date: Sep. 7, 2007

(65) Prior Publication Data

US 2009/0145315 A1 Jun. 11, 2009

(30) Foreign Application Priority Data

Mar. 3, 2006 (EP) ..... 06110614

(51) Int. Cl.

| | |
|---|---|
| ***B41F 5/16*** | (2006.01) |
| ***B41F 5/18*** | (2006.01) |
| ***B41F 5/04*** | (2006.01) |
| ***B41F 13/02*** | (2006.01) |

(52) U.S. Cl. ..... 101/221; 101/180; 101/350.1; 101/136; 101/141; 101/147

(58) Field of Classification Search ..... 101/180, 101/221, 147, 350.1, 349.1, 348, 136, 141
See application file for complete search history.

(56) References Cited

U.S. PATENT DOCUMENTS

| | | | | |
|---|---|---|---|---|
| 2,557,381 | A | | 6/1951 | Huebner |
| 3,007,403 | A | | 11/1961 | Barnes |
| 3,467,008 | A | | 9/1969 | Domotor |
| 3,892,178 | A | | 7/1975 | Staamann |
| 4,831,926 | A | | 5/1989 | Bowman et al. |
| 4,905,598 | A | | 3/1990 | Thomas et al. |
| 5,042,788 | A | | 8/1991 | Bowman et al. |
| 5,142,977 | A | | 9/1992 | Gertsch et al. |
| 5,293,819 | A | | 3/1994 | Fukuda |
| 5,341,733 | A | * | 8/1994 | Weisbrod ..... 101/148 |
| 5,704,288 | A | * | 1/1998 | John ..... 101/216 |
| 5,713,286 | A | * | 2/1998 | Zorn ..... 101/450.1 |
| 5,782,182 | A | | 7/1998 | Ruckmann et al. |

(Continued)

FOREIGN PATENT DOCUMENTS

| | | |
|---|---|---|
| CA | 1 251 688 | 3/1989 |

(Continued)

*Primary Examiner* — Matthew G Marini
*Assistant Examiner* — Leo T Hinze
(74) *Attorney, Agent, or Firm* — Mattingly & Malur, P.C.

(57) ABSTRACT

A printing group of a printing press is comprised of a transfer cylinder, a forme cylinder and a first roller of an inking unit. That first inking unit roller cooperates, as an ink application roller, with the forme cylinder. The inking unit is provided with two axially traversing friction cylinders which are serially disposed in the ink path to the forme cylinder. The first inking unit roller has substantially the same diameter as the forme cylinder.

15 Claims, 27 Drawing Sheets

U.S. PATENT DOCUMENTS

| | | | | |
|---|---|---|---|---|
| 6,408,748 | B1 | 6/2002 | Hajek et al. | |
| 6,684,775 | B2 | 2/2004 | Dufour et al. | |
| 6,691,612 | B1 | 2/2004 | Herrmann et al. | |
| 6,782,816 | B1 | 8/2004 | Bolza-Schunemann | |
| 7,117,792 | B2 | 10/2006 | Faist et al. | |
| 7,124,683 | B2 | 10/2006 | Faist et al. | |
| 7,140,295 | B2 | 11/2006 | Christel et al. | |
| 7,156,018 | B2 | 1/2007 | Holm et al. | |
| 7,213,513 | B2 | 5/2007 | Christel et al. | |
| 7,387,069 | B2 | 6/2008 | Schneider et al. | |
| 7,752,964 | B2 * | 7/2010 | Fischer et al. | 101/218 |
| 2005/0172846 | A1 * | 8/2005 | Schneider et al. | 101/477 |
| 2006/0169157 | A1 * | 8/2006 | Gahan | 101/365 |
| 2007/0175345 | A1 | 8/2007 | Schafer et al. | |

FOREIGN PATENT DOCUMENTS

| | | | |
|---|---|---|---|
| DE | 22 34 089 | | 1/1974 |
| DE | 32 23 352 | A1 | 12/1983 |
| DE | 38 25 517 | A1 | 2/1990 |
| DE | 43 27 278 | C2 | 2/1995 |
| DE | 195 20 841 | A1 | 12/1996 |
| DE | 195 34 651 | A1 | 3/1997 |
| DE | 199 11 180 | A1 | 9/2000 |
| DE | 100 44 860 | A1 | 5/2001 |
| DE | 102 02 385 | A1 | 8/2002 |
| DE | 102 44 043 | A1 | 6/2003 |
| DE | 101 63 961 | A1 | 7/2003 |
| EP | 0 149 841 | A2 | 7/1985 |
| EP | 0 246 081 | A2 | 11/1987 |
| EP | 0 331 870 | A2 | 9/1989 |
| EP | 0 557 635 | A1 | 9/1993 |
| EP | 0 699 524 | B1 | 8/1995 |
| EP | 1 161 345 | B1 | 3/2000 |
| EP | 1 264 686 | A1 | 5/2002 |
| GB | 2 398 272 | A | 8/2004 |
| WO | WO 95/24314 | | 9/1995 |
| WO | WO 02/081218 | A2 | 10/2002 |
| WO | WO 03/039872 | A1 | 5/2003 |
| WO | WO 03/049946 | A2 | 6/2003 |
| WO | WO 2004/028810 | A1 | 4/2004 |
| WO | WO 2005/097503 | A2 | 10/2005 |
| WO | WO 2005/097503 | A3 | 10/2005 |
| WO | WO 2005/097504 | A2 | 10/2005 |
| WO | WO 2005097505 | A2 * | 10/2005 |

* cited by examiner

PRINTING GROUPS OF A PRINTING PRESS

CROSS-REFERENCE TO RELATED APPLICATIONS

This application is the U.S. national phase, under 35 USC 371, of PCT/EP2007/051954, filed Mar. 1, 2007; published as WO 2007/099147 A2 and A3 on Sep. 7, 2007 and claiming priority to EP 06110614.2, filed Mar. 3, 2006, the disclosures of which are expressly incorporated herein by reference.

FIELD OF THE INVENTION

The present invention is directed to printing couples of a printing press. Each printing couple is comprised of a transfer cylinder, a forme cylinder and a first roller of an inking unit. The first roller cooperates with the forme cylinder as an ink forme roller.

A device for mounting a pair of cylinders of a printing press is known from EP 0 331 970 A2. Bearing housings, each of which supports a journal of the cylinder, can be acted upon by an arrangement of pressurized cylinders, with forces that are equal, that are different from one another, or that are equal to one another in groups, and which cylinders are thereby able to be displaced for the purpose of adjusting a distance between the cylinders. The respective direction in which the pressurized cylinders act is the same in each case. With this arrangement of pressurized cylinders, therefore, an adjustment that is substantially only unidirectional is possible. The adjustable forces can be adjusted or can be preselected while the machine is in operation, or even prior to the start of machine operation, using an adjustment/pre-selection/control or a regulating device. If the device is a regulator, a sensor is assigned to this regulator, which reports its readings to the regulator. The pressure at the pressurized cylinders, adjusted via the regulator, can be adjusted continuously as desired, such as, for example, based upon the running speed of the cylinders, and/or according to the speed of these cylinders within a broad range, while the device is in operation.

Devices for adjusting rollers in a printing press are known from DE 102 44 043 A1. Each of the two ends of a roller, which exerts contact pressure on an adjacent rotational body, is mounted in a support bearing having a roller housing that is capable of radial travel. Each support bearing has a plurality of actuators, which act upon the roller and which can be pressurized by a pressure medium. A roller that can be adjusted in this fashion is also engaged against a forme cylinder, for example.

A device for engaging and disengaging and for adjusting inking unit and/or dampening unit rollers of a printing press is known from DE 38 25 517 A1. A memory-programmable control device automatically regulates the position of an inking unit or of a dampening unit roller in relation to a stationary distribution roller, based upon an input, predetermined contact pressure. The memory-programmable control device issues a positioning command to an electrically actuated control element. The control element, which is configured as a direct current motor, relays the positioning command to an actuating element. The actuating element is responsible for the mechanical adjustment of the inking unit or the dampening unit roller. The electrically actuated control element and the actuating element are arranged in a roller socket of the adjustable inking unit or dampening unit roller. With the device known from DE 38 25 517 A1, a remote adjustment of the inking unit or the dampening unit rollers is possible. Based on a normal position of the adjustable inking unit or dampening unit rollers, adjustment values for other positions for different production modes can be stored in the memory-programmable control device. Therefore, the adjustment values for the inking unit or for the dampening unit rollers are dependent upon the selected production mode. Previously, input adjustment values for the positions, which differ based upon the production mode, are determined by the memory-programmable control device with a program.

Methods for operating an inking unit or dampening unit of a printing press are known from WO 03/049946 A2 and WO 2004/028810 A1. At least three rollers or cylinders are provided in the inking unit or dampening unit, and which can be placed in contact with one another in at least two roller strips. At least one of the rollers is mounted in a machine frame so as to be displaceable in relation to the other rollers. The displaceably mounted roller is pressed into the gap between the adjacent rollers with a force that is adjustable, in terms of extent and direction, for the variable adjustment of the respective contact pressure in the two roller strips.

It is known, from EP 1 161 345 B1, to provide a narrow, single-circumference forme cylinder with an additional Schmitz ring, not only at the ends of the cylinder, but also at its center. The forme cylinder presses against a double-sized transfer cylinder, and is inked up by a single-sized roller. The latter single-sized roller receives ink from an approximately double-sized anilox cylinder with an ink chamber blade, in dry offset. These four cylinders lie within one plane, and the large cylinders prevent the two small cylinders from sagging. A configuration with a classic inking unit is also shown, where two forme rollers, with inking rollers and distribution cylinders, are supplied with ink for the small forme cylinder from a large "bare cylinder" with an attached ductor inking unit. In this case, only three supporting disks lie between the forme cylinder and the large bare cylinder, at the outside and at the center, which three supporting disks are supported on Schmitz rings of the bare cylinder, and which press against the forme cylinder Schmitz rings. They are prevented from sagging by the forces of pressure between the forme and transfer cylinders. The EP 1 161 345 B1 document further shows that all eight participating cylinders and/or supporting disks lie either within a single plane or at an angle in two planes. A limitation of this proposal is the use of Schmitz rings, the replacement of which, as a result of wear and tear, is complicated and costly. Furthermore, the seating of the two small cylinders is spatially limited. The small forme cylinder is disadvantageously asymmetrically fixed between one rubber blanket against the transfer cylinder and two rubber blanket thicknesses of the small forme roller against the large bare cylinder.

In one embodiment of a printing unit, a forme roller of an anilox inking unit is provided, as seen in WO 2005/097504 A2. The diameter of the forme roller corresponds to that of the allocated forme cylinder. For the adjustment of the printing couple cylinders, pressure-actuable actuators and linear bearings are provided.

DE 32 23 352 A1 discloses a printing couple, the ink forme roller of which has the same diameter as the forme cylinder. The printing couple works with post-dampening, in which the inking unit is embodied as an anilox inking unit with an ink trough, an anilox roller and a forme roller.

EP 1 029 672 A1 discloses a rubber roller in a printing press, which can be engaged against two adjacent rollers. These rollers are fixed to the frame, using pressure-actuable actuators.

An inking unit having two forme rollers is disclosed in WO 03/049947 A2. The forme rollers can be engaged against a forme cylinder by the use of pressure-actuable actuators.

EP 1 559 548 A1 shows a system for adjusting rollers. A forme roller can be engaged against a forme cylinder via a pressure-actuable actuator.

GB 2 398 272 A is concerned with the problem of minimizing contrast problems in a printed image, which result from the defined ink key sections during the supplying of ink in an inking unit. It discloses a distribution cylinder, which is positioned vertically below a forme roller in the graphic.

US 2005/0005790 A1 relates to the formation of a keyless inking unit. In addition to a forme roller with a radius that is somewhat smaller than that of the forme cylinder, a roller, which is characterized as a "clean-up roller," cooperates with the forme cylinder.

SUMMARY OF THE INVENTION

The object of the present invention is to provide printing couples of a printing press.

The object is attained according to the present invention by the provision of each printing couple having a transfer cylinder, a forme cylinder, a forme roller of a dampening unit cooperating with the forme cylinder and a first roller of an inking unit cooperating with the forme cylinder as an ink forme roller. The inking unit includes two oscillating distribution cylinders arranged in series in the ink path. The rotational axes of the forme cylinder and its associated transfer cylinder form a plane in their operational position. The first ink forme roller has the same diameter as the forme cylinder. A plane through the forme cylinder and the ink forme roller forms an angle of less than 15° with the plane defined by the forme cylinder and the transfer cylinder.

The benefits to be achieved with the present invention consist especially in that a printing couple is provided, which is adapted for use with long, slender cylinders, which is easy to produce. The printing couple is nevertheless rigid.

The arrangement of the rotational axes of the transfer cylinder, the forme cylinder and the ink forme roller substantially within a shared plane, increases the rigidity of the printing couple with respect to sagging/vibrations which may be caused by groove wobble.

By using linear guides for the printing couple cylinders, an ideal mounting position for the cylinders, with respect to potential cylinder vibrations, is achieved. In addition, by mounting the cylinders in linear guides, short adjustment paths are realized. Therefore, no synchronization spindle is required. The costly installation of three-ring bearings is eliminated.

In one embodiment of the present invention, which uses power-controlled actuators for print-on/print-off adjustment, it is advantageous that the contact pressure, which is exerted by a roller or by a cylinder in a roller strip and on an adjacent rotational body, can be adjusted, as needed. In particular, the linear bearing, combined with the direction of adjustment and the use of power-controllable actuators, offers advantages in terms of rigidity and adjustability.

In addition to enabling easy installation, the mounting of rollers and/or cylinders on the inside of the side frames also allows the cylinder journals to be shortened. This results in a vibration-reducing effect.

The embodiment of the linear bearings for cylinders and/or the forme roller with movable stops, as discussed above, enables a pressure-based adjustment of the cylinders, along with an automatic normal setting—for a new configuration, a new printing blanket, or the like.

Further benefits to be achieved in accordance with the present invention consist in that the contact pressure that is exerted by a roller or by a cylinder on an adjacent rotational body in a roller strip can be adjusted individually, as needed, via a control unit, such as, for example, by addressing individual actuators which are involved in the adjustment. An existing setting can be changed, preferably via remote control, for example, even when the printing couple is in an ongoing production run.

In a particularly advantageous embodiment of the inking unit of the present invention, the inking unit has a forme roller, which cooperates with the forme cylinder, and whose diameter is the same size as that of the forme cylinder. With this same-sized forme roller, more space is provided for servicing and for automatic or semi-automatic plate changing systems. With the large forme roller, a supporting effect is exerted on the preferably single-sized forme cylinder. In one preferred embodiment, which is advantageous with respect to the limitation of vibrations, the rotational axes of the transfer cylinder, of the forme cylinder and of the forme roller of the same printing couple are arranged in the same plane, when these cylinders and roller are in the engaged position. In a further preferred improvement, the two planes of two printing couples of a blanket-to-blanket printing couple coincide. The rotational axes of the two transfer cylinders, of both of the forme cylinders and of both of the forme rollers come to lie within the same plane. In a more user-friendly solution, the planes of the transfer cylinder and of the forme cylinder can be inclined slightly, in relation to one another, from the planes of the forme cylinder and the forme roller, such as, for example, at an angle of less than 15°.

The single-sized forme cylinder advantageously has a continuous groove for use in fastening the ends of the printing forme. That groove preferably extends over the six pages width of the forme cylinder.

Advantageously, with respect to the rigidity of the printing couple, the transfer cylinders have a double-sized or even larger, such as, for example, a triple- or quadruple-sized circumference. In this case, the double-sized transfer cylinders are loaded, for example, with three printing blankets arranged side by side, which three printing blankets, in one advantageous embodiment, are arranged with their ends offset alternatingly in relation to one another by 180° in a circumferential direction. In a more cost-effective embodiment, these printing blankets are arranged with their ends aligned flush, side by side. In third and fourth embodiments, which are advantageous with respect to variable web widths, two printing blankets, each three pages wide, and situated either flush side by side, or offset by 180°, or a single printing blanket, six pages wide, can be arranged over the entire circumference of the transfer cylinder.

BRIEF DESCRIPTION OF THE DRAWINGS

Preferred embodiments of the present invention are presented in the accompanying drawings and will be described in greater detail in what follows.

The drawings show.

DESCRIPTION OF PREFERRED EMBODIMENTS

Figure 1:
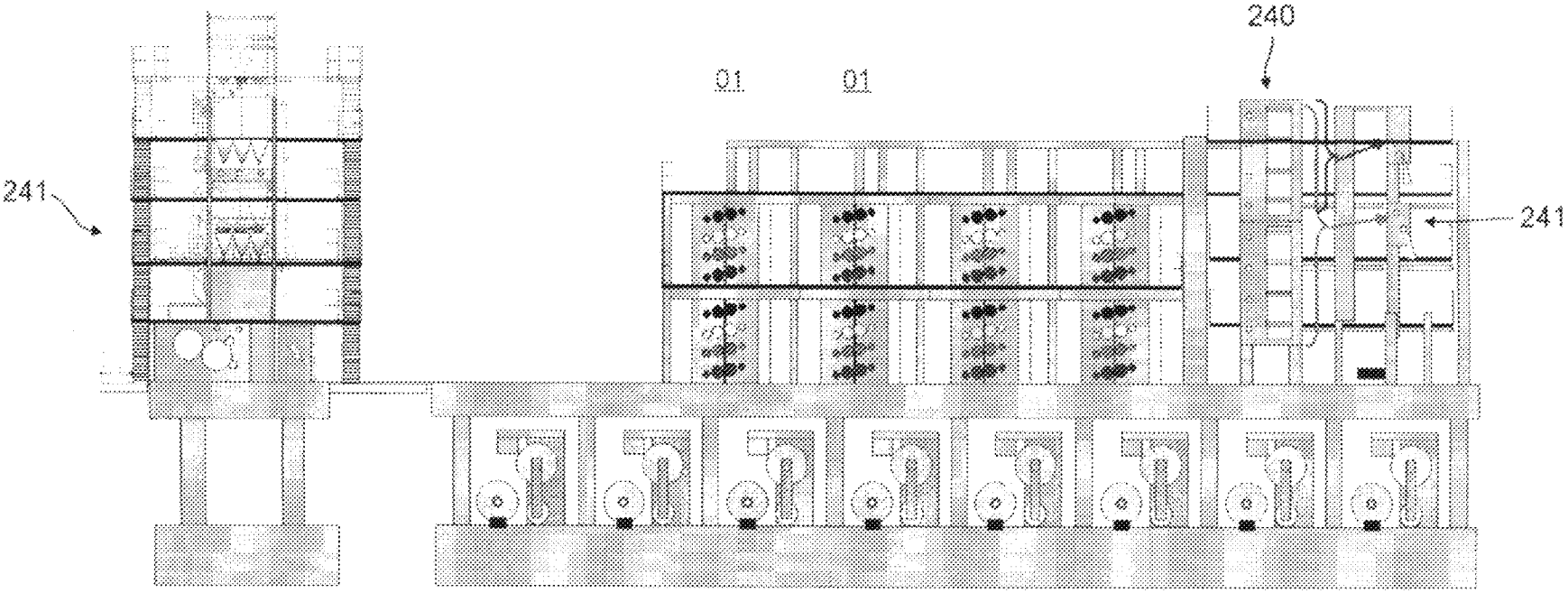
FIG. 1 a schematic representation of a printing press.

A printing press, which is schematically illustrated, for example, in FIG. 1, and which may be, for example, a web-fed rotary printing press, and in particular which may be a multicolor web-fed rotary printing press, has at least one printing unit 01. A web of material, shortened here to web, can be printed on both sides a single-time, or especially can be printed multiple times in succession, in this case, for example, four times, or a plurality of webs can be printed simultaneously, a single time or multiple times. The printing press is especially configured as a newspaper printing press, and the printing unit 01 is configured for printing on a printing substrate that is preferably embodied as newsprint paper, such as, for example, as an unlined paper or as paper having low line weights of up to 25 g/m$^2$.

In the example of the printing press, which is shown in FIG. 1, a plurality of printing towers, each comprising two stacked printing units 01, is provided. Each printing unit 01 has a plurality, and in the present case has four blanket-to-blanket printing couples 03 for use in double-sided printing in blanket-to-blanket operation, and arranged vertically, one on top of another, as depicted schematically in FIG. 2. The blanket-to-blanket printing couples 03, shown here with printing couple cylinders 06; 07 that lie within a single plane E, can, however, also be configured, in principle, in the form of bridge or n-type printing couples. Each of the blanket-to-blanket printing couples 03 is formed by two printing couples 04, each of which printing couples 04 has one cylinder that is configured as a transfer cylinder 06 and one cylinder that is configured as a forme cylinder 07, for example printing couple cylinders 06; 07, and each printing couple 03 has an inking unit 08, and, in the case of wet offset printing, also has a dampening unit 09. In each case, a blanket-to-blanket print position 05 is formed between the two transfer cylinders 06 in their engaged position. The above-described components are labeled with their respective reference numerals only on the uppermost blanket-to-blanket printing couple of FIG. 2. It will be understood that the blanket-to-blanket printing couples 03; 04, which are arranged one above another are, however, substantially identical in configuration, especially in terms of the embodiment of the features which are relevant to the present invention. The blanket-to-blanket printing couples 03 can also be configured differently from the representation of FIG. 2, without the advantageous feature of a linear or planar arrangement, as an n-unit that is open toward the bottom, or as a U-unit that is open toward the top.

In advantageous embodiments of the present invention, the printing unit 01 has one or more of the following features, based upon printing requirements, machine type, the technology that is used and/or the project stage. The printing unit 01 or the blanket-to-blanket printing unit 03 is/are configured such that they can be functionally separated, for example, at the center, in the area of the blanket-to-blanket print position or positions 05. The inking units 08 and, if applicable, dampening units 09 can have a "large" forme roller. The cylinder bearings can be adjusted via power control in linear bearings. The rotational axes of the printing couple cylinders 06; 07 in the print-on position can be configured so as to lie substantially within a shared plane. The rollers may be power-controlled in roller sockets. The transfer cylinder may be twice the size of the forme cylinder and/or may have corresponding printing blankets, especially metal printing blankets. Furthermore, the embodiment of the present invention can be further improved upon, in an advantageous manner, by the provision of special individual drives for the cylinders 06; 07. In an advantageous embodiment, this also applies to the mechanical independence of the drive for the inking unit 08 and, if applicable, the drive for the dampening unit 09 from the drives for the printing couple cylinders 06; 07.

In principle, one or more of the aforementioned characterizing features are also viewed as advantageous for printing units 01 that are not printing couples 04, configured as blanket-to-blanket printing units 03 used in blanket-to-blanket printing, and instead which have printing couples 04 that operate only in straight printing. The transfer cylinder 06 of a printing couple 04 then acts in cooperation with an impression cylinder, which is not specifically shown. Then, rather than the two cylinders 06; 07 of the second printing couple 04 and the inking unit 08, only an impression cylinder can be used. For arrangement between the side panels, what will be discussed below with respect to the other cylinders 06; 07, can then also apply to such configurations.

Figure 2:
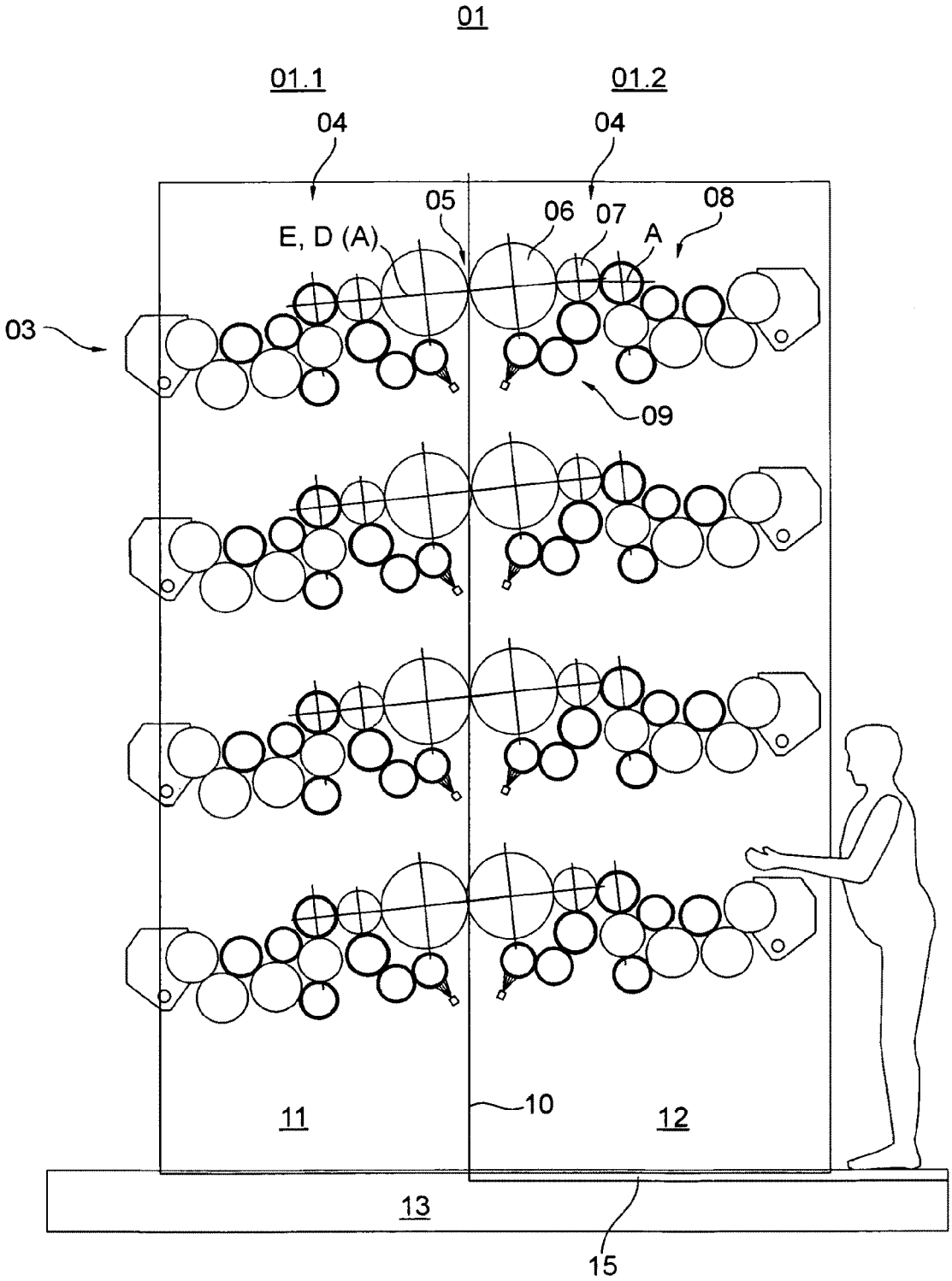
FIG. 2 a schematic representation of a printing tower of the printing press of FIG. 1.

FIG. 2 shows an embodiment of the printing unit 01, which is advantageous in terms of its easy operability, for example. This printing unit 01 is embodied, by way of example, to be functionally separable in the area of its blanket-to-blanket print position(s) 05, such as, for example, for maintenance and for servicing purposes, as opposed to for dismantling or disassembly. The two parts that can be separated from one another, including cylinders 06; 07, inking units 08 and, if present, dampening units 09 are labeled, in the discussion which follows, as printing unit sections 01.1 and 01.2, where this may be necessary and/or logical.

In addition, the printing couple cylinders 06; 07 of the multiple, such as, for example, the four blanket-to-blanket printing units 03 arranged one above another, are rotatably mounted in or on one right frame or panel section 12 and one left frame or panel section 11, for example, side frame 11; 12, in such a way that the two printing couple cylinders 06; 07 of the same printing couple 04 are allocated to the same frame or panel section 11; 12. The printing couple cylinders 06; 07 of multiple, and especially all of the printing couples 04 that print the web on the same side are preferably mounted on the same frame or panel section 11; 12. In principle, the printing couple cylinders 06; 07 can be mounted on only one side, such as, for example, by being cantilevered, on only one outside-surface frame section 11. Preferably, however, two frame sections 11; 12, which are arranged at the ends of the cylinders 06; 07 are provided for each printing unit section 01.1; 01.2. The two parts that can be separated from one another are hereinafter referred to as printing unit sections 01.1 and 01.2, which comprise the respective frame sections 11; 12 and printing couples 04, including printing couple cylinders 06; 07 and inking units 08.

In an advantageous embodiment of the present invention, the printing unit sections 01.1; 01.2 can be moved, in a direction that runs perpendicular to the rotational axis of the cylinders 06; 07, relatively toward one another or away from one another. One of the two sections, in this case printing unit section 01.1, is preferably mounted fixed in space, for example, it is mounted stationarily on a section of floor 13 in the printing shop, on a stationary base 13, on a mounting plate 13 or on a mounting frame 13 for the printing unit 01. The other, in this case printing unit section 01.2, is mounted so as to be movable in relation to the floor 13 or base 13 or mounting plate 13 or mounting frame 13, hereinafter support 13. In FIG. 2, the printing unit sections 01.1 and 01.2 are shown pushed together. They can be moved away from one another in the area of the schematically represented line of separation 10.

The outer frame sections 12 are mounted in bearing elements for the frame section 12 and the base 13. These bearing elements correspond with one another and are not specifically shown in FIG. 2, and together form a linear guide 15, for example. These bearings can be configured as rollers that run on rails or as slider- or roller-mounted linear guide elements that are allocated to one another.

The side frame sections 11; 12 are preferably structured such that, in their adjoined operating position, as shown in FIG. 2, their sides that face one another are configured to have substantially complementary shapes in pairs, and to nevertheless form a substantially closed side front at their lines of separation 10 and/or to form lines of contact when adjoined. The maintenance position, in which there is a space between the two side frame sections 11; 12, is not shown in FIG. 2.

The relative positioning of the printing unit sections 01.1; 01.2, in relation to one another, can also be achieved by moving the frame sections 12, or in another embodiment, in the two printing unit sections 01.1; 01.2 or their frame sections 11; 12 can both be movably mounted.

The forme cylinders 07 and the transfer cylinders 06 are preferably each configured to have a cylinder width of at least four, and, for especially high product output, six, vertical print pages arranged side by side in newspaper format, and especially in broadsheet format. In this way, a double-width web can be printed with four newspaper pages side by side, or preferably a triple-width web can be printed with six newspaper pages side by side. The forme cylinder 07 can be correspondingly loaded with four or preferably with six printing formes arranged side by side, particularly with their ends flush against one another. In the advantageous format embodiment shown schematically in FIG. 3, the forme cylinders 07 each have a circumference that corresponds substantially to one printed page, and especially to a vertical printed page, in a newspaper format. For example, a printing forme 22 is arranged on each forme cylinder 07, which extends substantially around the entire circumference of each forme cylinder 07, and the printed image supports only one printed page in newspaper format.

To hold the printing formes 22, the forme cylinder 07 advantageously has a groove 19, with an opening facing toward the circumferential surface, for use in holding the printing formes 22, which groove 19 is preferably configured as continuous over the entire active length of the cylinder. The forme cylinder 07 can then be loaded with four or particularly can be loaded with six printing formes side by side, as is depicted schematically in FIG. 3.

The groove 19, which is continuous in the axial direction of the forme cylinder 07, and/or corresponding plate end clamping devices are configured in such a way that at least a plurality of individual printing formes 22, each of one or two newspaper pages in width, can be fastened side by side in the axial direction. In one operational situation, the forme cylinder 07 can then be configured with a printing forme 22 that is one printed page in length in the circumferential direction, and with a plurality of printing formes 22, for example four or preferably six such printing formes, that are one printed page in width in the longitudinal direction. It is also possible to arrange printing formes 22 that are one printed page in width, and two or even three printed pages in width, mixed, side by side, or simply a plurality of printing formes 22 that are two or even three printed pages in width, side by side on the forme cylinder 07, which carry a total, for example, of four, but preferably carry six, print images of printed pages.

In a first preferred embodiment, which is not specifically depicted, in a double-sized format, with two newspaper pages, one behind another, in circumference, the transfer cylinder 06 has, for example, only one groove 21 for holding one or more, for example, two dressings 23 arranged side by side, especially two printing blankets 23, with that groove 21 then also being preferably continuous in configuration over the entire active cylinder length. The transfer cylinder 06 can then be loaded with one printing blanket 23, which is continuous over the cylinder length and which extends over substantially the entire circumference, or with two or three printing blankets arranged axially side by side, and which extend over substantially the full cylinder circumference, wherein their ends are flush with one another, as viewed in the longitudinal direction of the cylinder 06. Each of the printing blankets 23 is preferably configured as a multilayered printing blanket 23, which is configured as a metal printing blanket 23, having a dimensionally stable support plate with a flexible layer, as will be discussed below.

In another configuration of the double-sized transfer cylinder 06, that cylinder can have two or three printing blankets 23 arranged side by side. The respective adjacent blankets can be offset 180° from one another in the circumferential direction. These two or three printing blankets 23, which are offset from one another, can be held in two or three groove sections, which are also arranged side by side in the longitudinal direction of the cylinder 06. The respectively adjacent groove sections may be offset 180° from one another in the circumferential direction.

Figure 3:
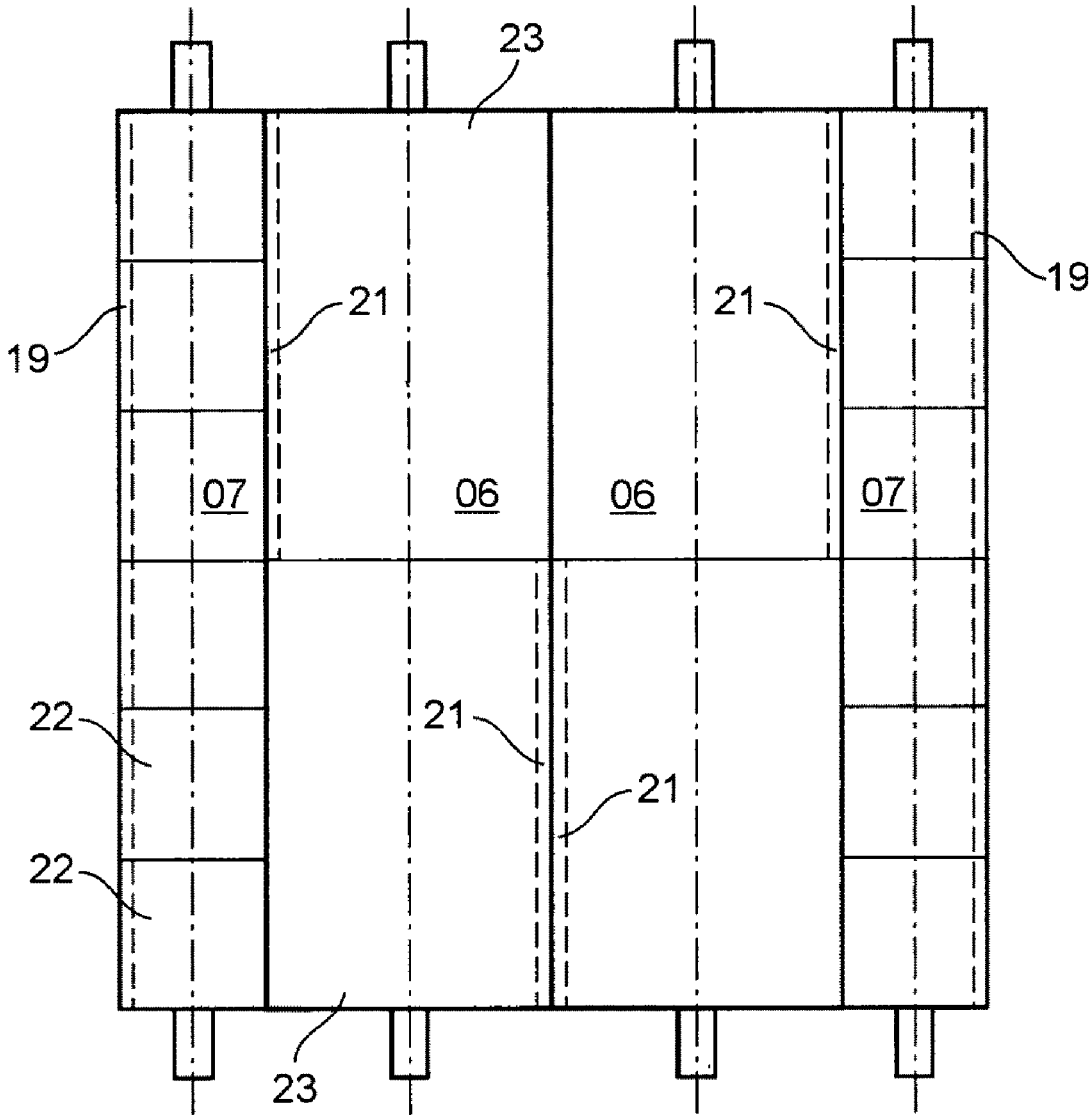
FIG. 3 a schematic representation of a first preferred embodiment of coordinating printing couple cylinders in accordance with the present invention.
Figure 4:
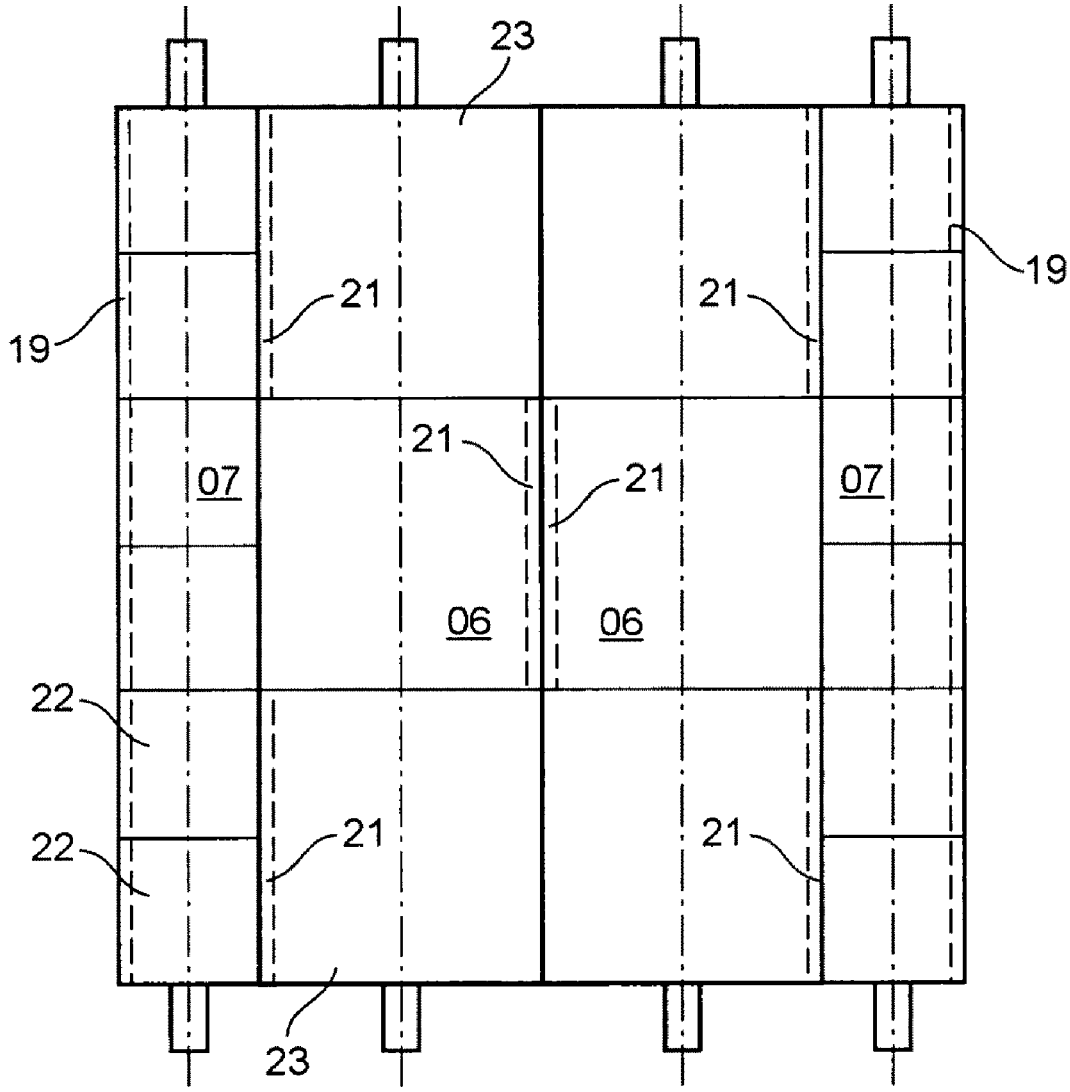
FIG. 4 a schematic representation of a second preferred embodiment of the coordinating printing couple cylinders.

FIG. 3 and FIG. 4 show schematic representations of the printing couple cylinders 06; 07, wherein the transfer cylinder 06 is configured with a double circumference, or is double sized, for the purpose of increased stability, and the forme cylinder 07 is configured with a single circumference or is single sized. Each of the forme cylinders 07 has a continuous groove 19, as described above, and in this example, six single-width printing formes 22, with one printed page on each printing forme 22. In FIG. 3, the transfer cylinder 06 has two grooves 21 situated side by side in the longitudinal direction, which are offset 180° in relation to one another in the circumferential direction, and in which the two printing blankets 23, and preferably the two printing blankets 23 that are each three printed pages in width, are held side by side. In the embodiment shown in FIG. 4, three printing blankets 23 that are each two printed pages in width are held in three grooves 21, which grooves 21 are side by side in the longitudinal direction, but are alternatingly offset 180° from one another in the circumferential direction.

In an embodiment that is not specifically shown, the transfer cylinder 06 in what follows can also be alternatively configured as a transfer cylinder 06 having a circumference of one vertical printed page, and particularly a newspaper page in broadsheet format and thus is single-sized. In this case, transfer cylinder 06 can also have a single, full-circumference printing blanket 23, or can have two or three full-circumference printing blankets 23 which are arranged flush, side by side. In principle, any combination of forme and transfer cylinders 07; 06 having a whole-number circumferential ratio of forme cylinder to transfer cylinder 07; 06, for example, of 1:1, 1:2, 1:3, 1:4, but preferably with a single-sized forme cylinder and with a multiple-sized transfer cylinder 06 can be used. The characteristics of the printing unit 01, that do not relate to the dimensions of the transfer cylinder 06, can then be applied to this, alone or in combination.

Figure 16:
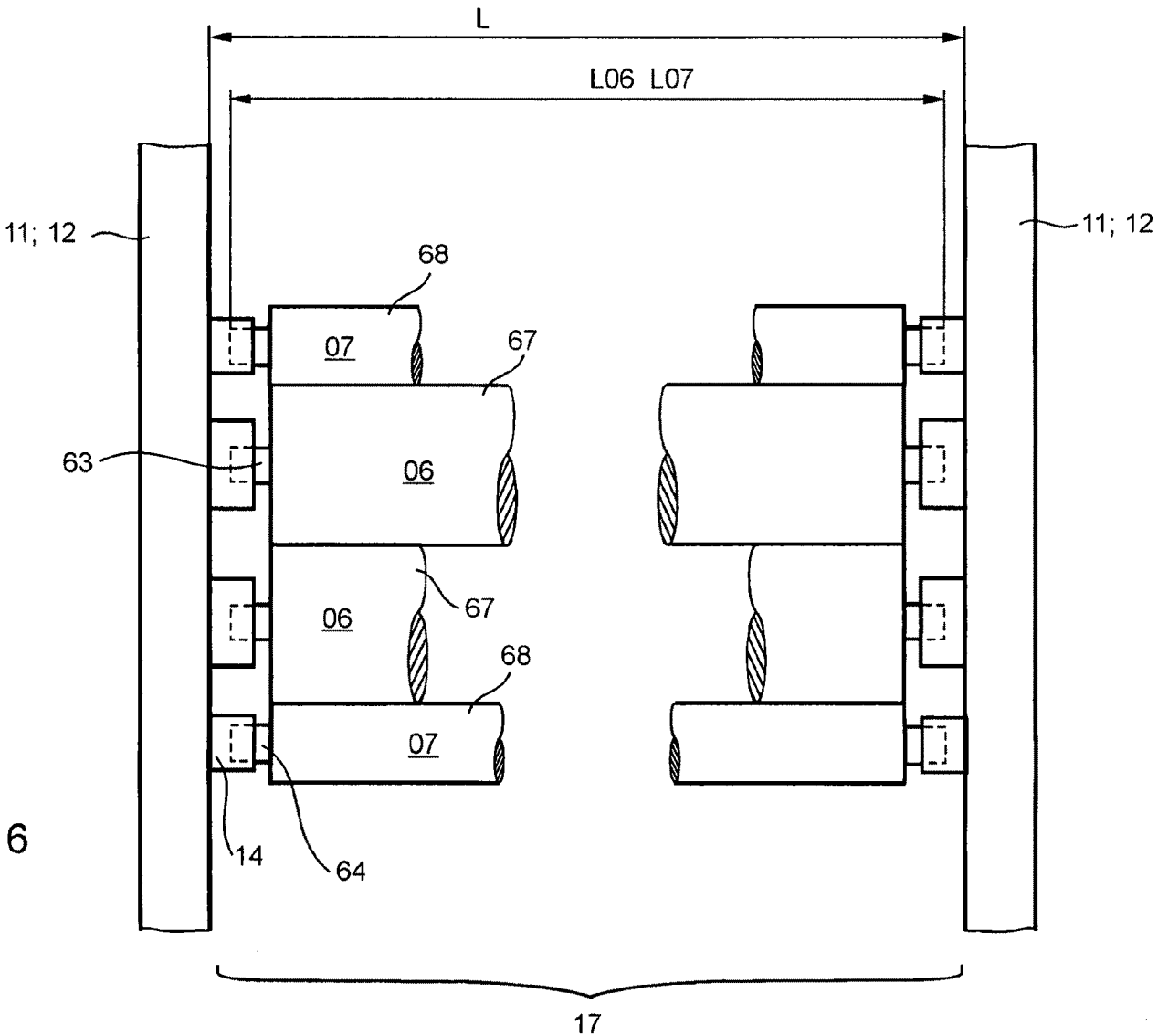
FIG. 16 a top plan view of a blanket-to-blanket printing couple.

Modules, that can be configured as cylinder units 17, have, for example, a cylinder 06; 07 with journals 63; 64 and a bearing unit 14 that can be pre-assembled on the journals 63; 64, and which can be pre-tensioned and/or pre-adjusted. Bearing unit 14 and cylinders 06; 07 receive their firmly defined position, in relation to one another, before being placed in the printing unit 01, and they are rigid and can be installed as a unit into the printing unit 01, all as seen in FIG. 16.

The circumferences of the double-sized cylinders 06 can lie between 840 and 1,300 mm, and preferably between 860 to 1,120 mm, and the circumferences of the single-sized cylinders 07 can lie correspondingly between 420 and 650 mm, and preferably between 430 and 560 mm, or even between 430 and 540 mm.

In printing presses having very wide, but slender cylinders 06; 07, and particularly having slender forme cylinders 07, such as, for example, in 6/1 presses, with 1 printed page, especially one vertical newspaper page, in circumference and 6 printed pages side by side, the geometry of the forme cylinder 07 is very critical with respect to sag and cylinder vibrations.

One solution for the printing couple 04 or for the inking unit 08, in accordance with the present invention, and which is represented schematically in FIGS. 5 through 11, helps to counteract these problems. Inking units 08 that are configured in this manner can be arranged in a printing unit 01 having one or more of the features of the preferred embodiments of the present invention.

Figure 11:
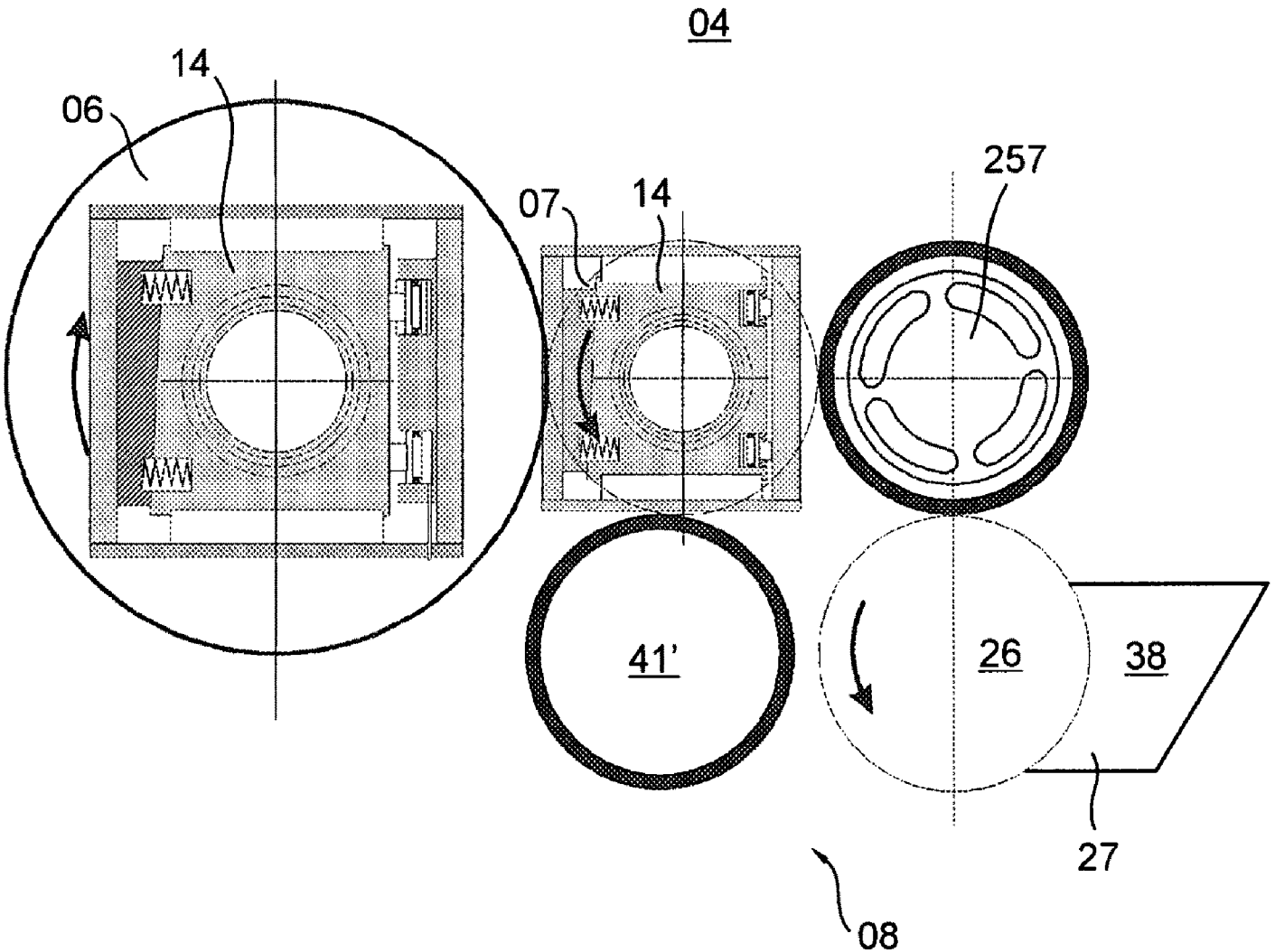
FIG. 11 an embodiment of an inking unit.

In one advantageous embodiment, as represented by way of example in FIG. 5 through FIG. 9 and in FIG. 11, transfer cylinder 06, forme cylinder 07 and roller 28, for example forme roller 28, and particularly ink forme roller 28, are arranged linearly. In the print-on position, the rotational axes of these three cylinders and roller lie substantially within a shared plane E, which is defined by the rotational axes of the forme and transfer cylinders 07; 06 in the print-on position. In this embodiment, the plane E of the cylinders 06; 07 coincides with a plane A, which is formed by the rotational axes of the forme cylinder 07 and the cooperating roller 28, which for example is a forme roller 28, and preferably is an ink forme roller 28, in the print-on position or operational position, as seen in the examples of FIG. 5 through 9.

The ink forme roller 28 is configured as a "large" ink forme roller 28 and corresponds, in its diameter substantially, with a maximum deviation +/−5%, and preferably of at most +/−2%, to that of the forme cylinder 07, in other words, for example, substantially corresponds to the length of a printed page, for example a printed page, for example a newspaper page. The diameter of the roller 28 is preferably its undistorted diameter, i.e., without any impression that is caused by engagement. The diameter of the forme cylinder 07 is preferably the total effective diameter when the forme cylinder 07 is loaded with the print master, for example with the printing forme or formes 22.

The 1:1 ink forme roller 28 supports the forme cylinder 07 by virtue of the former's large diameter and its geometric arrangement, for example, in the plane with the groove openings.

As an alternative to a soft inking roller cover, which serves to cushion vibration effects, in the present examples, and to provide the desired support function, a roller cover for this ink forme roller 28 having a Shore hardness A>50, can advantageously amount, for example, to between 60-80. In a further improvement, the ink forme roller 28 can be slightly convex, with a convexity of 0 to 0.5 mm, and particularly of 0 to 0.3 mm over the active cylinder length.

Another embodiment of this first ink forme roller 28 would be having a roller cover configured as a sheathing, for example, as a sleeve, which sleeve can be pulled on over the roller body, or with a roller cover, which is fastened in the manner of a printing blanket, in a manner that is comparable with a printing blanket 23 arranged on the transfer cylinder 06, as will be discussed subsequently, in a groove that extends lengthwise along the roller body of the roller 28.

The ink forme roller 28 should be adjusted with a defined amount of force. This can be accomplished either by mounting the roller journal 256 in a linear bearing 252, with a lever 254 that can be pivoted using a pressure-actuable positioning element 253, or through the use of an automatic roller socket 257, which can be acted upon by a pressure medium, as will be discussed below.

Figure 5:
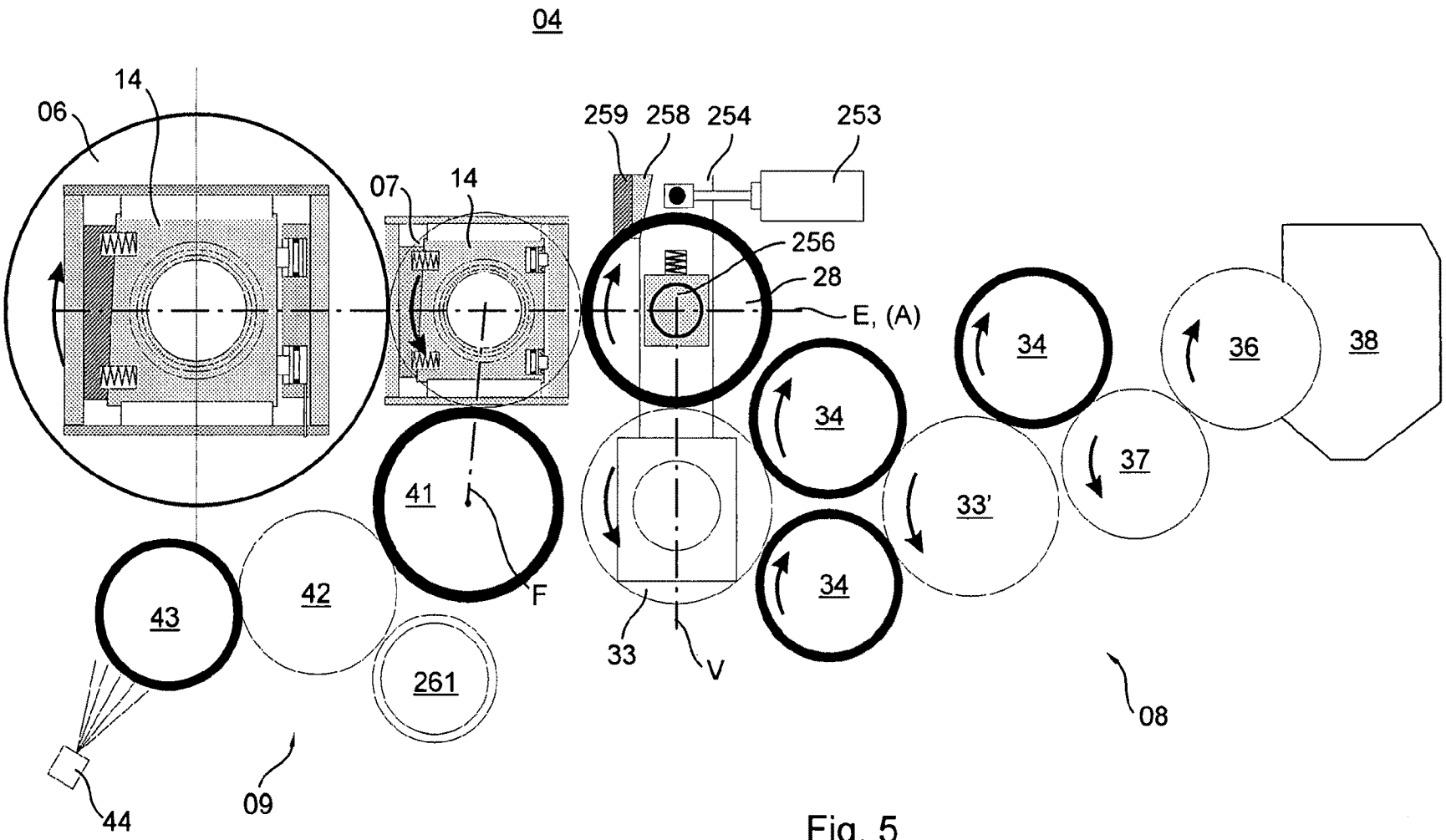
FIG. 5 an embodiment of an inking unit.
Figure 6:
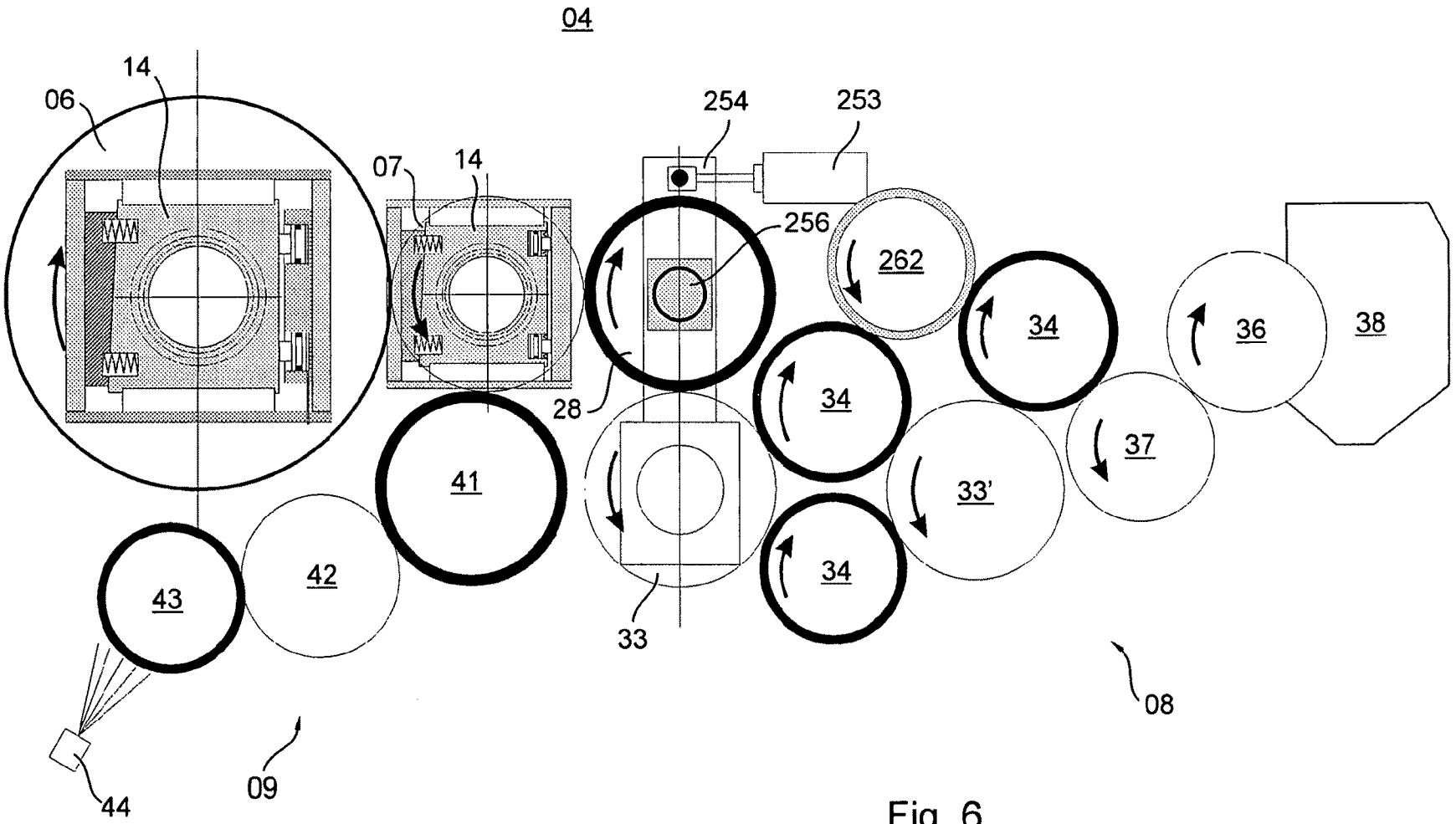
FIG. 6 an embodiment of an inking unit.
Figure 7:
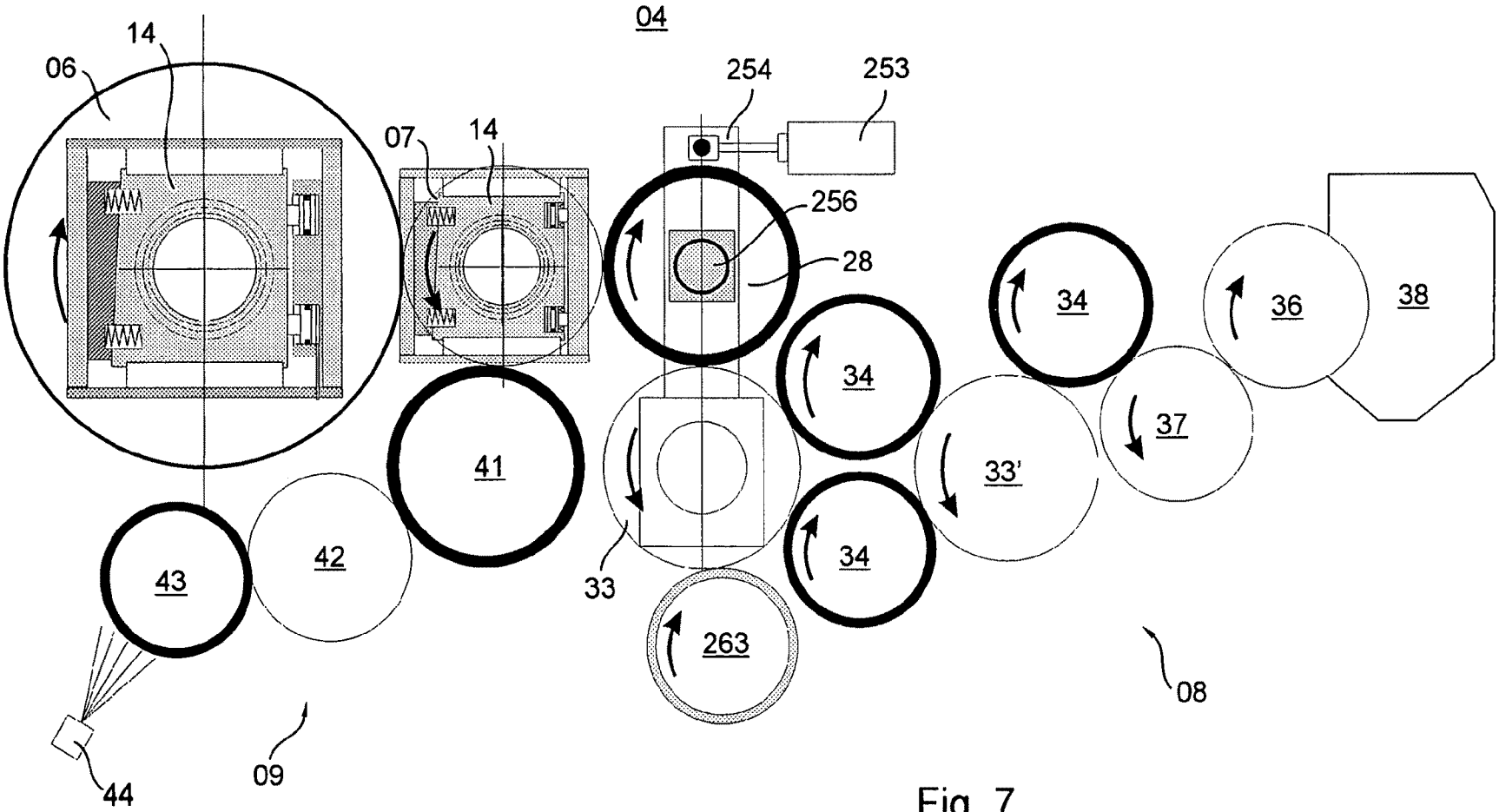
FIG. 7 an embodiment of an inking unit.

In the preferred embodiment shown in FIG. 5 through 7, the mounting of the large first ink forme roller 28 is accomplished, by way of example, in the lever 254. However, the embodiments can also be transferred to the use of the roller socket described below, or to the linear mounting. The power adjustment can also be automated with the help of an adjustable wedge 258 and stop 259, in a manner that corresponds to that which will be described below in reference to the wedge 79 of the bearing unit 14. A roller 33, such as, for example, a distribution roller 33, and particularly a distribution cylinder 33, which is capable of oscillating in an axial direction, and which cooperates with the first ink forme roller 28, preferably also has substantially the same diameter as the forme cylinder 07, in order to avoid displacing the printing template on the 1:1 forme roller.

The distribution cylinder 33, which is closest to the forme cylinder, is advantageously arranged in an embodiment such that the plane of connection E of the rotational axes of forme cylinder 07 and ink forme roller 28 forms an angle with a plane of connection V between the rotational axes of ink forme roller 28 and distribution cylinder 33 amounting to, for example, 70-110°, and advantageously to 80 to 100°, especially 90°+/−5°, and most advantageously to 90°. Successive rollers 34; 37; 36 and a distribution cylinder 33', which is positioned remotely from the forme cylinder, can be configured to have smaller diameters, in the customary structure.

In one advantageous configuration of the arrangement of the distribution cylinder 33 closest to the forme cylinder, the distribution cylinder, for the relevant variants, is arranged in such a way that the plane of connection V between the rotational axes of ink forme roller 28 and the distribution cylinder 33 extends substantially vertically, or deviates from the vertical by at most +/−20°, advantageously by at most +/−10°, and preferably by at most +/−5°. This criterion can be applied especially advantageously if the plane E extends inclined in relation to the horizontal.

The distribution cylinder 33 which is closest to the forme cylinder cooperates, for one, with the large first ink forme roller 28, and upstream also cooperates with at least one roller 34, such as, for example, an ink forme roller 34, and especially an ink transfer roller 34, for example, with a soft surface, and especially cooperates with two such transfer rollers 34. In one advantageous embodiment of the inking unit 08, the distribution cylinder 33 receives the ink from a second distribution cylinder 33', which is positioned more distant from the forme cylinder. The remote distribution cylinder 33', for its part, receives the ink via at least one additional transfer roller 34, such as, for example, with a soft surface, a roller 37, and especially a film roller 37, and a roller 36, especially an ink fountain roller or a dipping roller 36, from an ink fountain 38. Dipping and film roller 36; 37, as is characteristic of a film inking unit, can also be replaced by a different ink supplying and/or metering system, such as, for example, a pump system in an ink injector system, or a vibrator system in a vibrator inking unit. In one embodiment, the distribution cylinders 33, 33', together, or each separately, are rotationally driven by an individual drive motor, which is independent of the cylinders 06; 07. For the roller 36, and in a further improvement, also optionally for the film roller 37, an individual rotational drive motor is also preferably provided. In the event of an increased demand for variation, the oscillating motion of the distribution cylinders 33; 33', together or individually, can be generated by a separate drive element, or, as shown here, can be accomplished at a decreased cost, via a transmission, which converts the rotational motion of each distribution cylinder 33; 33' into axial motion.

Preferably, the inking unit 08, represented schematically in FIG. 5 through 10, is configured as a so-called "long" inking unit 08 with two distribution cylinders 33; 33' arranged in series in the path of the ink flow.

In the case of a printing couple 04 for wet offset printing, as is presented by way of example in FIG. 5, the geometric positioning of a dampening forme roller 41 can also support the forme cylinder 07. In this case, the dampening forme roller 41 can preferably be arranged such that the plane of connection E between the rotational axes of the forme cylinder 07 and the first ink forme roller 28 forms an angle, with a plane of connection F between the rotational axes of forme cylinder 07 and the dampening forme roller 41, that amounts, for example, to 70-110°, advantageously to 80 to 100°, especially to 90°±/−5°, and most advantageously to substantially 90°. In one advantageous variation of the positioning of the dampening forme roller 41, that roller, for the relevant variants, is arranged in such a way that the plane of connection F between the rotational axes of the forme cylinder 07 and the dampening forme roller 41 extends substantially vertically, or deviates from the vertical by at most by +/−20°, advantageously by at most +/−10°, and especially by at most +/−5°. This criterion can be applied to particular advantage if the printing couple 04 or the plane E extends inclined in relation to the horizontal.

This dampening forme roller 41 can also preferably have substantially the circumference of the forme cylinder 07, and/or can advantageously be convex in configuration, up to +/−5%, especially up to +/−2%.

Preferably, the dampening unit 09 is configured as a so-called contactless dampening unit 09, and is especially configured as a spray dampening unit 09. The dampening solution is transferred to a last roller 43 of the dampening unit 09 in a contactless fashion, from a dampening solution source 44. This can be accomplished, for example, via contactless spinners, contactless brushes, or in some other manner, but preferably by using spray nozzles of a spray bar 44. If three rollers 41; 42; 43 lie in a row between spray bar 44 and forme cylinder 07, without optionally present rider rollers, the roller 41 that cooperates with the printing forme, for example the forme roller 41, and specifically the dampening forme roller 41, is preferably configured with a soft surface, such as, for example, rubber. A subsequent roller 42, which is preferably structured as an oscillating distribution cylinder 42, is configured with a hard surface, for example of chromium or noble steel, and, in the case of a three-roller dampening unit 09, the roller 43 that receives the dampening solution from the dampening solution source 44 is configured with a soft surface, such as, for example, rubber. In the case of an alternative, four-roller, contactless dampening unit 09, a fourth roller, which is not specifically shown here, and with, for example, a hard surface, is placed against the soft roller 43. That fourth roller receives the dampening solution. In this embodiment, the distribution cylinder 42 is preferably driven by its own rotational drive motor, which is independent of the cylinders 06; 07. The two rollers 41 and 43 are driven by friction. In an alternative arrangement, an individual rotational drive motor can also be provided for the roller 43. The oscillating motion of the distribution cylinder 42 can be provided by an individual, separate drive element, or, as is provided here, at reduced cost, by a transmission, which converts the rotational motion of the distribution cylinder into axial motion.

In a variation of the subject invention, that is not specifically shown here, the roller 42 is configured with an ink-friendly or oleophilic surface. A contact wetting angle with the corresponding fluid, and especially with the ink, is smaller than 90°. The surface may be for example, made of rubber or plastic, such as, for example, a polyamide material. Therefore, in this embodiment, the circumferential surfaces of all three rollers 41; 42; 43 of the dampening unit 09 are configured with an ink-friendly or an oleophilic surface, wherein the contact wetting angle with the corresponding fluid, especially the ink, is smaller than 90°.

In a further variation, the center roller 42 of the three rollers 41; 42; 43 of the dampening unit roller train has an ink-friendly outer or circumferential surface 45 made of plastic, such as, for example, a polyamide material, especially such as Rilsan.

A "soft" surface in this case is a surface that is flexible in a radial direction, having a modulus of elasticity, in a radial direction of, preferably, at most 200 mPa, and especially less than, or equal to 100 mPa. The roller 43, which receives the dampening solution from the dampening solution source 44, and/or the roller 42, which is arranged downstream in the roller train, in the direction of the forme cylinder 07, preferably has a circumferential surface having a hardness level ranging from 55° to 80° Shore A. The roller 41 that applies the dampening solution to the forme cylinder 07 preferably has a circumferential surface 45 having a hardness level that ranges from 25° to 35° Shore A.

In principle, the dampening unit 09 can also be configured as a contact dampening unit 09, such as a film dampening unit, a vibrator, a cloth, or a brush dampening unit, with a total of three rollers, arranged in series between the dampening solution source and the forme cylinder 07.

In the configuration according to FIG. 5, the dampening film on the distribution cylinder 42 of the dampening unit 09 can be smoothed by an additional roller 261.

In place of the positioning element 253 and the pivotable lever 254, in FIG. 8, the linear bearing 252, which is described below with reference to the example of the linear bearing 14, or the roller socket 257 described below in connection with FIG. 9, can also be used.

In FIG. 6 and FIG. 7, the printing couple 04 is represented similarly to that of FIG. 5. In FIG. 6, rather than the additional roller 261, an additional roller 262, and in FIG. 7 an additional roller 263, is arranged in the inking unit 08. Two or even three of the aforementioned rollers 261; 262; 263 can also be provided at the same time.

Figure 8:
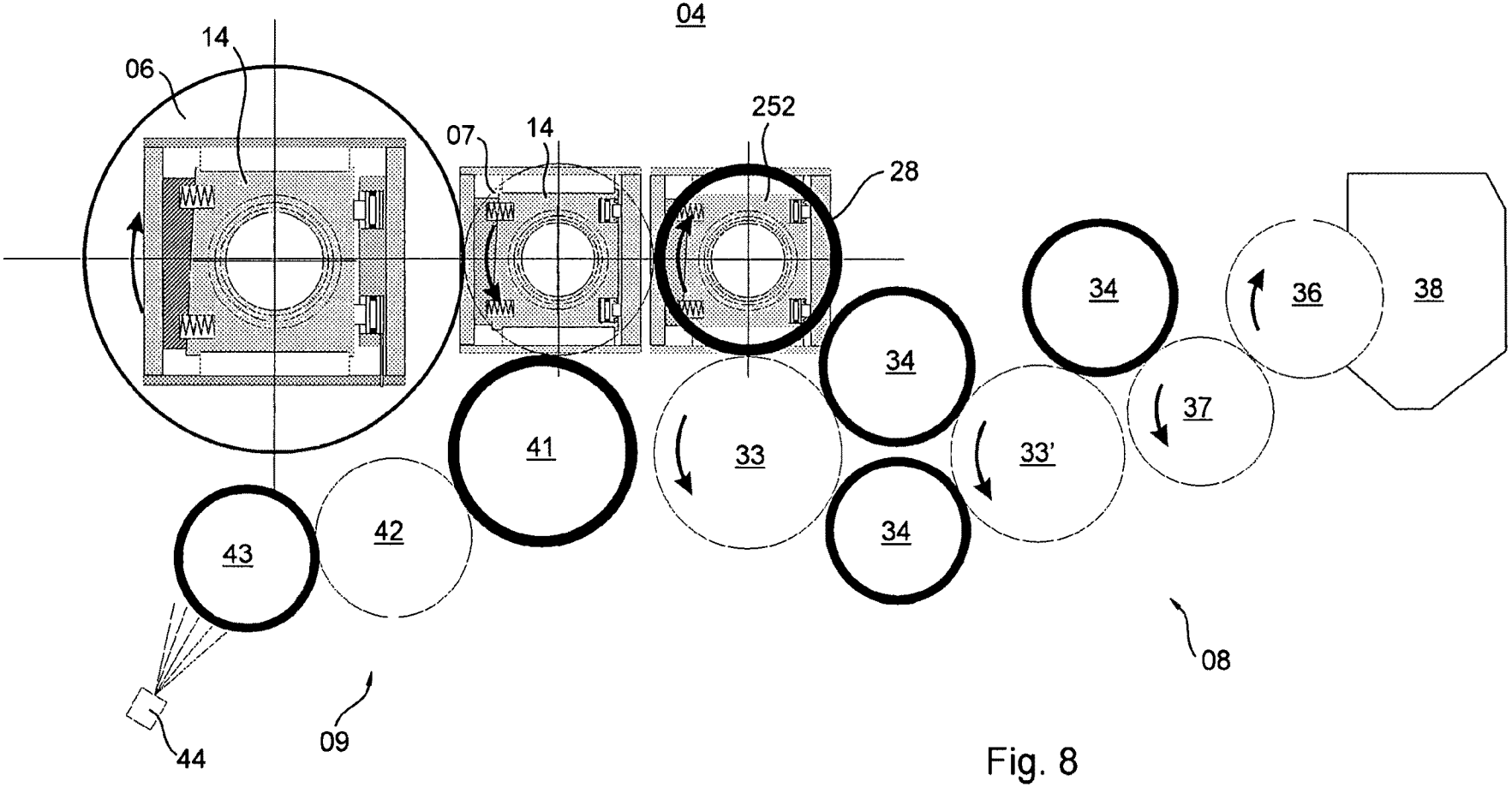
FIG. 8 an embodiment of an inking unit.

In FIG. 8, the printing couple 04 is represented, by way of example, using a linear bearing 252. In this case, the rollers 261; 262; 263 from the above examples can also be provided, singly or together.

Figure 9:
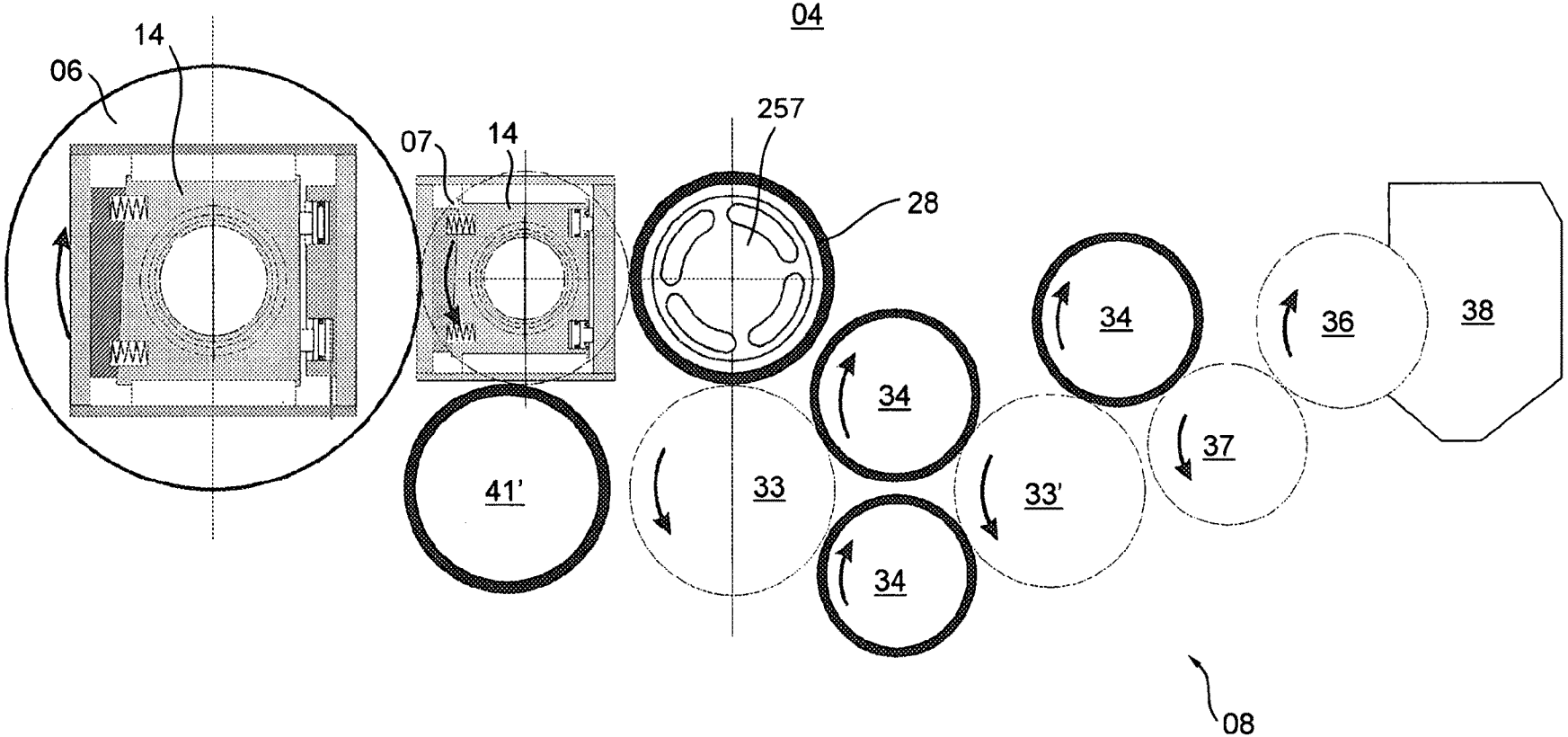
FIG. 9 an embodiment of an inking unit.

In FIG. 9, the printing couple 04 is represented using a roller socket 257. In this case, the rollers 261; 262; 263 described above can also be provided singly or together. A dampening unit 09 in accordance with the preceding FIGS. 5 through 8 can also be provided. However, FIG. 9 is also configured, by way of example, without a dampening unit 09 for dry offset or waterless printing. Nevertheless, the roller 41 can be provided as a support roller 41'. The configuration for waterless offset printing, without a dampening unit can be transferred, with or without the remaining support roller 41', to the embodiments of the inking units 08 of FIGS. 5 through 8. If the roller 41 functions only as a support roller 41', its surface should have a Shore hardness A of >50, and preferably of, for example, 60-80.

Figure 10:
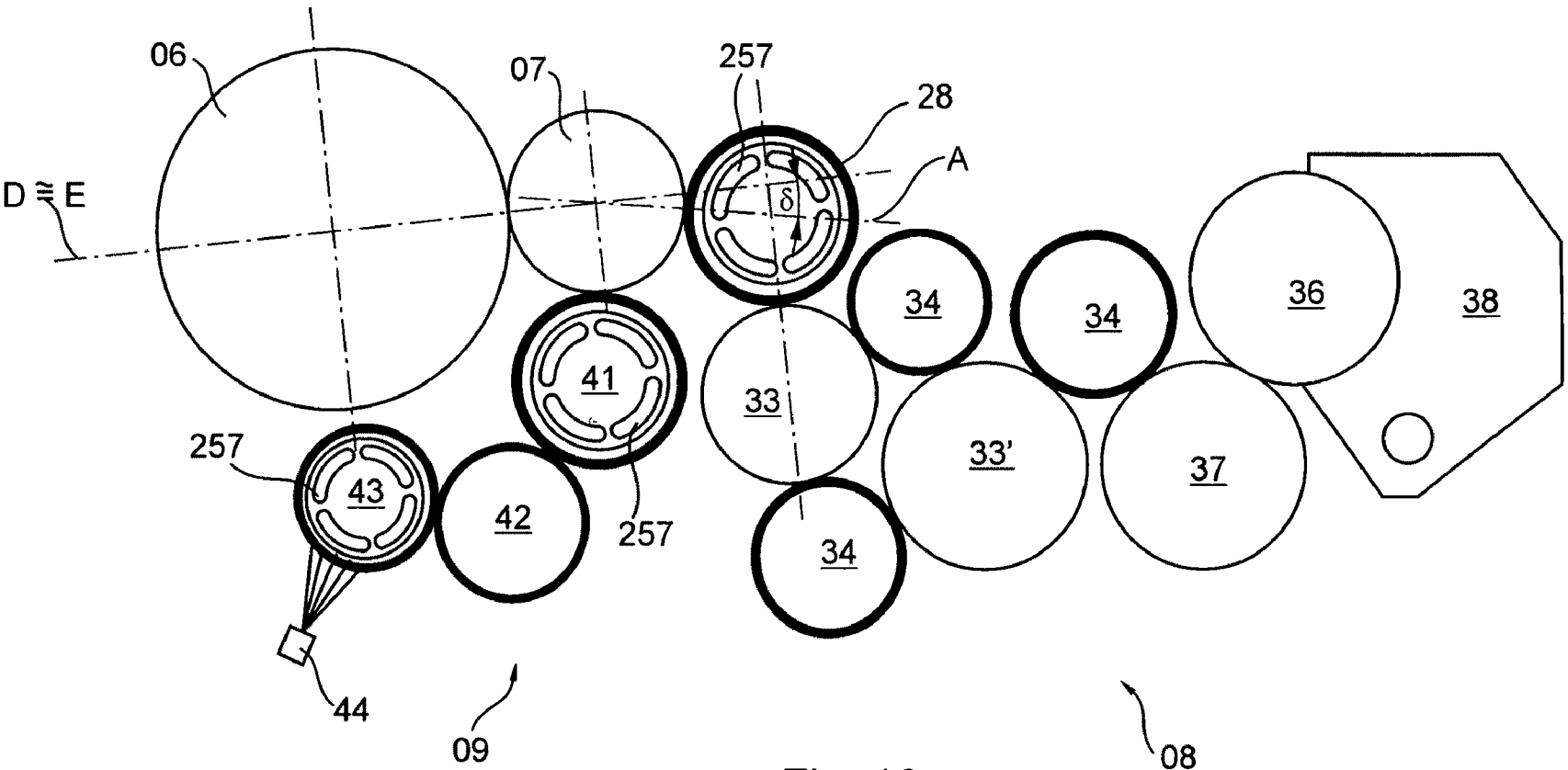
FIG. 10 an embodiment of an inking unit.

In contrast to the embodiments of the present invention, in accordance with FIG. 5 through 9, planes E and A, in the embodiment that is represented in FIG. 10, do not coincide, but rather, in this case and even in the operational position, form an angle δ that is different from zero, with, for example, $\delta \leqq 45°$, advantageously $\delta \leqq 30°$, especially $\delta \leqq 15°$. Although this positioning of the roller 28 does somewhat less to cushion the impacts extending in the plane E during the nip passage of the cylinders 06; 07, it does effectively guarantee a support of the forme cylinder 07 against impacts extending in the plane E, based upon the above-mentioned angular area. Including the embodiments according to FIG. 5 through 10, the ink forme roller 28 is therefore arranged such that, in the operating position, the plane A, which is defined by the rotational axes of the forme roller 28 and the forme cylinder 07, forms an angle $\delta \leqq 45°$, advantageously $\delta \leqq 30°$, especially $\delta \leqq 15°$, or even substantially 0° with the plane E, which is defined by the rotational axes of the forme cylinder 07 and the transfer cylinder 06. In addition, what has been described above, in relation to the plane V with respect to the distribution cylinder 33, and or in relation to the plane F with respect to the dampening forme roller 41 or the support roller 41', can be advantageously applied in this embodiment depicted in FIG. 10.

For all the examples of FIG. 5 through 10, the "long" inking unit 08, which has an ink forme roller 28, at least two distribution cylinders 33; 33' arranged in series, at least two transfer rollers 34, at least one of which is between the distribution cylinders 33; 33' and one of which is on the inking path between the ink supply, such as, for example, ink fountain 38 or ink injector line and the distribution cylinder 33' that is remote from the forme cylinder, is very "slender" in configuration. In other words, the inking unit 08, including the ink supply, the ink fountain, and the like, is significantly longer, for example by a factor of 1 to 2, in a direction running parallel to a plane D, which plane D is defined by the two cylinders 06 that form the print position 05, than in the direction perpendicular to this plane D.

In the case of printing couples 04 for use in wet offset printing, the printing couples 04, as shown here, are preferably configured for pre-dampening. After a point on the forme cylinder 07 passes through the nip point with the transfer cylinder 06, this point comes into active contact first with the dampening forme roller 41, and only then with the ink forme roller 28.

In an embodiment of the inking unit 08, as is represented in FIG. 11, this inking unit is configured as an anilox inking unit with a roller 26, which is configured as a large anilox roller 26. This roller preferably assumes the same position described above, in reference to FIG. 5, for the distribution cylinder 33 that is close to the forme cylinder. The embodiment of this inking unit 08 as an anilox inking unit 08 can be configured in combination with one of the dampening units 09 that is described in FIG. 5 through 9, and/or also, in place of the roller socket 257, with the corresponding actuators, in combination with the lever 254 or the linear bearing 252.

Figure 12:
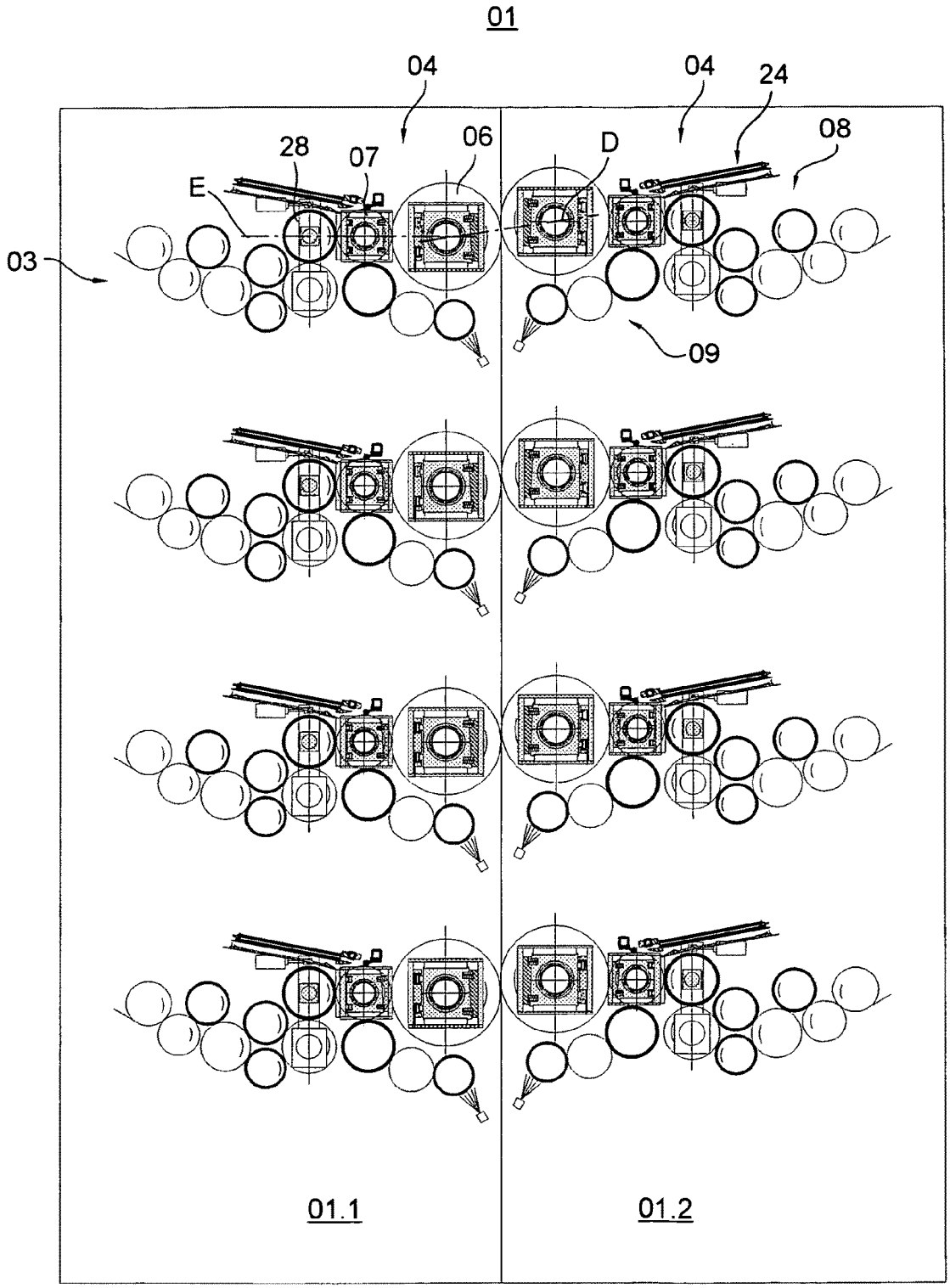
FIG. 12 an embodiment of a printing unit.

In FIG. 12, for the inking units 08 which are described with reference to FIGS. 5 through 10, the inking unit and the dampening unit 08; 09 of FIG. 5 is represented, without roller 261, in a printing tower with four blanket-to-blanket printing units 03 that are arranged one above another. Advantageously, automatic or semiautomatic printing forme handling devices 24, and especially printing forme changers 24, are provided. In an advantageous further improvement, the printing unit 01 is configured to be separable, through the use of the printing unit sections 01.1; 01.2, as described above. In the embodiment which is shown in FIG. 12, one of the other inking or dampening units 08; 09, as described in connection with FIGS. 5 through 11 can also be provided.

In the preferred embodiment of FIG. 12, in each printing couple 04, the rotational axes of the transfer cylinder 06, the forme cylinder 07 and the forme roller 28 lie within a shared plane E in the print-on position. However, the two printing couples 04 of a blanket-to-blanket printing unit 03 are arranged offset from one another at their transfer cylinders 06 such that the two planes E of the two printing couples 04 do not coincide. The plane D that connects the transfer cylinders 06, extends at an incline in relation to at least one of the two planes of the printing couples 04, in this case, in relation to the two planes E. This can be advantageous if a partial wrap of the web, which is traveling vertically, is to be produced, and/or if space or a specific orientation of the printing couples, together with the printing forme changers 24, is to be formed.

In an advantageous further improvement on the preferred embodiment depicted in FIG. 12, in the print-on position, both transfer cylinders 06, both forme cylinders 07, and the two first forme rollers 28 of the blanket-to-blanket printing unit 03 lie within the same plane E. The planes E, D and A then coincide for the blanket-to-blanket printing unit 03.

In FIG. 12, the above-described levers 254 are provided, by way of example, for the ink forme rollers 28. However, in an advantageous embodiment, roller sockets 257 or linear bearings 252 can also be provided for this purpose.

If roller sockets 257 are used, it is particularly beneficial that the first ink forme roller 28 can ideally be placed in contact with the two cooperating rotating bodies, forme cylinder 07 and roller 33. In this case, the first ink forme roller 28 can be moved in different directions, perpendicular to the rotational axis, and based upon the impingement of the individual pressure chambers, as will be described below in connection with actuators 322.

Figure 13:
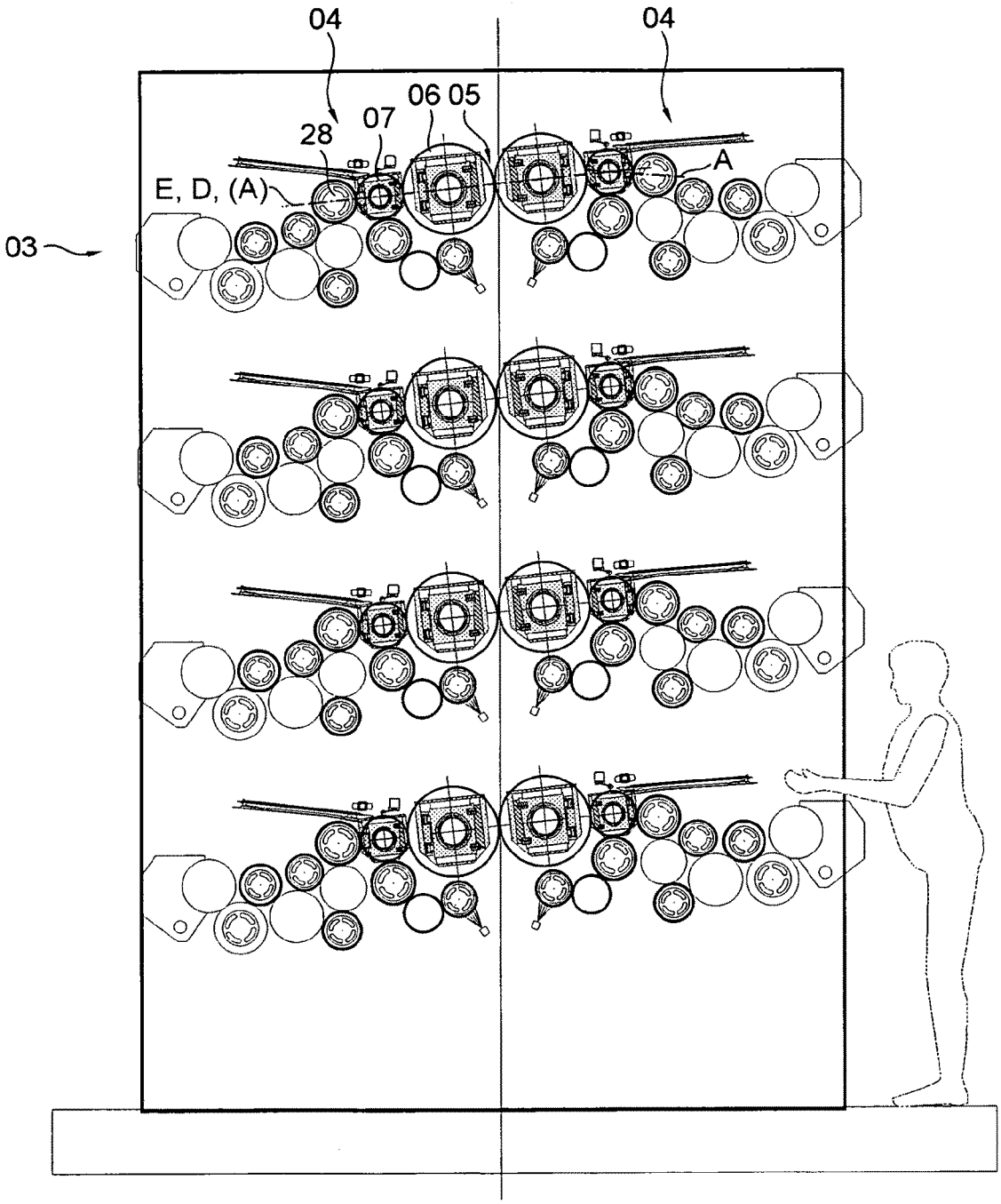
FIG. 13 an embodiment of a printing unit.

In FIG. 13, a further preferred embodiment of a printing unit 01 in accordance with the present invention, and with stacked blanket-to-blanket printing units 03 is shown. Here, in contrast to FIG. 12, the four printing couple cylinders 06; 07, namely the two transfer cylinders 06 that form the print position 05, and the two associated forme cylinders 07 for each printing couple, lie within a shared plane E in the print-on position. In the example shown in FIG. 13, in one of the two printing couples 04, the first ink forme roller 28 does not lie within the plane E, but is arranged on the forme cylinder 07, and is offset by the above-mentioned angle δ. In this case, the forme roller 28 of the cooperating printing couple 04 is arranged within the same plane E. If necessary for reasons of space, the forme roller 28 of the second printing couple 04 can also be arranged offset by an angle δ, as discussed above.

The offset of the forme roller 28 of one of the two printing couples 04, and especially of the printing couple 04 that lies farther toward the top, is especially advantageous if the plane E of the blanket-to-blanket printing unit 03 is not perpendicular to the direction of web travel. Rather, the plane E preferably extends at an incline of, for example, of 2°-15°, and especially of 4° to 10°, in relation to the line that is perpendicular to the direction of web travel. In this case, a slight offset of the forme roller 28 creates space for the printing forme or for a plate change.

If a printing couple 04 has a first ink forme roller 28 that is arranged at an angle δ>0, in relation to the plane E, it is advantageous to provide a continuous surface on the forme roller 28, such as, for example, a surface without an interruption, such as a surface that results from the fastening of a finite dressing in a groove. In this case, for example, a roller cover that is permanently attached to a roller body, such as, for example, one that is vulcanized onto the roller cover, or a removable sleeve, is advantageous. The permanently attached roller cover or the sleeve can then advantageously have a compressible layer, comparable with a layer that is used with rubber blankets for the transfer cylinder. In contrast to purely elastic properties, the compressible layer supports the true-to-point transfer of the ink in the nip point. Although the compressible layer ensures the establishment of contact pressure, in contrast to solely elastic materials, it does not deviate toward the side.

Figure 29:
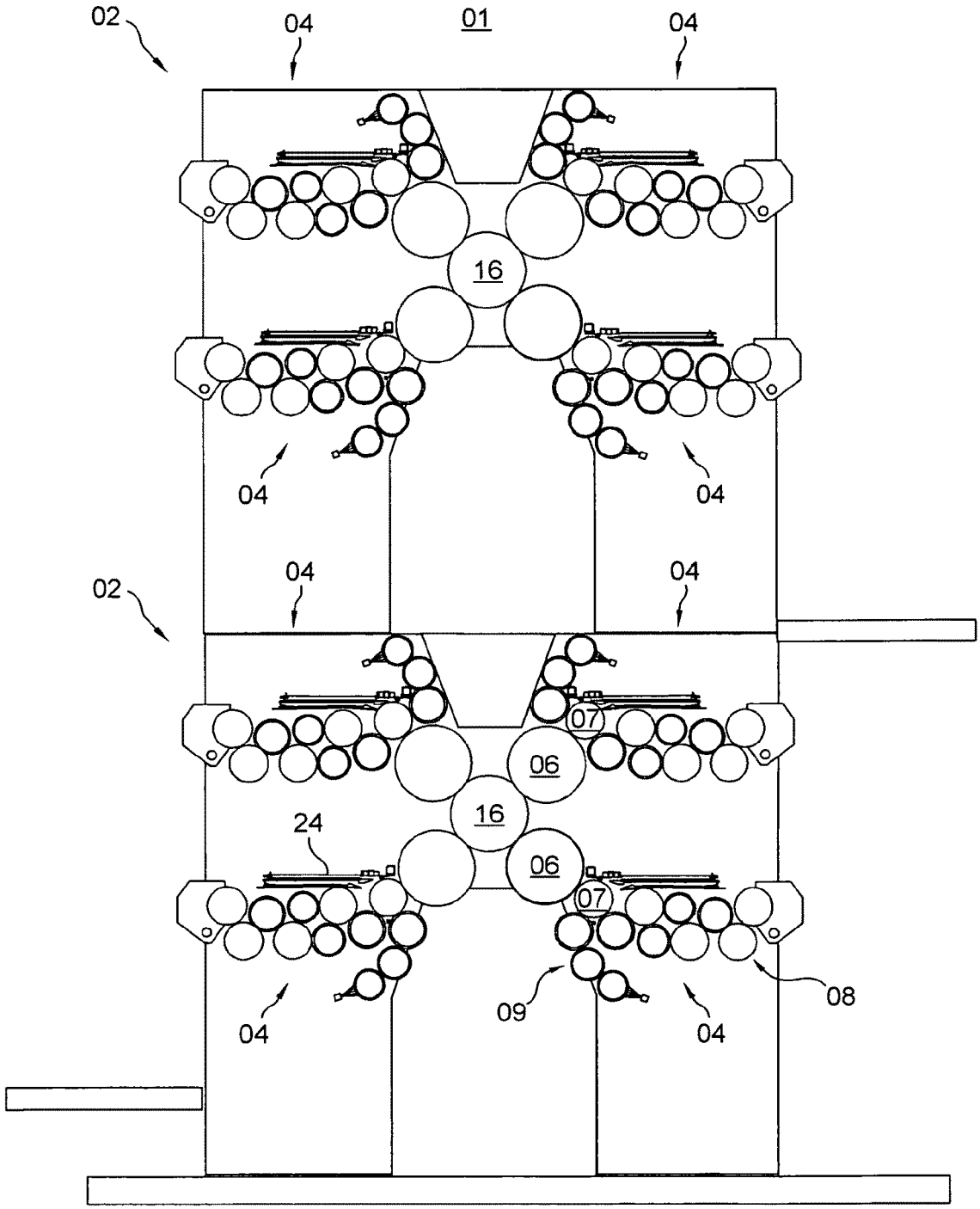
FIG. 29 an embodiment of a printing tower with nine-cylinder printing units.

In one variation for the printing unit 01, or for the printing couples 04, these printing couples 04 are configured not as blanket-to-blanket printing units 03, but instead as satellite printing units 02, according to FIG. 29, and especially as nine-cylinder printing units 02. In this case, the transfer cylinder 06 of the printing couple 04 cooperates, not with a second transfer cylinder 06, but instead cooperates with an impression cylinder 16, such as, for example, with a satellite cylinder 16. In FIG. 29, a printing tower, with two nine-cylinder satellite printing units of a printing press, stacked one above another, such as, for example, a web-fed rotary offset printing press, is provided for the double-sided printing of a web of printing substrate, such as, for example, a paper web, which is transported through the printing press along a transport path, which is not shown specifically here. Each such nine-cylinder satellite printing unit comprises a central satellite cylinder 16, which acts as an impression cylinder 16, and four printing couples 04 that cooperate with the satellite cylinder 16.

In each case, two plate cylinders 07 of each nine-cylinder satellite printing unit are arranged lying side by side, at least substantially in a horizontal direction. Two plate cylinders 07 of each nine-cylinder satellite printing unit are also arranged at least substantially lying one above another in a vertical direction. The same is true of the transfer cylinders 06, the axes of which at least approximately form a square.

Figure 14:
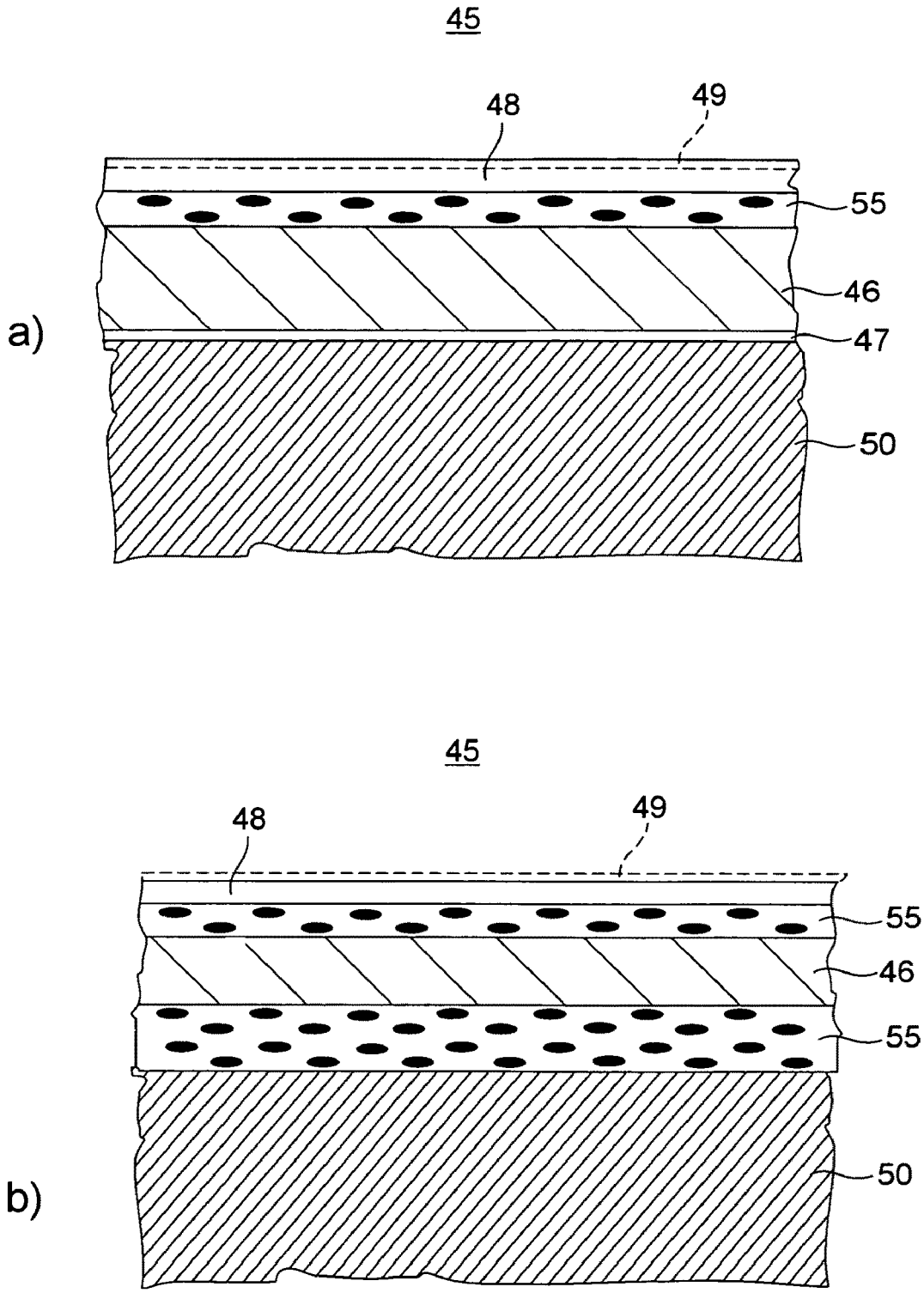
FIG. 14*a* a schematic depiction of a structure of a roller cover.
FIG. 14*b* a schematic depiction of a structure of an additional embodiment of a roller cover.

FIG. 14 shows, by way of example, advantageous structures for a roller cover for the ink forme roller 28, such as, for example, an ink forme roller cover 45, in the form of a finite roller cover, a sleeve, or a cover which is permanently attached to a roller body 50. In a first embodiment, depicted in FIG. 14*a*, a structure that is similar to a metal printing blanket is selected. A compressible layer 46 is applied, for example, to a dimensionally stable base 47, such as, for example, to a metal plate or metal sleeve. A fabric layer 55 can be applied to this. The outer layer 48 is formed by a flexible layer 48, for example a rubber layer, which, in one variation, can also be covered with a surface layer 49. The surface layer 49, if present, can have a hardness ranging from 30° to 45° Shore A. This surface layer 49 is made of a flexible material, preferably a plastic, such as a polymer, and has a thickness ranging from 30 μm to 60 μm, and preferably has a thickness of 50 μm +/−5%. The surface layer 49 can have a microstructure on its outer surface, which transports the printing ink.

The flexible layer 48 can have a hardness of >50 Shore A, and especially of 60 to 80 Shore A. The flexible layer 48 has, for example, a thickness of 0.1 to 0.4 mm, and especially has a thickness of 0.2 mm+/−20%.

In the embodiment which is shown in FIG. 14*b*, the ink forme roller cover 45 has an additional fabric layer 55, for example, in place of the dimensionally stable base 47. Between this fabric layer and the roller body 50, an adhesive layer, which is not shown, can be provided.

Figure 15:
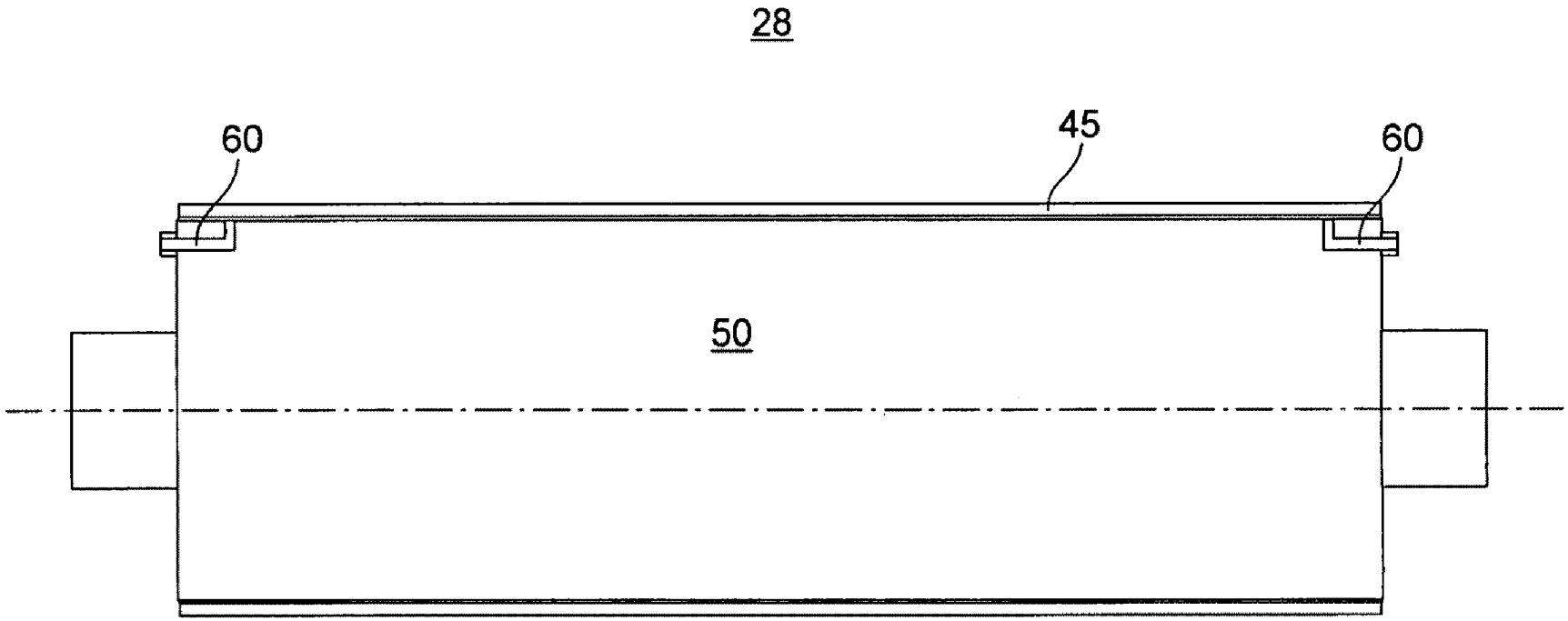
FIG. 15 an embodiment of an ink forme roller.

FIG. 15 shows an embodiment of the first ink forme roller 28, the ink forme roller cover 45 of which is embodied in a sleeve. To facilitate the mounting/removal of the roller cover 45, air supply ducts 60, that point toward the circumferential surface of the roller body 50, are provided in the roller body 50, through which air supply ducts 60, for example, compressed air can be supplied. With this embodiment, a structure for the sleeve according to FIG. 14*b* is preferably provided, with a fabric layer 55 in place of a metal sleeve.

In all of the examples, it can be particularly advantageous for the printing blanket 23 to be embodied as a multilayer printing blanket 23, which is embodied as a metal printing blanket 23, and which has a dimensionally stable support plate with an elastic layer. The elastic layer can then be configured with a customary layer of a metal printing blanket.

In one advantageous embodiment of the printing unit 01, as seen in FIG. 16, the cylinders 06; 07 are rotatably mounted in bearing units 14 on the side frames 11; 12, which bearing units 14 can be power actuated with respect to on/off adjustment, and/or which bearing units 14 do not extend through the alignment of the side frames 11; 12. The barrels 67; 68 of the cylinders 06; 07, including their journals 63; 64, may have a length L06; L07, which is shorter than or equal to an inside width L between the side frames 11; 12. The bearing units 14 thus support the printing couple cylinders 06; 07 at both end surfaces, as is also seen in FIG. 16. The side frames 11; 12, which support the printing couple cylinders 06; 07 at both end surfaces, are preferably not side frames that are open at the sides, so that the cylinders 06; 07 could be removed axially.

Instead, they are side frames 11; 12, which at least partially overlap the end surfaces of the mounted cylinders 06; 07 in the axial direction. The cylinder 06; 07, and especially its bearing, as will be discussed below, is at least partially enclosed at the end surface by the two side frames 11; 12.

Preferably, all four printing couple cylinders 06; 07, but at least three of the printing couples 06; 07, each have their own bearing unit 14, into which the on/off adjustment mechanism is already integrated. For the at least three of the four cylinders 06; 07, bearing units 14 that have the on/off adjustment mechanism can also be provided, and for the fourth bearing units 14, a bearing unit 14, without an on/off adjustment mechanism, can be provided.

Figure 17:
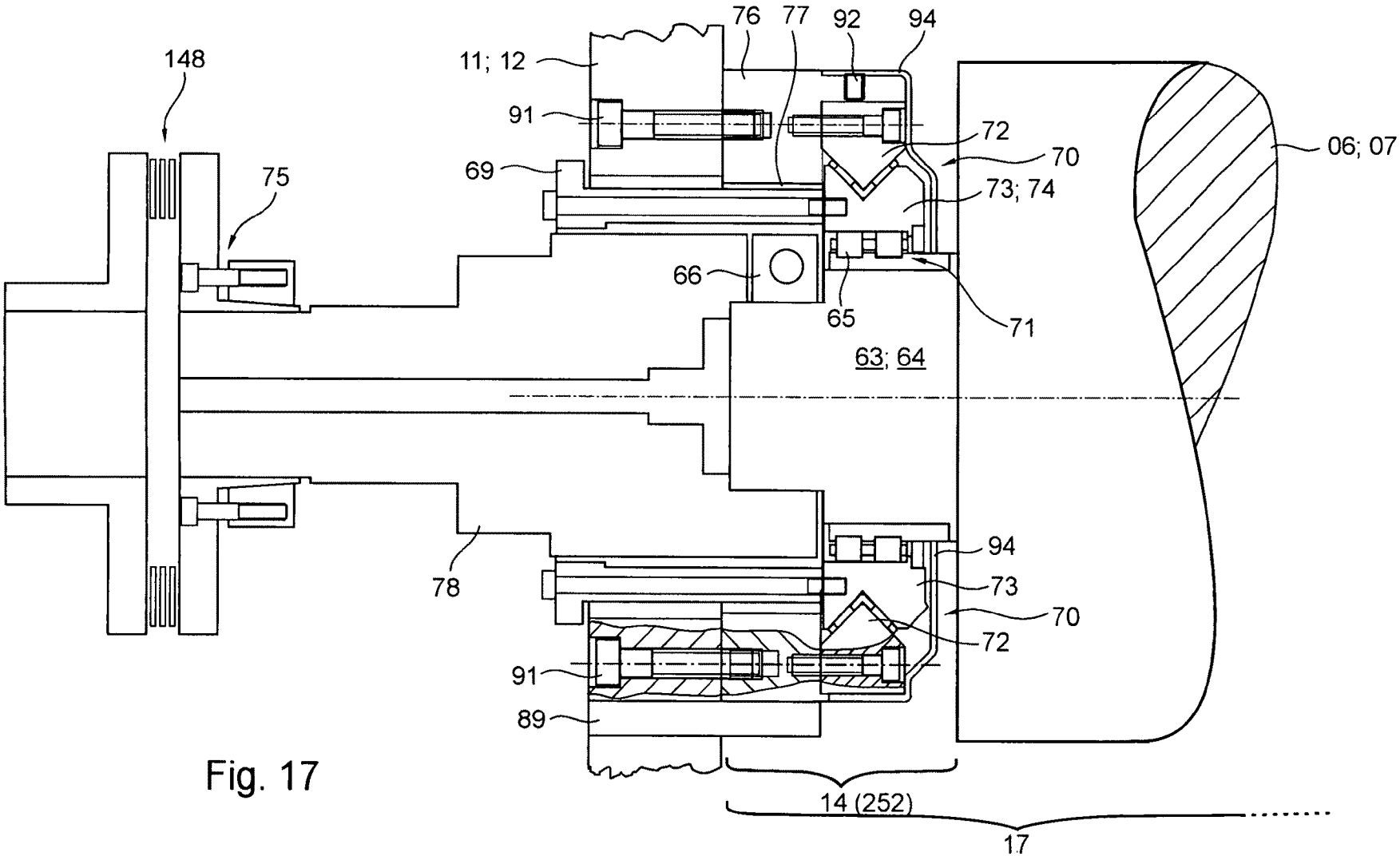
FIG. 17 a schematic longitudinal cross-section of a bearing unit.
Figure 18:
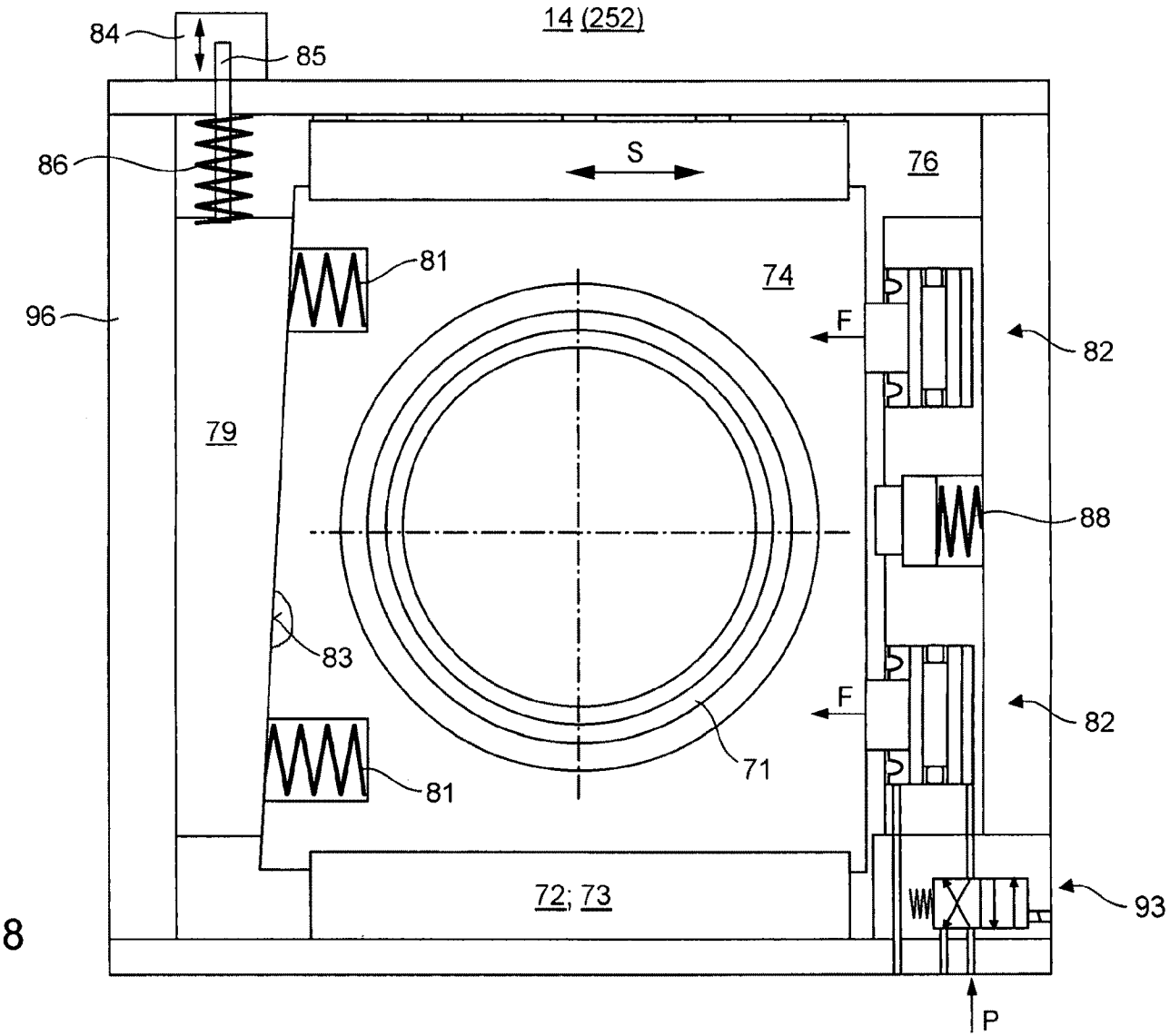
FIG. 18 a schematic transverse cross-section of a bearing unit.

As was discussed above, in one variation the ink forme roller 28 can also be mounted in a linear bearing 252 or bearing unit 252. Because these correspond substantially in their structure, the following statements with regard to the bearing unit 14 can also be applied to the linear bearing 252 or bearing unit 252. In FIGS. 17 and 18, this circumstance is accounted for by the reference symbols (252) in parentheses.

FIGS. 17 and 18 show a schematic longitudinal cross section of a bearing unit 14 (252), which is preferably based on linear adjustment paths. In addition to a bearing 71, for example, a radial bearing 71, for example a cylinder roller bearing 71, for use in the rotational mounting of the cylinder 06; 07, the bearing unit 14 (252), which integrates the on/off adjustment mechanism, has bearing elements 72; 73 for a radial movement of the cylinder 06; 07, for use to accomplish a print-on or print-off adjustment. For this purpose, the bearing unit 14 (252) has bearing elements 72, which are fixed to the support by being fixed to the frame following mounting of the bearing unit 14 (252), along with the bearing elements 73, which can be moved in relation to the former. The support-fixed and movable bearing elements 72; 73 are configured as cooperating linear elements 72; 73, and, combined with corresponding sliding surfaces or roller elements located between these, as linear bearings 70. The linear elements 72; 73 hold a bearing block 74, for example, a sliding carriage 74, which holds the radial bearing 71, between them. Bearing block 74 and the movable bearing elements 73 can also be embodied as a single piece. The bearing elements 72, which are fixed to the support, are arranged on a support 76, which will be, or is connected, as a unit, to the side frame 11; 12. The support 76 is configured, for example, as a support plate 76, which has, at least on one drive side, such as, for example, an opening 77 for a shaft 78, for example drive shaft 78, of a cylinder journal 63; 64, to pass through. The frame wall 11; 12 on the drive side preferably has a recess or an opening for a drive shaft 78. At the end surface that is opposite the drive side, it is not absolutely necessary for an opening 77 or a recess to be provided in the side frame 12; 11.

A length of the linear bearing 70, especially at least a length of the bearing element 72 of the linear bearing 70, which when mounted is fixed to the frame, is preferably shorter than a diameter of the allocated printing couple cylinder 06; 07 as viewed in the direction of adjustment S, as seen in FIG. 18.

Figure 20:
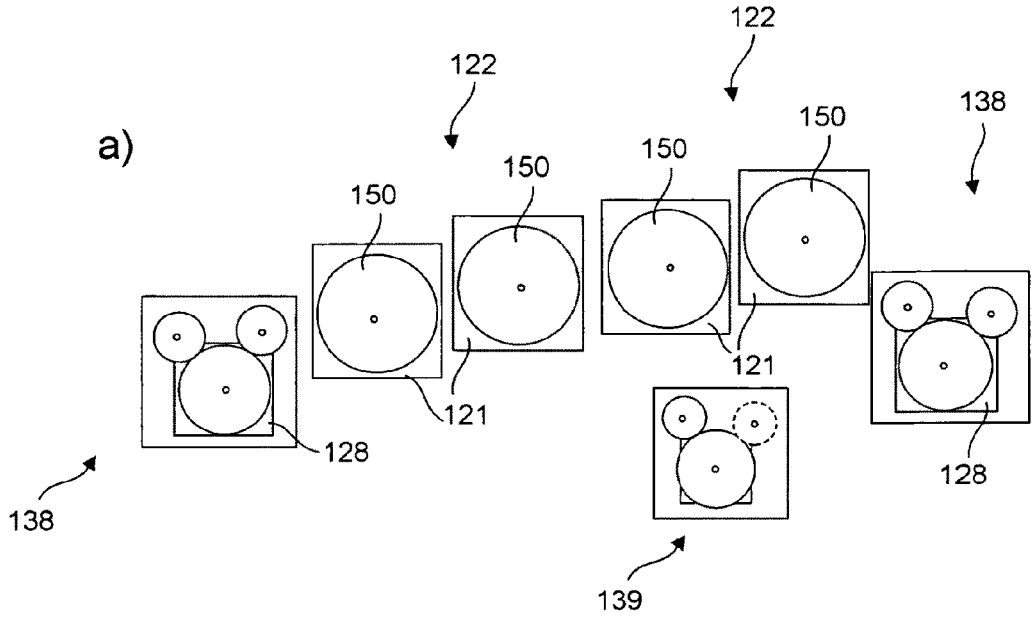
FIG. 20 an embodiment of the drive of a printing couple in accordance with the present invention.
Figure 20:
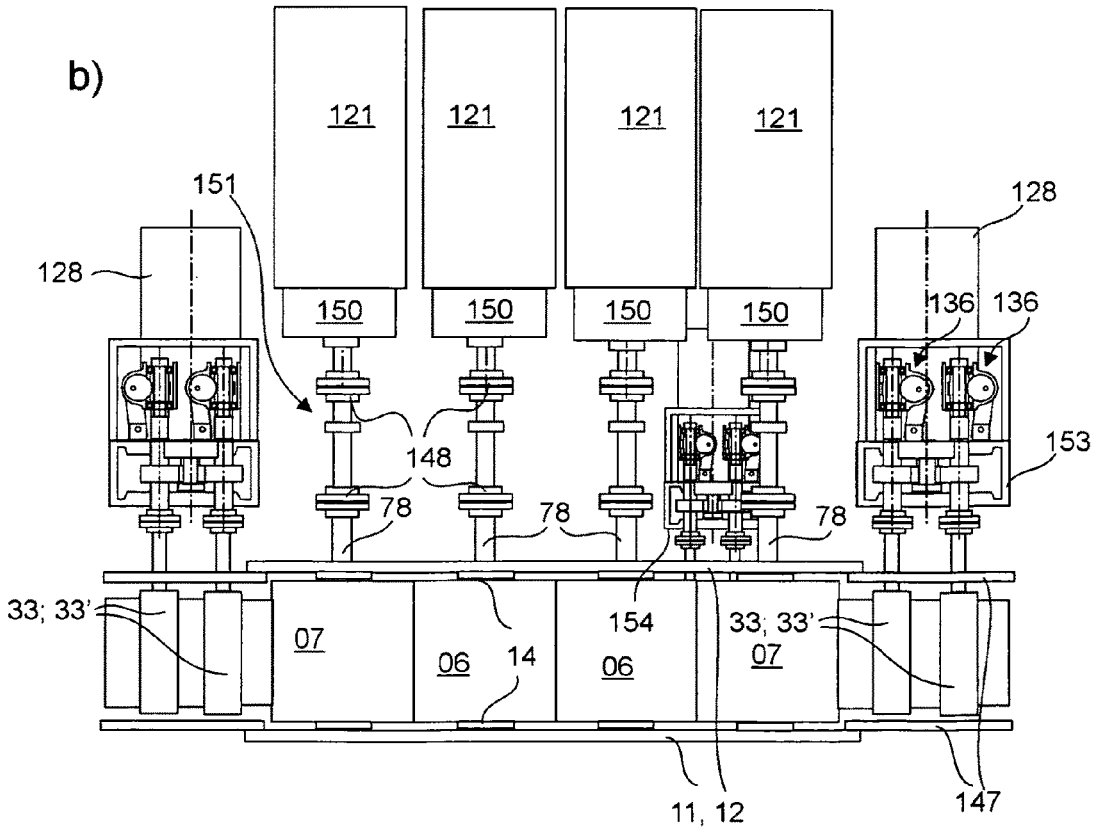

The coupling of the cylinder 06; 07 or the bearing block 74 on a drive side of the printing unit 01 to a drive, such as, for example, to a drive motor 121, and/or to a drive train of a paired drive for the cylinder 06; 07, which is not specifically shown, or transmission 150, as seen in FIG. 20, is accomplished via the shaft 78, which, at its end that is closest to the cylinder, encompasses an end of the journal 63; 64, and, for example, is non-rotatably connected to the journal 63; 64 via a clamping device 66. In this case, the clamping device 66 is configured, for example, as a partially slotted hollow shaft end, which encompasses the journal end of journal 63; 64, and can be drawn together via a screw connection in such a way that a non-positive, non-rotatable connection can be created between the journal end of journal 63; 64 and the interior surface of the hollow shaft. The coupling can also be configured differently, for example having a form closure in the circumferential direction. The shaft 78 is guided through an opening in the side frame 11; 12, which opening is sufficiently large in dimension to allow the movement of the shaft 78 together with the bearing block 74, and which opening is configured, for example, as an elongated hole. For protection against contamination, a cover 69 with a collar that overlaps the elongated hole can be provided, which cover 69 is connected, for example, to the bearing block 74, but not to the shaft 78.

At the end of the shaft 78 that is remote from the cylinder, a coupling 148, and especially a multi-disk coupling 148, of optionally a plurality of disks arranged in series, can be coupled via a non-rotatable connection 75, such as, for example, via a clamping element 75, as represented in FIG. 17. In another embodiment, the transmission 150 can be coupled directly with the drive motor 121, without a coupling 148 that compensates for angle and/or offset, to the shaft 78. In this embodiment, the drive motor 121 is arranged so it is not fixed to the frame, but is fixed to the cylinder, and is moved along with the cylinder 06; 07. This also applies, in one advantageous variation, to a direct drive, as represented, for example, in FIG. 22 through 25.

On a side of the cylinder 06; 07, and especially on a side of the cylinder 07, which is configured as the forme cylinder 07, which side is opposite the drive side, the journal 64 can preferably be coupled with a device for the axial movement of the cylinder 07, not shown, i.e., with a side register drive.

The configuration of the linear bearing 70 in such a way that the cooperating bearing elements 72; 73 are both provided on the structural component of the bearing unit 14 (252), and not on a part on the side frame 11; 12 of the printing unit 01, enables a preassembly and pre-adjustment or a presetting of the bearing tension. The advantageous arrangement of the two linear bearings 70, which encompass the bearing block 74, enables a play-free adjustment, because the two linear bearings 70 are positioned opposite one another, such that the bearing pre-tension and the bearing forces undergo or accommodate a significant component in a direction perpendicular to the rotational axis of the cylinder 06; 07.

The linear bearings 70 can therefore be adjusted in the direction in which the play-free adjustment of the cylinder 06; 07 also occurs.

Because the cylinder 06; 07, together with the journals 63; 64 and the bearing unit 14 (252), do not extend through the frame wall 11; 12, these are already pre-mounted, and the bearings, both the radial bearings 71 and the linear bearings 70, can be installed in the printing unit 01 pre-adjusted or correctly pre-tensioned as the cylinder unit 17 module. The description "do not extend through" and the above definition with respect to the inside width L should further be advantageously understood such that, at least in the area of the proposed end position of the cylinders 06; 07, and at least on a through path from a frame edge up to the location of the end position, such a condition of "not extending through" exists. The cylinder unit 17 can thus be fastened from an open side, which lies between the two end-surface side frames 11; 12, without tipping, i.e., in a position in which its rotational axis is perpendicular to the frame plane and can be moved toward the end position, and can be arranged there between the two interior walls of the frame, especially being fastened to the interior walls of the frame. This is also possible, for example, if, although gate parts or other raised areas are provided on the interior side, a through mounting path is nonetheless provided.

The bearing units 14 (252) are arranged on the interior walls of the side frames 11; 12 in such a way that the cylinders 06; 07, and especially their bearing units 14 (252), are supported on the side opposite the cylinder by the side frame 11; 12. This arrangement offers both static and assembly advantages.

The linear bearings 70 (72, 73), which are identifiable in FIGS. 17 and 18, therefore each have pairs of corresponding, cooperating bearing elements 72 and 73 or their guide or active surfaces, configured as sliding surfaces, not shown, or with roller elements 65 arranged between them.

The guide surfaces of the bearing elements 72 of the linear guide 70, which bearing elements are fixed to the frame, have bearings in the hemisphere that faces the journal 63; 64. Here, the bearing elements 72, which are fixed to the frame, encompass the bearing block 74, which is arranged between them. The guide surfaces of the two linear bearings 70, which surfaces are fixed to the frame, therefore partially encompass the guide surfaces of the bearing block 74 with respect to an axial direction of the cylinder 06; 07.

To accomplish the correct placement of the bearing units 14 (252), or the cylinder units 17, including the bearing unit 14 (252), mounting aids 89, such as alignment pins 89, can be provided in the side frame 11; 12. The bearing unit 14 (252) of the fully assembled cylinder unit 17 is aligned with such mounting aids 89 before they are connected to the side frame 11; 12 via separable connecting elements 91, such as screws 91, or even with adhesive force via welding. To accomplish the adjustment of the bearing pre-stress in the linear bearings 70, which adjustment is to be performed prior to installation in the printing unit 01 and/or is to be readjusted after installation, suitable elements 92, such as, for example, tightening screws 92, can be provided, as seen in FIG. 17. The bearing unit 14 (252), at least toward the cylinder side, is preferably largely protected against contamination by a cover 94, or is even embodied completely encapsulated as a structural unit.

In FIG. 17 the cylinder 06; 07 with journals 63; 64 and a preassembled bearing unit 14 (252) is schematically depicted. This component group can be placed, preassembled, between the side frames 11; 12 of the printing unit 01 in an assembly-friendly manner, and can be fastened at points which are designated for this purpose. For a modular construction, the bearing units 14 (252) for the forme cylinder and the transfer cylinder 07; 06, respectively, and optionally including the permissible operational size of the adjustment path, can be similarly structured. With the pre-assembled embodiment, the active inner surface of the radial bearing 71 and the active outer circumferential surface of the journal 63; 64 can be cylindrical rather than conical in configuration, as both the mounting of the bearing unit 14 (252) on the journal 63; 64 and the adjustment of the bearing clearance can be performed outside of the printing unit 01. For example, the bearing unit 14 (252) can be decreased in size to fit.

The structural unit that can be mounted as a complete unit, bearing unit 14, is advantageously configured as an optionally partially open housing, comprised of, for example, the support 76, and/or, for example, a frame, as is depicted in FIG. 18 without a reference symbol, and which frame may consist of, for example, the four plates that border the bearing unit 14 (252) toward the outside on all four sides, and/or, for example, the cover 94, as also shown in FIG. 18. The bearing block 74 that has the radial bearing 71, the linear guides 70, and, in one advantageous embodiment, for example, the actuator 82 or the actuators 82 are accommodated inside this housing or this frame.

The bearing elements 72; 73 that are fixed to the frame are arranged substantially parallel to one another and define a direction of adjustment S, as shown in FIG. 18.

An adjustment to a print-on position is accomplished by moving the bearing block 74 in the direction of the print position by the application of a force that is applied to the bearing block 74 by at least one actuator 82, and especially by an actuator 82 that is power-controlled or that is defined by a force. By the use of this actuator, a defined, or a definable force can be applied to the bearing block 74 in the print-on direction to accomplish the print-on adjustment, as depicted in FIG. 18. The linear force at the nip points, which is decisive for ink transfer and thus for print quality, among other factors, is therefore defined not by an adjustment path, but by the equilibrium of forces between the force F and the linear force $F_L$ that results between the cylinders 06; 07, and by the resulting equilibrium. In a first embodiment, which is not shown separately, cylinders 06; 07 are engaged on one another in pairs, in that the bearing block 74 is acted upon by the correspondingly adjusted force via the actuator(s) 82. If multiple, such as, for example, three or four cylinders 06; 07, that are adjacent to one another in direct succession, and acting in coordinating pairs, are embodied such that the adjustment path S cannot be set or limited using a purely force-dependent adjustment mechanism, then, although a system that has already been adjusted with respect to the necessary pressures or linear forces can again be correctly adjusted subsequently and successively, it is possible to implement a basic setting adjustment only with difficulty, due to the somewhat overlapping reactions.

To adjust the basic setting of a system, with corresponding dressings, and the like, it is therefore provided, in one advantageous embodiment, that at least the two center cylinders of the four cylinders 06, or expressed differently, that at least all the cylinders 06 other than the two outer cylinders 07, can be fixed or at least can be limited in their travel, at least during a period of adjustment to a defined position, advantageously to the position of adjustment determined by the equilibrium of forces.

Particularly advantageous is an embodiment in which the bearing block 74, even during operation, is mounted such that it can move in at least one direction away from the print position against a force, such as, for example, a spring force, and especially a definable force. With this, in contrast to a mere travel limitation, on one hand a maximum linear force in the cooperation of the cylinders 06; 07 is defined, and on the other hand a yielding is enabled in the cylinder 06; 07, for example in the case of a web tear followed by a wrap-around.

On one side that faces the print position 05, the bearing unit 14 (252), at least during the adjustment process, has a movable stop 79, which limits the adjustment path up to the print position 05. The movable stop 79 can be moved in such a way that the stop surface 83, which acts as the stop, can be varied in at least one area along the direction of adjustment. Thus, in one advantageous embodiment, an adjustment device, such as the adjustable stop 79, is provided, by the use of which, the location of an end position of the bearing block 74 that is near the print position can be adjusted. For travel limitation/adjustment, for example, a wedge drive, which will be described in detail below, is provided. The stop 79 can be adjusted manually or via a positioning element 84 which is implemented as an actuator 84, as will be discussed below. Further, in one advantageous embodiment, a holding or a clamping element, which is not specifically illustrated in FIGS. 10 and 11, is provided, by the use of which holding or clamping elements the stop 79 can be secured in the desired position. Further, at least one spring-force element 81, for example, a spring element 81, is provided, which exerts a force $F_R$ from the stop 79 on the bearing block 74 in a direction away from the stop. In other words, the spring element 81 effects an adjustment of the cylinder to the print-off position, when the movement of the bearing block 74 is not impeded in some other way. An adjustment of the cylinder to the print-on position is accomplished by moving the bearing block 74 in the direction of the stop 79 by at least one actuator 82, and especially by the use of a power-controlled actuator 82, by the use of which, a defined or a definable force F can optionally be applied to the bearing block 74 in the print-on direction for the purpose of adjustment. If this force F is greater than the restoring force $F_R$ of the spring elements 81, then, with a corresponding spatial configuration, an adjustment of the cylinder 06; 07 relative to the adjacent cylinder 06; 07 and/or an adjustment of the bearing block 74 relative to the stop 79 takes place.

Ideally, the applied force F, the restoring force $F_R$ and the position of the stop 79 are selected such that, in the engaged position, no substantial force AF is transferred between the stop 79 and the stop surface of the bearing block 74, and such that, for example, $|\Delta F|<0.1*(F-F_R)$, especially $|\Delta F|<0.05*(F-F_R)$, ideally $|\Delta F|\approx 0$ applies. In this case, the adjustment force between the cylinders 06; 07 is determined substantially by the force F that is applied via the actuators 82. The linear force at the nip points, which linear force is decisive for ink transfer and therefore for print quality, among other factors, is thus defined primarily not by an adjustment path, but, in the case of a quasi-free stop 79, by the force F and the resulting equilibrium. In principle, once the basic setting has been determined, with the forces F necessary for this, a removal of the stop 79 or of a corresponding immobilization element that is active only during the basic adjustment, would be conceivable.

In principle, the actuator 82 can be configured as any actuator 82 that will exert a defined force F. Advantageously, the actuator 82 is embodied as a positioning element 82 that can be actuated with pressure medium, and especially is configured as a piston 82 that can be moved using a fluid. Advantageously with respect to a possible tilting, the arrangement involves multiple, in this case two, actuators 82 of this type. A liquid, such as oil or water, is preferably used as the fluid due to its incompressibility.

To actuate the actuators 82, which are configured, in this case, as hydraulic pistons 82, a controllable valve 93 is provided in the bearing unit 14 (252), as may be seen in FIG. 18. That controllable valve 93 is configured, for example, to be electronically actuable, and places the hydraulic pistons 82, in one position of valve 93, that is pressureless or at least at a low pressure level, while in another position of valve 93, the pressure P that conditions the force F is present. In addition, for safety purposes, a leakage line, not shown here, is also provided.

In order to prevent on/off adjustment paths that are too large, while still protecting against web wrap-up, a travel limitation can be provided on the side of the bearing block 74 that is distant from the print positions. This travel limitation can be provided by a movable, force-limited stop 88 as an overload protection element 88, for example a spring element 88, which in operational print-off, when the pistons 82 are disengaged and/or retracted, can serve as a stop 88 for the bearing block 74 in the print-off position. In the case of a web wrap-up or of other excessive forces exerted from the print position 05, the travel limitation will yield and will open up a larger path. A spring force for this overload protection element 88 is therefore selected to be greater than the sum of the forces from the spring elements 81. Thus, during operational on/off adjustment, only a very short adjustment path, such as, for example, of only between 0.3 and 4 mm, for example 0.5 to 3.5 mm, or between 1 and 3 mm, can be provided.

In the represented embodiment shown in FIG. 18, the stop 79 is embodied as a wedge 79 that can be moved crosswise to the direction of adjustment S. In the movement of that wedge, the position of the respective effective stop surface 83 along the direction of adjustment S varies. The wedge 79 is supported, for example, against a stop 96 that is stationarily fixed to the support.

The stop 79, which is configured here as a wedge 79, can be moved by an actuator 84, such as, for example, a positioning element 84 that can be actuated with pressure medium, such as a piston 84 that can be actuated with pressure medium, in a working cylinder provided with dual-action pistons, via a transmission element 85, which may be configured, for example, as a piston rod 85, or by an electric motor via a transmission element 85, which may be configured as a threaded spindle, as depicted schematically in FIG. 18. This actuator 84 can either be active in both directions, or, as illustrated here, can be configured as a one-way actuator, which, when activated, works against a restoring spring 86. For the aforementioned reasons, a largely zero-force stop 79, the force of the restoring spring 86 is selected to be weak enough that the wedge 79 is held in its correct position against only the force of gravity or vibration forces.

In principle, the stop 79 can also be embodied differently, such as, for example, as a ram that can be adjusted and affixed in the direction of adjustment, etc., such that it forms a stop surface 83 for the movement of the bearing block 74 in the direction of the print position 05, which is variable in the direction of adjustment S and, at least during the adjustment process, can be fixed in place. In an embodiment that is not specifically illustrated, the stop 79 can be adjusted, for example, directly parallel to the direction of adjustment S via a drive element, for example a cylinder that is actuable with pressure medium, with dual-action pistons or by an electric motor.

In an advantageous embodiment, represented here, for example, in FIG. 2, in the print-on position the rotational centers of the cylinders 06; 07 form an imaginary line or plane of connection E, which will be referred to in what follows as a "linear" or "flat" blanket-to-blanket printing unit 03. The plane E and the entering and exiting web preferably form an interior angle that deviates from 90°, measuring between 75 and 88°, and especially measuring between 80 and 86°. In one embodiment, the bearing unit 14 of the transfer cylinder 06, especially the bearing units of all cylinders 06; 07, when mounted, are arranged on the side frame 11; 12 in such a way that their directions of adjustment S—for example, for the purpose of a force-defined print-on adjustment, as discussed below, form a maximum angle of 15° with the plane of connection E, for example an acute angle β of approximately 2° to 15°, especially 4 to 10°, with one another. This arrangement is of particular advantage, with respect to mounting, if the direction of adjustment S extends horizontally and the web extends substantially vertically.

In a modified embodiment of a blanket-to-blanket printing unit 03, which is arranged at an angle, with n- or u-printing couples 04, the plane D is understood as the plane of connection of the cylinders 06 that form the print position 05, and the plane E is understood as the plane of connection between the forme and transfer cylinders 07; 06, and what was discussed above with regard to the angle is referred to the direction of adjustment S of at least one of the cylinders 06 that form the print position 05, or the forme cylinder 07 and the plane D or E.

One of the cylinders 06 that form the print position 05 can also be arranged in the side frame 11; 12 such that it is stationary and functionally non-adjustable, but optionally is adjustable, while the other cylinder is mounted such that it is movable in the direction of adjustment S.

A functional adjustment path, for adjustment to the on/off positions in the direction of adjustment S, between the print-off and print-on positions, for example in the case of the transfer cylinder 06, measures between 0.5 and 3 mm, and especially measures between 0.5 and 1.5 mm, and in the case of the forme cylinder 07 measures between 1 and 5 mm, and especially measures between 1 and 3 mm.

In the embodiment of the printing unit 01 as a linear blanket-to-blanket printing unit 03, the plane E is inclined from the planes of the incoming and outgoing web, for example, at an angle $\alpha$ of 75° to 88° or 92 to 105°, preferably from $\alpha$ 80 to 86° or 96 to 100°, in each case on one side of the web, or 96 to 100°, or $\alpha$ 80 to 86°, on the respective other side of the web, as depicted in FIG. 2.

Figure 19:
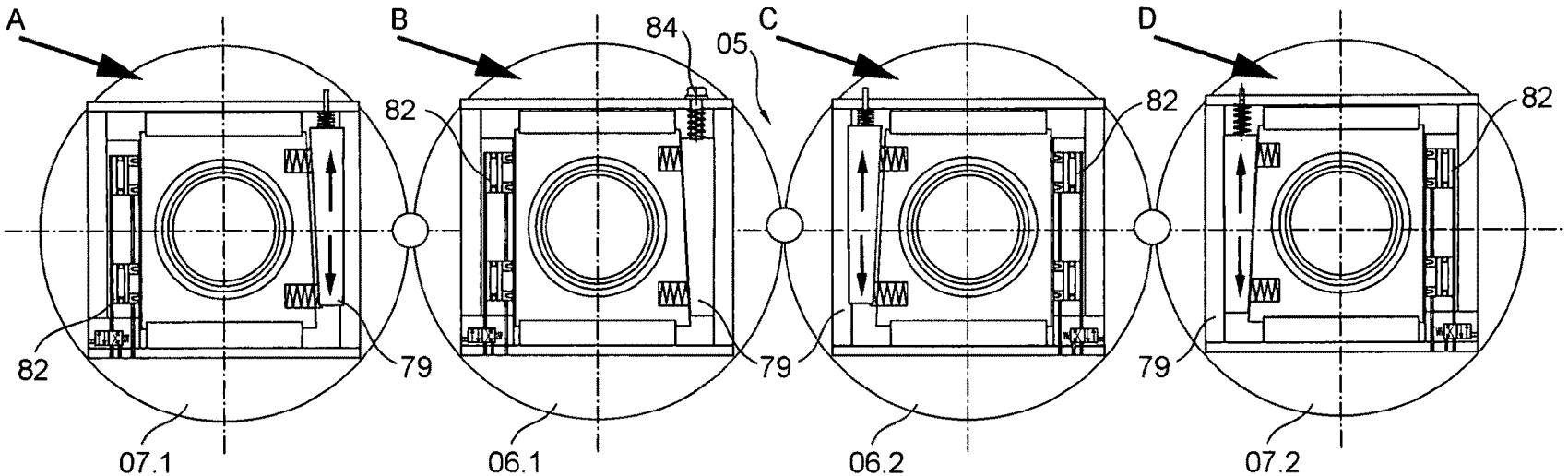
FIG. 19 a schematic depiction outlining the principle of the mounting and adjustment of the cylinders in accordance with the present invention.

In another embodiment which is illustrated here, for example in FIG. 19, when mounted, the bearing units 14 (252) of the transfer cylinder 06, and especially of all of the cylinders 06; 07, are arranged on the side frame 11; 12 in such a way that their directions of adjustment S coincide with the plane of connection E. In other words, they form an acute angle of approximately 0°. Therefore, all of the directions of adjustment S coincide, and are not spaced from one another.

Independent of the inclination of the adjustment paths S, relative to the plane E or D, in the schematic example shown in FIG. 19 an advantageous procedure for adjusting the cylinders 06; 07, which, in this case, are assigned the suffixes "1" and "2" to differentiate between the left and right printing couples or their print-on position is described in what follows.

First, a first cylinder 06.1, such as, for example, a transfer cylinder 06.1, which participates in defining the print position 05, is aligned in its position in the print-on setting, wherein actuators 82 are active, within the printing unit 01 and relative to the web by adjusting the stops 79 at both end surfaces. This can be accomplished, as indicated here, using an actuator 84, such as an adjustment screw, shown here by way of example as being manually actuable. A so-called "0-position" that defines the print position 05 is thereby established.

Once the stop 79 of the assigned forme cylinder 07.1 has been released, in other words once the stop 79 has been removed, for example, beforehand, by drawing it toward the top, and the print-on position of the transfer cylinder 06.1 is still activated, in other words the actuators 82 of the transfer cylinder 06.1 are activated, the amount of force F desired between the forme and transfer cylinders 07.1; 06.1 for the print-on position is exerted. This is accomplished by an impingement of the actuators 82 of the forme cylinder 07.1 with the desired amount of contact force P. If the bearing unit 14 (252) of the first forme cylinder 07.1 is also equipped with an adjustable stop 79, then, in a first variation this stop 79 can now be placed, substantially without force, in contact with the corresponding stop surface of the bearing block 74 on the first forme cylinder 07.1.

When the print-on position is activated, such as when a force is respectively exerted in the direction of the print position 05, for the two first cylinders 06.1; 07.1 and the print-off position of the second forme cylinder 07.2 is activated, while the stop 79 of the third cylinder 06.2 is being released, or after it has been released, the desired amount of force, or pressure P for the print-on position is exerted on the second transfer cylinder 06.2 or its bearing block 74. Once equilibrium is reached, its stop 79 is placed, substantially without force, in contact with the corresponding stop surface of the bearing block 74. Within this framework, the stop 79 of the first forme cylinder 07.1 can also be placed in contact with the allocated bearing block 74 beforehand, during this, or afterward, if this has not already taken place as in the aforementioned variation.

In a final step, with a free or an already released stop 79, the second forme cylinder 07.2 or its bearing block 74 is placed in the print-on position, while the allocated transfer cylinder 06.2 is also in print-on. Once a stationary condition has been reached, if a stop 79 is provided there, this stop 79 is also placed, essentially without force, in contact with the corresponding stop surface of the bearing block 74 on the second forme cylinder 07.2.

In this manner, an adjustment of the cylinder 06; 07 of the blanket-to-blanket printing unit 03 that is optimal for the printing process is accomplished.

In the represented embodiment of FIG. 19, all four cylinders 06; 07 are mounted so as to be adjustable to the print on/print off position via actuators 82. However, only the stops 79 of the two forme cylinders 07, and of one of the transfer cylinders 06, can be adjusted other than manually, such as, for example, via the pressure-actuable actuators 84, and especially can be remotely actuated. The stop 79 of the other transfer cylinder 06 can be adjusted and set, for example, using a positioning element 84, which is embodied as an adjustment screw. Therefore, it also need not have holding elements, for example.

In a simpler variation, as mentioned above, although all four cylinders 06; 07 are mounted so as to be linearly movable via actuators 82, only the two transfer cylinders 06 have movable stops 79, optionally with the above-mentioned actuators 84 and/or holding elements.

In a further simplified embodiment, although one of the two transfer cylinders 06 can be adjusted in terms of its position, it is not functionally movable in the sense of an on/off adjusting motion, but instead is mounted fixed to the frame. The three other cylinders 06; 07 are then movably mounted so as to allow an on/off adjustment. In a first variation, all of these three cylinders 06; 07, and in a second variation only the transfer cylinder 06 that is different from the fixed transfer cylinder 06, has a movable stop 79 and optionally also has the holding element.

In a further improvement on the cylinder bearing, the bearing units 14 (252) of the forme cylinders 07 and/or of the transfer cylinders 06 are themselves mounted so as to be movable on at least one end surface, for example in linear bearings, or by the use of a deformable suspension, in one direction of motion, which is perpendicular to the cylinder's rotational axis, and which has at least one component that is perpendicular to the direction of adjustment S. Preferably, this direction of motion is selected perpendicular to the direction of adjustment S, and, with the use of a one-sided actuation, causes the relevant cylinder 06; 07 to assume an inclined position, so-called "cocking".

In addition, the actuator 82, provided in the preceding embodiment of the bearing units 14 (252), is configured to provide an adjustment path $\Delta S$ that is suitable for on or off adjustment, and thus preferably has a linear travel that corresponds at least to $\Delta S$. The actuator 82 is provided for use in adjusting the contact pressure of rollers or cylinders 06, 07 engaged against one another and/or for performing the adjustment to the print-on/print-off position, and is configured accordingly. The adjustment path ΔS, or the linear travel, amounts, for example, to at least 1.5 mm, and especially to at least 2 mm.

The piston 82 is sealed against the pressure medium chamber by a seal that is positioned near the pressure chamber and which extends around the circumference of the piston 82, and is guided by a sliding guide which is positioned near the pressure chamber. A second seal and a second sliding guide can also be advantageously provided in an area of the piston 82 that is distant from the pressure chamber. In one particularly advantageous embodiment, in place of or, in addition to the second seal, the piston 82 is also sealed against the outside by a membrane, made of, for example rubber, and especially configured as a roller membrane. This roller membrane is connected, on one side, all the way around, to the piston 82. On the other side, on its outer peripheral line, the roller membrane is fully connected to the base component or to other stationary internal parts of the actuator element.

In one advantageous embodiment of the printing unit 01 in accordance with the present invention, parts of the printing unit 01, and especially the side frame sections 11; 12, are arranged so as to be linearly movable in relation to one another, especially in a linear guide 15, for the purpose of loading or servicing the printing unit 01, and the cylinders 06; 07 are arranged so as to be linearly movable within the corresponding side frame section 11; 12, in linear bearings 70, for the purpose of adjusting the contact pressure and/or for performing the print-on/print-off adjustment.

In principle, the drive embodiments, which will be described in what follows, are advantageous independently of the above-described separability and/or of the linear arrangement and/or of the special linear bearing and/or of the mentioned on/off positioning and adjustment of the cylinders 06; 07, and/or the above-described inking unit 08, and/or the use of roller sockets. However, particular advantages result specifically in combination with one or more of the aforementioned features of the subject invention.

Preferred embodiments of the drive for the printing couple 04, for example, including drive transmissions configured as functional modules, will now be described. In the drive solutions, functional groups or individual cylinders 06; 07 or cylinders of the printing unit 01 are equipped with their own drive motors, as will be discussed below, and especially are equipped with servo, AC, or asynchronous motors. In principle, a paired drive for the forme cylinder/transfer cylinder pair can also be used, which paired drive then comprises, for example, a print cylinder transmission with its own drive motor. In addition, an inking unit transmission with its own drive motor, for rotation and oscillating motion and, in the case of wet offset, a dampening unit transmission with its own drive motor, for rotation and oscillating motion, have a high level of variability and quality.

The concept of individual drive modules for separate printing couple cylinder drives, for inking unit drives and for dampening unit drives ensures both the separability of each printing couple 04 of the printing unit 01 at the printing point 05 and the separability between the forme cylinder 07 and the respective inking unit 08. The separate drives for printing couple cylinders 06; 07, for the inking unit 08 and optionally for the dampening unit 09 also permits a simultaneous set-up operation and printing forme change and/or a washing of the rubber blanket, while a separate washing of the inking unit and/or a pre-inking is taking place. In this case, the process programs can differ from one another in terms of duration, speed and functional sequence.

On the left side of FIG. 20, the arrangement for dry offset printing are shown, by way of example, and on the right side those for wet offset printing are depicted. Of course, as a rule, the two printing couples 04 of a real blanket-to-blanket printing unit 03 are of the same type. In the views from the end surfaces, as depicted in FIG. 20*a*, for purposes of illustration, the roller layout has been omitted, and only the drive trains with motors have been shown. In the top plan view shown in FIG. 20*b*, the drive plan is within the context of the example of an inking unit 08 with two rotationally driven distribution cylinders 33; 33', as described above in connection with the inking unit 08, and, in the case of wet offset printing, in contrast to the above figures, using the example of a dampening unit 09 with two rotationally driven distribution cylinders 33; 33'.

The printing couple cylinders 06; 07 are driven at least in pairs. For each cylinder pair 06; 07, which consists of forme cylinder and the allocated transfer cylinder 07; 06, there is provided at least one independent drive motor 121 that is mechanically independent of other printing couple cylinders. This can be, for example, a mechanically independent drive motor 121, as represented in FIG. 20, or can be, as is not shown, a paired drive via drive connections or drive trains.

As is shown in FIG. 20, for one drive variation, each of the drive motors 121 is recognizably coupled with the two printing couple cylinders 06; 07 via at least one rotationally stable coupling 148, and especially through the use of at least one coupling 148 that compensates for angle. Preferably, two couplings 148 of this type are provided in series, and are separated by a spacer or by a component which is embodied together as a double joint, which then represents, as a unit, a coupling 151, which compensates for offset. Despite the movability of the cylinders 06; 07, during print on/off adjustment, the drive motors 121 can be arranged fixed to the frame. During assembly, it is necessary only for the shafts 78 with the coupling(s) 148 to be flange-mounted to the functional modules 122, which have been manufactured as separate units. Especially advantageously, each coupling 148 is configured as a multi-disk coupling 148 or as an all-metal coupling, and has at least one multi-disk packet, which is connected with two flanges, in a positive connection, but which may be offset in the circumferential direction of the disks.

The coupling 151 between each functional module 122 and the respective forme cylinder 07 is preferably configured to enable a side register control or regulation, such that this coupling 151 also accepts axial relative movement between forme cylinder 07 and functional module 122. This can also be achieved with the above-described multi-disk coupling 148, which enables an axial change in length due to deformation in the area of the disks. An axial drive, which is not shown, can be provided on the same side of the frame as the rotary drive, or on the opposite side.

The driven rollers 33; 33', and especially the driven distribution cylinders 33; 33', of the inking unit 08 are also preferably coupled, via at least one coupling 149, and especially via a coupling 149 that compensates for angular variations, to the functional module 138. Because, as a rule, no on/off adjustment of these rollers 33; 33' occurs, a coupling 149 of this type is sufficient. In a simpler embodiment, the coupling 149 is also configured merely as a rigid flanged connection. The same is true of the drive on the dampening unit 09, optionally provided as functional module 139.

In FIG. 20*b*, the two distribution cylinders 33; 33' are configured to be rotationally positively driven, in this case by the drive motor 128.

In FIG. 20, in an advantageous embodiment, each of the printing cylinders 06; 07 is driven by a separate drive motor 121. Preferably, in a "drive train" between each drive motor 121 and each cylinder 06; 07, a transmission 150, and especially a reduction gearing 150, such as, for example, a planetary gear set, is provided. Such a gear set can be structurally pre-assembled, as an attached transmission mounted on the motor 121, to form a component unit. However, a modular transmission can also be provided as the drive or the functional module, at the intake of which the drive motor 121 can be coupled, and at the output of which the respective cylinder 06; 07 can be coupled, especially via a coupling 148 or 151 that serves to compensate for angle and/or offset. Rather than a drive motor 121 with transmission 150, the drive 121 can also be advantageously configured as a permanent magnet synchronous motor 121.

In a particularly advantageous embodiment of the present invention, the drive motor 121, for the drive of the cylinder 06; 07 that is to be connected, is structured as a synchronous motor 121 and/or as a permanent magnet electric motor 121, as especially is structured as a permanent magnet synchronous motor 121. This drive motor 121 is a directly driven cylindrical motor and has a stator with a three-phase winding and has a rotor with permanent magnets. With this configuration of the drive motor 121, and especially using the permanent magnets, a high power density is achieved, which therefore makes the use of transmission ratios unnecessary. Imprecisions in the drive train and wear and tear of mechanical elements such as gears are thereby eliminated.

In a second advantageous preferred embodiment of the drive coupling, as depicted schematically in FIG. 20, the coupling is implemented between the rotational body, for example cylinder 06; 07, and the drive motor 121 directly, i.e., without a separate coupling that enables axial relative movement, and/or without a coupling that will compensate for angle and/or offset, to the shaft 78. This coupling can be configured as a rigid, but separable coupling. In this embodiment, the drive motor 121 is arranged, for example, not fixed to the frame, but fixed to the cylinder, and is moved along with the cylinder 06; 07 during on/off adjustment, and, if applicable, also during side register displacement. In the case of cylinders 06; 07 that can be moved by a bearing arrangement 14, the drive motors 121 for each of the printing couple cylinders 06; 07 are rigidly connected, for example by being screwed, not to the side frame 11; 12, but instead directly to the movable bearing block 74, and are moved along with bearing block 74 during the adjusting movement.

In FIG. 20, the drive of the rotating component, and especially the drive of the cylinder 06; 07 that is mounted on the bearing unit 14, is embodied with a drive motor 121, which is configured as a synchronous motor 121 and/or as a permanent magnet motor, with a section of permanent magnets on the rotor.

Figure 22:
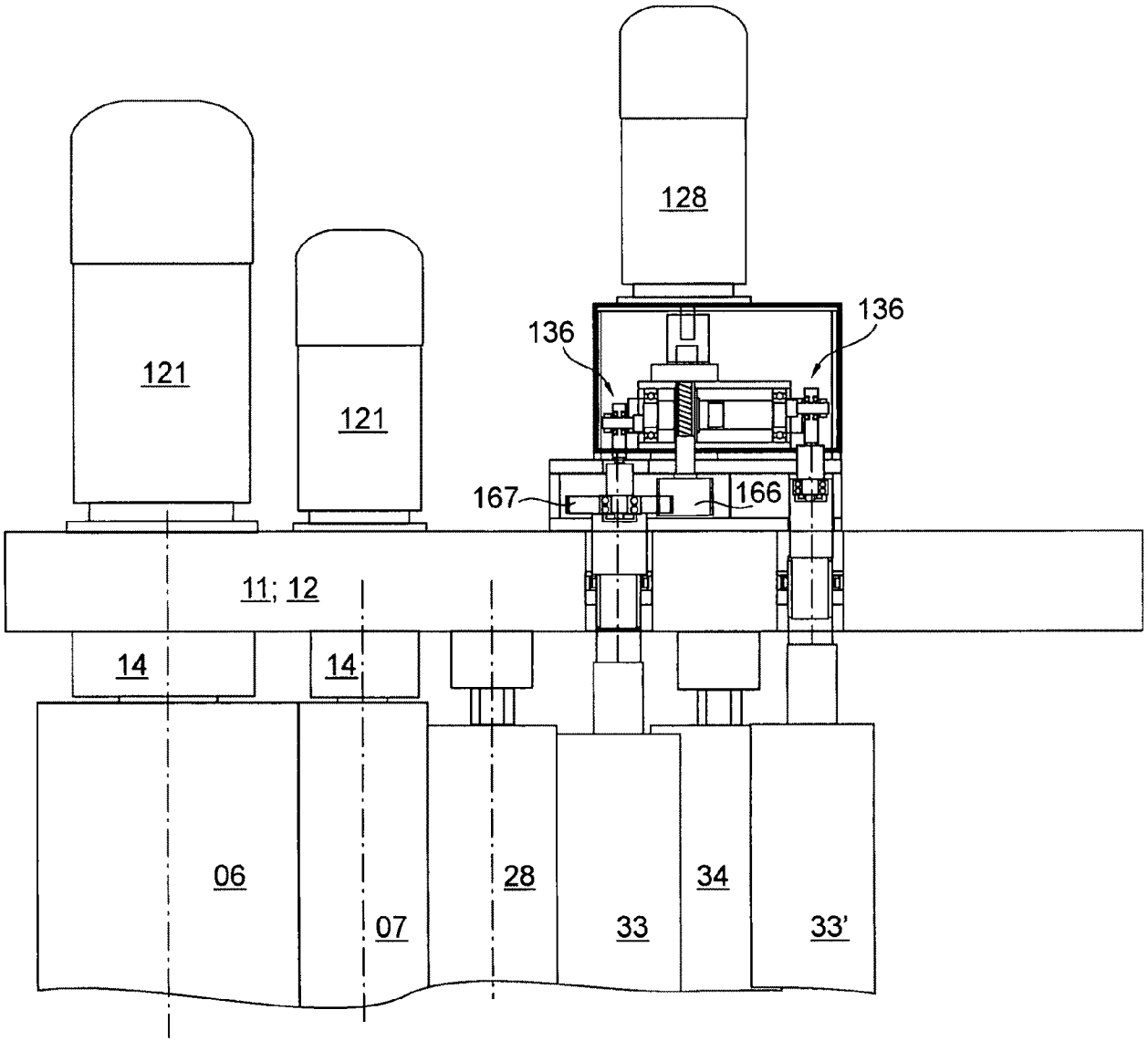
FIG. 22 a further preferred embodiment of an inking unit drive.

The rollers 28; 33; 34; 33' of the inking unit 08 are represented in FIG. 22 in an "exploded" view, in order to illustrate them as compared with those of FIG. 5 through 10.

In this case, the stator is rigidly connected, for example, directly or indirectly to the movable part of the bearing unit 14, for example to the movable bearing block 74, and can be moved together with it. In the case of a different type of bearing arrangement 14, the stator is mounted, for example, on the inner eccentric bushing or the lever.

Figure 21:
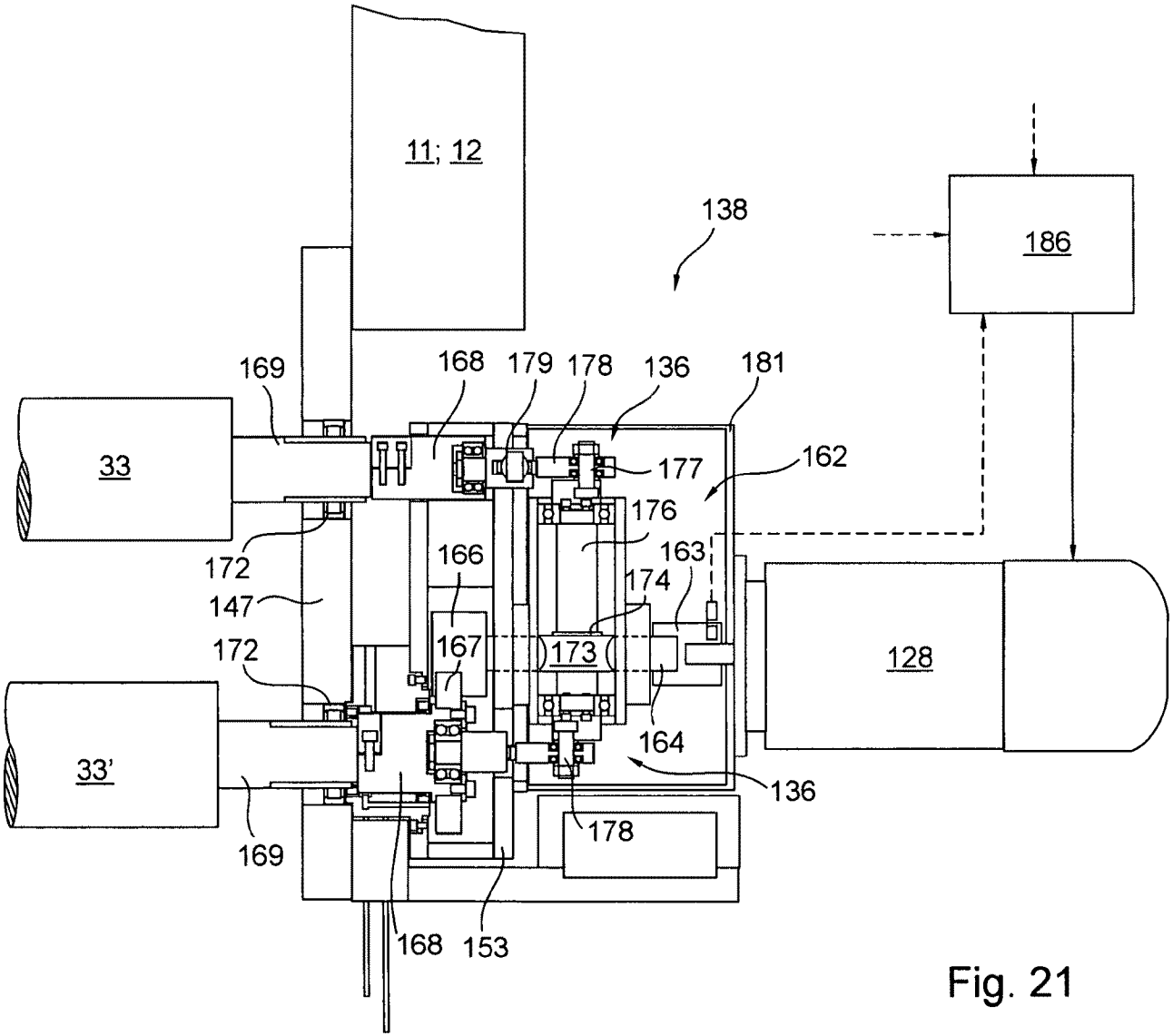
FIG. 21 a preferred embodiment of an inking unit drive.

FIGS. 21 and 22 show embodiments of the inking unit 08 or the inking unit drive, which are advantageous, for example, in terms of ink transport and wear and tear, and which offer advantages when used alone, but also when used in combination with one or more features of the above-mentioned printing units 01.

The inking unit 08, which is characterized, for example, as a single-train roller inking unit 08, or also as a "long inking unit," has a plurality of the rollers 28; 33; 33' 34; 36; 37 that have already been discussed above. As represented in FIG. 5 through 10, inking unit 08 comprises one first ink forme roller 28, which applies the ink to the printing forme of the forme cylinder 07, and which receives the ink via an oscillating distribution roller 33 or a distribution cylinder 33, typically provided with a hard surface, which is close to the printing forme or the forme cylinder, at least one ink or transfer roller 34, typically with a soft surface, a second oscillating distribution roller 33' or distribution cylinder 33', which is remote from the forme cylinder, another ink or transfer roller 34, typically also with a soft surface, a film roller 37, which is not specifically represented in FIG. 22, and an ink fountain roller or dipping roller 36, from an ink fountain 38. Dipping and film rollers 36; 37, which are characteristic of a film inking unit, can also be advantageously replaced by a different ink supply or metering system, such as, for example, by a pump system in the pump inking unit, or a vibrator system in the vibrator inking system.

The soft surfaces of the forme and/or transfer rollers 28; 34 referred to as the soft rollers 28; 34, are configured to be flexible in the radial direction, for example, by having a rubber layer, which is indicated in FIG. 5 through 10 by the bold circular lines.

When the rollers 28; 33; 33'; 34; 37 of the inking unit 08 are then placed in contact with one another, the hard surfaces of the distribution cylinders 33; 33' penetrate into the soft surfaces of the respective cooperating soft rollers 28; 34, to a greater or lesser degree, depending upon contact pressure and/or adjustment path. In this way, the circumferential conditions of cooperating rollers 28; 33; 33'; 34; 37 that are rolling off against one another change, depending upon impression depth.

If, for example, for one of multiple cooperating rollers a positive rotational actuation occurs based upon a preset speed, such as, for example, via a drive motor or a corresponding mechanical drive connection to another actuated component, then an adjacent soft roller, that is actuated only by friction from the former roller, rotates at a different speed, based upon impression depth. However, if this soft roller were to also be actuated by an independent drive motor, or additionally by friction at a second nip point by another speed-determined roller, then, in the first case, this could result in a difference between the motor-driven preset speed and the speed caused by friction. In the second case, it could result in a difference between the two speeds, as caused by friction. This would result in slip at the nip points, and the drive motor or motors would thus be needlessly stressed.

In the inking unit 08, and especially for the embodiment of the drive according to FIG. 21, in the area in which ink is applied to the printing forme 22 by the rollers 28, with the solution described for FIGS. 22 and 21 below, a slip-free rolling, or a "true rolling", and inking are achieved.

In FIG. 22, the distribution cylinder 33, which is situated close to the forme cylinder, is rotationally actuated only via friction with adjacent rollers 28; 34, and for its rotational actuation does not have an additional mechanical drive connection for driving the printing couple cylinders 06; 07, or another inking unit roller that is positively rotationally actuated, or its own separate drive motor. In this manner, the first distribution cylinder 33 is rotationally driven predominantly via the, in this example, two, or optionally also is driven by one or three forme rollers 34, which are driven by friction with the forme cylinder 07, and essentially has the circumferential speed of the forme cylinder 07, independent of the impressions in the nip points that lie between the two. The distribution cylinder 33' that is distant from the forme cylinder, as shown in FIG. 22, has a drive motor 128 that drives it rotationally, but, aside from the friction gearing formed by the rollers 33'; 34; 33, has no mechanical coupling to the first distribution cylinder 33. If there are more than two distribution cylinders 33; 33', such as, for example, three such distribution cylinders, the two that are distant from the forme cylinder can be positively rotationally driven, or only the center distribution cylinder, or the one that is farthest from the forme cylinder, can be positively rotationally driven.

Preferably, the two distribution cylinders 33; 33' have a transmission 136, such as, for example, an oscillation or friction gearing 136.

In an embodiment that is mechanically less complicated, the distribution cylinder 33 that is close to the forme cylinder has its own oscillation gearing 136 that merely converts its rotational motion into an oscillating motion. This can advantageously be configured as a cam mechanism. For example, an axial stop that is fixed to the frame can cooperate with a curved, peripheral groove that is fixed to the roller, or an axial stop that is fixed to the roller, can ride in a peripheral groove of a cam disk, with that groove and cam disk being fixed to the frame. In principle, this transmission 136, which converts rotation to an oscillating axial linear stroke, can be embodied as another suitable transmission 136, for example as a worm gear or as a crank mechanism that has an eccentric.

The oscillation transmission 136 of the first distribution cylinder 33 is advantageously mechanically coupled to the oscillation transmission 136 of the second distribution cylinder 33' via a transmission, as depicted in FIG. 22. The two coupled oscillation transmissions 136 advantageously represent a shared oscillation drive 162, an oscillation transmission 162, and are positively driven in their oscillating motion via a drive motor. Preferably, the positive drive of the oscillation transmission 162 is accomplished via the drive motor 128, which rotationally drives the second distribution cylinder 33', as is depicted in FIG. 21.

In FIG. 21, an advantageous embodiment of the drive of the distribution cylinders 33; 33' is illustrated. Only the second distribution cylinder 33' is positively rotationally driven, but both distribution cylinders 33, 33' are positively axially driven via the shared oscillation drive 162. The printing couple cylinders 06; 07 can be embodied either in pairs with a drive motor 121 for each cylinder pair, or advantageously can each be provided with its own separate drive motor 121, as represented in FIG. 20 or 22.

In FIG. 22, the reverse situation is represented. Only the distribution cylinder 33, that is close to the forme cylinder, is positively rotationally driven. Those parts that recognizably correspond to those of FIG. 21 are not explicitly described or characterized again in connection with FIG. 22.

In addition, in FIG. 21 and in FIG. 22, the drive motor 128 drives a driving pinion 166 via a coupling 163 via a shaft 164, which driving pinion 166, in turn, cooperates with a spur gear 167, which is non-rotatably connected to the second or to the first distribution cylinder 33'; 33, respectively. The connection can be made, for example, via an axle segment 168, which supports the spur gear 167, on a journal 169 of the second, as seen in FIG. 21 or of the first distribution cylinder 33'; 33, as seen in FIG. 22. A corresponding axle segment 168 of the first distribution cylinder shown in FIG. 21 or of the second distribution cylinder 33; 33', shown in FIG. 22, has no spur gear 167 of this type and no drive connection to the drive motor 128. The drive connection between the driving pinion 166 and the spur gear 167 of the second or first distribution cylinder 33'; 33 is preferably evenly toothed and is configured with an overlap in the toothed engagement, which overlap is great enough for any position of the oscillating movement. As represented, by way of example in FIG. 21, the two distribution cylinders 33; 33' are mounted in a frame 147, which is formed on the side frame 147 or frame, in bearings 172, for example in radial bearings 172, or in the side frame 11; 12, as shown in FIG. 22, which additionally enables axial movement. In this case, there is no rotational drive connection between the drive motor 128 and the first or second distribution cylinder 33; 33'. Driving pinion 166 and the spur gear 167, which is arranged on the axle segment 168, together represent a transmission, and especially a reduction gearing, which, in turn, is a closed and/or a pre-assembled component with its own housing 153. The component can be coupled to the journals 169 at the output side.

The oscillation drive 162 is also driven by the drive motor 128, for example via a worm drive 173, 174. In this configuration, actuation is accomplished via a worm 173 that is arranged out of the shaft 164, or via a section of the shaft 164 which is configured as a worm 173 on a worm gear 174, which is non-rotatably connected to a shaft 176 and that extends perpendicular to the rotational axis of the distribution cylinders 33; 33'. In each case, on an end surface of the shaft 176, a driver 177 is arranged eccentrically to the rotational axis of the shaft, and is, in turn, connected to the journals 169 of the distribution cylinders 33; 33', for example via a crank mechanism, for example via a lever 178, which is rotatably mounted on the driver 177, and a joint 179, so as to be rigid with respect to pressure and tension exerted in the axial direction of the distribution cylinders 33; 33'. In FIG. 20 the friction gearing 136 of the distribution cylinder 33' that is distant from the forme cylinder is indicated only by a dashed line, as, in this view, it is covered by the spur gear 167. A rotation of the shaft 176, as seen in FIG. 21, causes the driver 177 to rotate, which, in turn, causes the axial travel of the distribution cylinders 33; 33' via the crank drive. The output of the oscillation drive 162 can also occur at another point in the rotational drive train between the drive motor 128 and the distribution cylinder 33', or even on a corresponding oscillation transmission 162, on the other side of the machine from the journal 169 that is located at the other end surface of the distribution cylinder 33'. A transmission that is different from a worm drive 173, 174, for use in decoupling the axial drive, can also be optionally provided.

As represented in FIGS. 21 and 22, the oscillation drive 162 or the oscillation transmission 162 is configured as a complete structural unit with its own housing 181. This can also be embodied as an encapsulated unit.

Because, in the configuration shown in FIG. 21, the distribution cylinder 33 close to the forme cylinder has no positive rotational drive, the rollers 28; (34), at least in the area of the inking unit that is close to the forme cylinder, roll off against one another largely slip free. In FIG. 22, only the distribution cylinder 33 that is close to the forme cylinder is positively rotationally driven, so that in the rear part of the inking unit 08, competing positive drives are eliminated. In general, it will be understood that, in the drive of the inking unit 08, it can be advantageous for only one of two distribution cylinders 33; 33' to be positively rotationally driven.

In principle, the drive motor 128 that rotationally drives the one distribution cylinder 33; 33' can be configured as an electric motor, which can be controlled or can be regulated with respect to its output and/or its torque and/or even with respect to its speed. In the latter case, if the drive motor 128 is also operated with speed regulation/control in print-on mode, the above-mentioned problems, with respect to different roller circumferences, can still arise in the area of the inking unit 08 that is distant from the forme cylinder.

However, with respect to the set of problems of a preset speed competing with the friction gearing, described above, the drive motor 128 is advantageously configured such that it can be controlled or regulated with respect to its output and/or its speed, at least during print operation. In principle, this can be accomplished by the provision of a drive motor 128, which is configured as a synchronous motor 128 or as an asynchronous motor 128.

In one embodiment, which is the simplest in terms of complexity, the drive motor 128 is configured as an asynchronous motor 128, for which, in an allocated drive control 186, only one frequency, such as, for example, when the inking unit 08 is in the print-off position, and/or one electrical driving power or one torque, when the inking unit 08 is in the print-on position, is preset. When the inking unit 08 is in the print-off position, or in other words when the forme rollers 28 are out of rolling contact with the forme cylinder 07, the inking unit 08 can be brought to a circumferential speed that is suitable for print-on adjustment, using the preset frequency and/or driving power, via the second distribution cylinder 33', at which speed the circumferential speeds of the forme cylinder 07 and forme rollers 28 differ from one another by less than 10%, and especially differ by less than 5%. A preset frequency or output suitable for this can be determined empirically and/or through calculation performed in advance, and can be performed either in the drive control itself, in a machine control, or in a data processor of a control console. The preset value can preferably be changed by the press operator which advantageously also applies to the preset values listed below.

In the print-on position, in which the forme rollers 28 are in rolling contact with the forme cylinder 07 and all the ink forme rollers are engaged against one another, the rollers 28; 33; 34; 33'; 34; 37 are rotationally driven in part by the forme cylinder 07 via the friction gearing now generated between the rollers 28; 33; 34; 33'; 34; 37, so that the drive motor 128 need only apply the dissipated power, which increases, in the friction gearing, with its increasing distance from the forme cylinder 07. In other words, the drive motor 128 can be operated at a low driving torque or at a low driving power, which contributes only to keeping the rear part of the inking unit 08 at the circumferential speed that is predetermined substantially by the frictional contact. In a first variation, this driving power can be held constant for all production speeds, or speeds of the forme cylinder 07, and can correspond either to the preset value for starting up in print-off, or can represent an intrinsic constant value for production. In a second variation, for different production speeds, and optionally for starting up in print-off, different preset values, with respect to frequency and/or driving power, can be predetermined and stored. Depending upon the production rate, or the production speed, the preset value for the drive motor 128 can then vary.

In the discussion which follows, devices, such as the roller sockets 257, for use in adjusting a contact pressure that is exerted by a roller in a roller strip on an adjacent rotational body, and/or for engaging the roller against the rotational body, and/or for moving the roller away from this rotational body, together with the respective control or regulation of these devices, will be discussed in greater detail.

The first ink forme roller 28, as is also represented in FIGS. 9, 10 and 13 as a representation of the other embodiments of the inking unit 08, has this type of roller socket 257 for on/off adjustment. Advantageously, as indicated in FIG. 10, all of the adjustable rollers 28, 34 of the inking unit 08, and optionally the adjustable rollers 41; 43 of the dampening unit 09, if one is present, all have an automatic roller socket 257 of this type.

By using the roller socket 257, as will be described below, the rollers 28, 34, 41, 43 that are mounted in this manner are each configured as rollers 28, 34, 41, 43 that can be controlled in terms of their contact force.

In the examples shown, each of these controllable rollers 28; 34; 41 of the inking unit 08 or of the dampening unit 09, is in direct contact with two adjacent rotational bodies. Each of these rollers 28; 34; 41 is placed simultaneously against two of the rotational bodies provided in this arrangement, so that each of these rollers 28; 34; 41 has, on its circumferential surface, two roller strips, also called nip points, which extend substantially axially in relation to the respective roller. Each roller that is controllable, in terms of its contact pressure, presses into its respective roller strip with an adjustable contact force against its adjacent rotational bodies.

An operational position for at least one of these controllable rollers 28; 34; 41; 261; 262; 263 can also be provided in the printing couple 04, in which position this roller is in direct contact with only one adjacent rotational body, and is separated from its second adjacent rotational body, or is configured only as a supplementary roller or as a so-called "rider roller." In this case, this controllable roller is then assigned only a single adjacent rotational body, for example.

In practice, in order to achieve high quality for the printed product to be produced using the printing couple 04, it is necessary to adjust the roller strip present in the printing couple 04 to a specific force or width. The width lies within the range of a few millimeters, such as, for example, between 1 mm and 10 mm.

Figure 23:
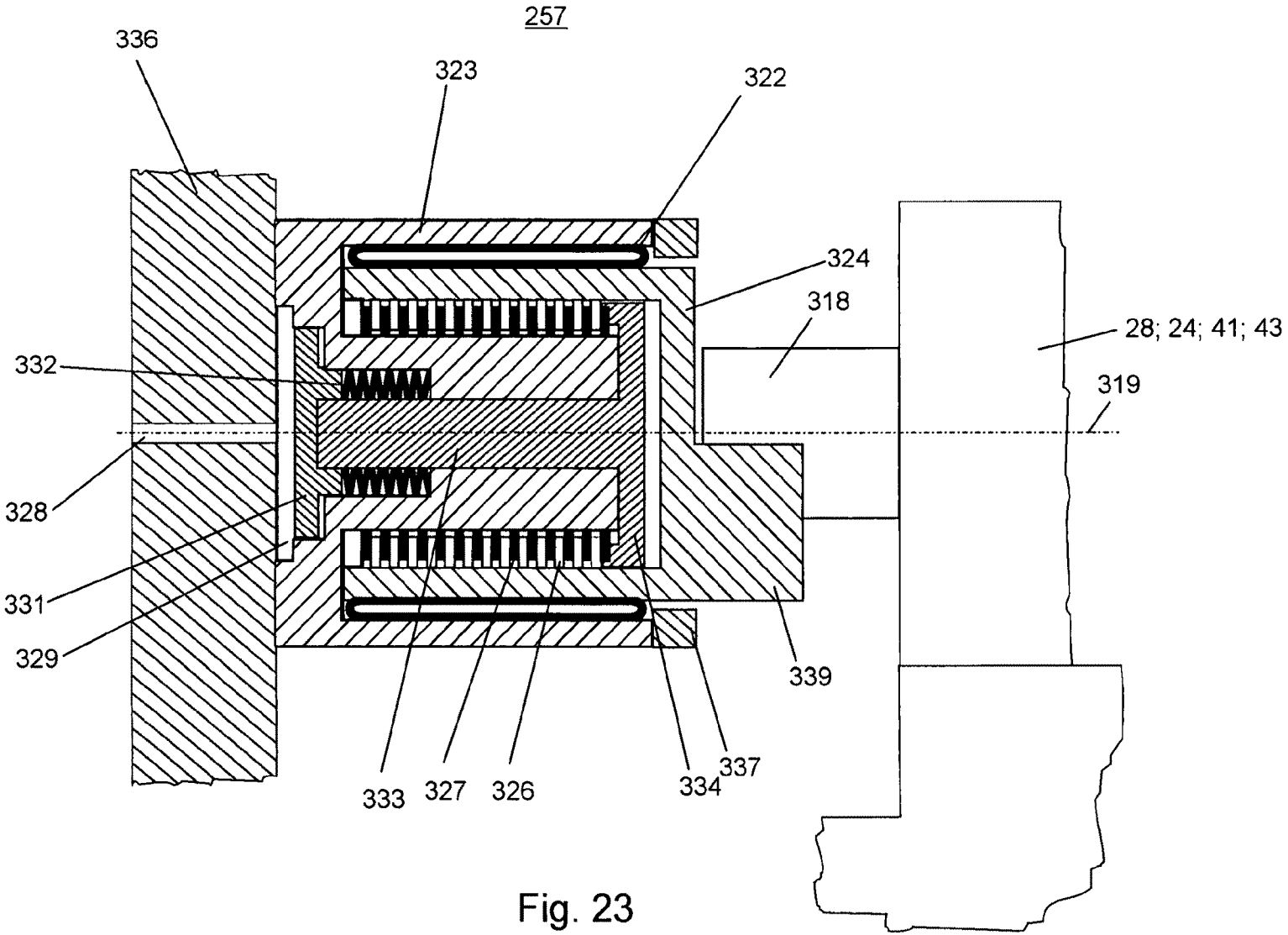
FIG. 23 a longitudinal cross-sectional view of a roller socket.

Each of the rollers 28; 34; 41; 43, which is controllable in terms of its contact force, and especially the first ink forme roller 28, is seated at both of its ends 318, for example, at end journals 318, in a support bearing, generally at 257, as seen in FIG. 23, and with a roller mount 339, which is capable of radial travel, in a so-called roller socket 257. Each support bearing 257 or roller socket 257 has at least one, and preferably has several actuators 322, which act upon the roller 28; 34; 41; 43. The actuators 322, in turn, are preferably arranged in a housing belonging to the support bearing 257 or the roller socket 257, and can each be acted upon by a pressure medium, for example. In what follows, the actuators 322 are described as actuators 322 that can be acted upon by a pressure medium, which corresponds to their preferred embodiment. However, the control of the support bearings 257 and/or of their actuators 322, described in what follows, is independent of the medium which is used to exert the contact force. To implement the desired control, the actuators 322 can also be configured, for example, as actuators 322, which exert the respective contact force, for example, based upon a hydraulic, electric, motorized, or piezoelectric effect. In each case, actuation or use of the actuators 322 cause the roller mount 339 to be moved eccentrically, with respect to the support bearing 257, in a plane that extends orthogonally, in relation to the axial direction of the controllable roller 28; 34; 41; 43. The radial travel can extend along a linear or nonlinear path.

Figure 24:
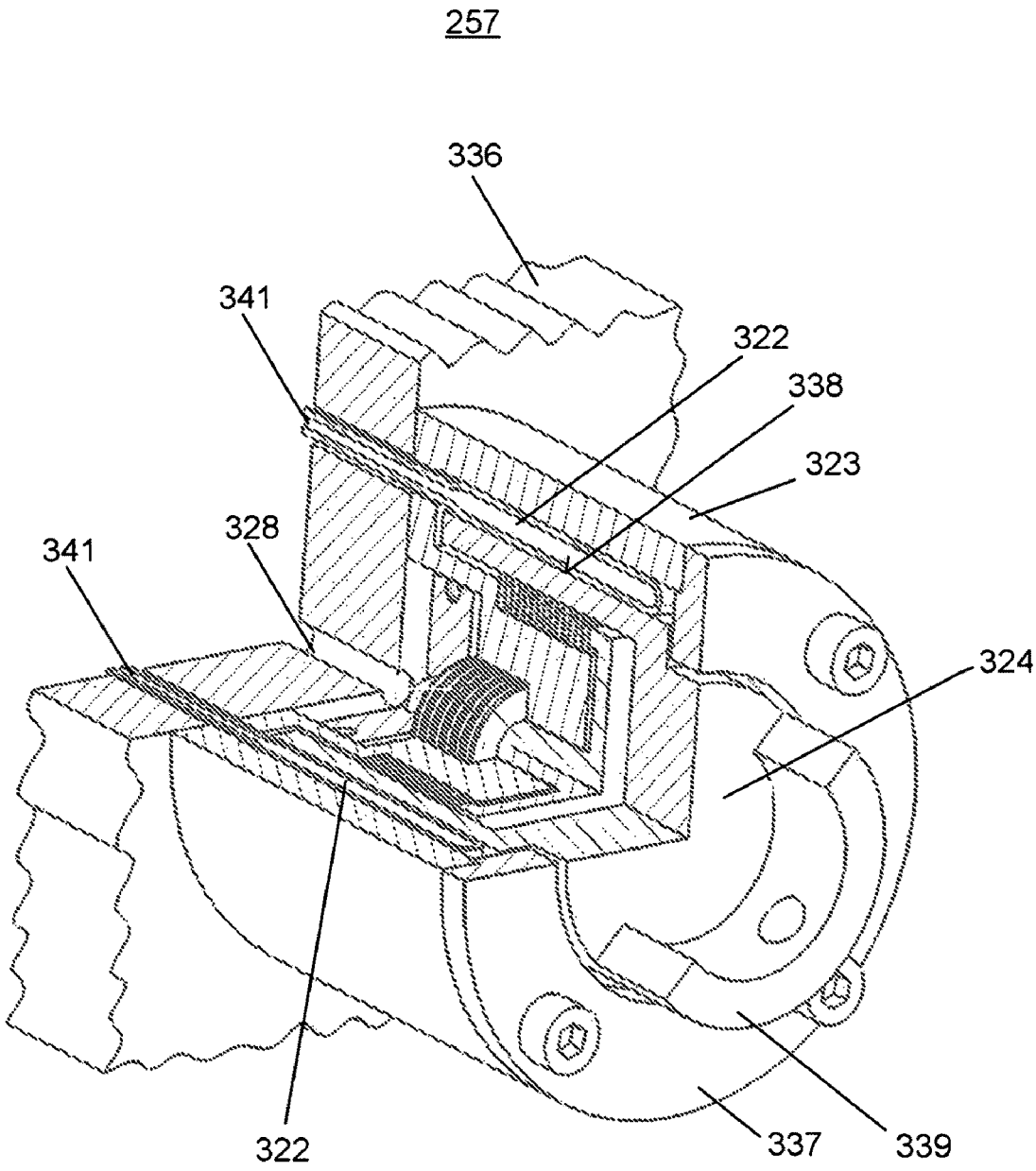
FIG. 24 a perspective view of the roller socket in accordance with FIG. 23, with a partial longitudinal section taken in two planes that are orthogonal to one another.

The radial travel of the roller mount 339, which is permissible in the support bearing 257 which is arranged, for example, fixed to the frame, therefore leads to an eccentric displacement of the roller mount 339 in the support bearing 257, which support bearing 257 is preferably embodied as a radial bearing. In FIGS. 23 and 24, the structure of a roller socket 257 is represented, by way of example. FIG. 23 shows a longitudinal section of the roller socket 257, taken parallel to the axis 319 of the roller. FIG. 24 shows a perspective view of the roller socket 257 of FIG. 23, with a partial longitudinal section in two planes, which two planes are orthogonal to one another. At least all of the rollers 28; 41 that cooperate directly with a forme cylinder 07 can have at least one actuator 322, which is controlled independently of the other actuators 322 of the rollers 28; 41 which cooperate directly with the forme cylinder 07.

The housing of the roller socket 257 has a frame holder 323, which may be, for example, sleeve shaped, and in the interior of which frame holder 323 a roller holder 324 is mounted. The actuators 322, when actuated, act upon the roller holder 324, and are capable of displacing the roller holder 324 radially within a gap that is formed radially around the axis 319, between the frame holder 323 and the roller holder 324. The gap between the frame holder 323 and the roller holder 324 has, for example, a width of 1 mm to 10 mm, and preferably had a width of approximately 2 mm. The actuators 322 are arranged, for example, in the gap between the frame holder 323 and the roller holder 324, or respectively are arranged in a chamber or in a recess in the frame holder 323. The actuator 322 that is arranged in the chamber or in the recess of the frame holder 323 has an active surface 338 that is oriented toward the roller holder 324, with which active surface 338, the actuator 322, in its operational state in which it is acted upon by a pressure medium, exerts surface pressure against the roller holder 324.

The actuators 322 are preferably non-rotatably arranged in the housing of the roller socket 257, opposite this housing or at least opposite the frame holder 323. Each of the actuators 322 is configured, for example, as a hollow component that can be acted upon by a pressure medium, such as, for example, as a pressurized tube. The hollow component has at least one surface 338, as seen in FIG. 24, which is made of a reversibly deformable elastomeric material. This surface 338 is configured, for example, in a further embodiment, which is not specifically shown here, as a membrane. The membrane 338 preferably comes to rest against an outer circumferential surface of the roller holder 324 when the hollow component is pressurized. The reversibly deformable surface 338 thus corresponds, at least largely, to the surface 338 used to exert the surface pressure. In the preferred embodiment presented here, the actuators 322 have no pistons that are guided in a cylinder, and are instead without piston rods. The integration of the actuators 322 into the housing of the roller socket 257 obviously results in a highly compact construction of the roller socket 257. The pressure medium is supplied to each of the actuators 322 through a pressure medium line 341, as is depicted schematically in FIG. 24.

One of the ends 318 of the rollers 28; 34; 41; 43, that are controllable in terms of their contact force, is mounted in the roller mount 339, which is configured on the roller holder 324, for example in semicircular shape, preferably as a quick-release coupling, and is rigidly connected to that roller holder 324. Each roller that is controllable, in terms of its contact force, is capable of rotating around its own axis 319. As an alternative to the rigid connection of the roller mount 339 to the end of the roller 28; 34; 41; 43, the roller mount 339 has a bearing, for example a roller bearing or a friction bearing, in which the end of the roller is rotatably mounted. The frame holder 323 is fastened, for example, on a frame panel 336 of the printing couple 04. The roller socket 257 is preferably sealed against dust, moisture and other contaminants at its end surface that faces the roller, which is controllable in terms of its contact force, by a sealing element 337, which especially covers the gap between the frame holder 323 and the roller holder 324. The sealing element 337 is, for example, attached to the frame holder 323 with screws. With the sealing element 337, the actuators 322 are also especially protected against contamination and therefore are also protected against a breakdown of their mobility. With the radial displacement of the roller holder 324 in the frame holder 323, a roller can also be engaged against, or can be disengaged from its adjacent rotational body.

The roller socket 257 has, for example, an immobilization device, which fixes the roller holder 324, and therefore also fixes the roller 28; 34; 41; 43 that is rigidly connected to it, in a first operating position, thereby locking it against any radial displacement in relation to the frame holder 323, or, in a second operating position, releasing it to permit such displacement. The immobilization device has, for example, a preferably coaxial first disk packet 326 that is rigidly connected, for example, to the roller holder 324, and a second disk packet 327, also preferably coaxial. The disks of the second disk packet 327 engage or interdigitate between the disks of the first disk packet 326. Immobilization is accomplished, preferably non-positively or positively, with the engagement of the disks. Once the non-positive or positive connection of the disks has been released, the second disk packet 327 is capable of moving in the axial direction of the roller socket 257.

The axial movement of the second disk packet 327 is accomplished in response to a pressure medium being conducted through a groove 328, which is formed in the frame panel 336, and into a pressure chamber 329 which is arranged in the roller socket 257. A pressure plate 331, which is arranged in the pressure chamber 329, moves a ram 333, which is preferably positioned in the roller holder 324, axially, against the force of a spring element 332. The second disk packet 327 is fastened to a ram head 334 of the ram 333, and is also moved with an axial movement of the ram 333, thereby causing the disks of the disk packets 326; 327 to move out of engagement. With a decrease in the pressure which is exerted by the pressure medium in the pressure chamber 329 on the pressure plate 331, the force that is exerted by the spring element 332, guides the disks of the disk packets 326; 327 back into engagement with one another, thereby immobilizing the roller holder 324 in the frame holder 323, which frame holder 323 can be radially displaced by the actuators 322 of the roller socket 257.

Figure 25:
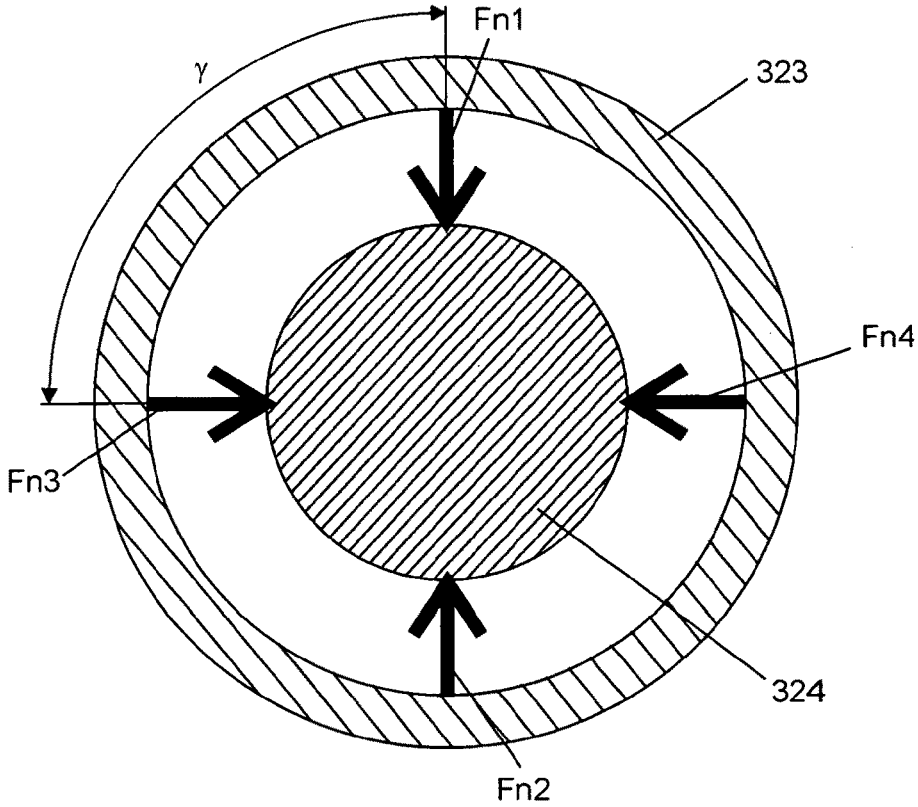
FIG. 25 a schematic representation of radial forces which are exerted by actuators on a controllable roller, without a displacement of the controllable roller.
Figure 26:
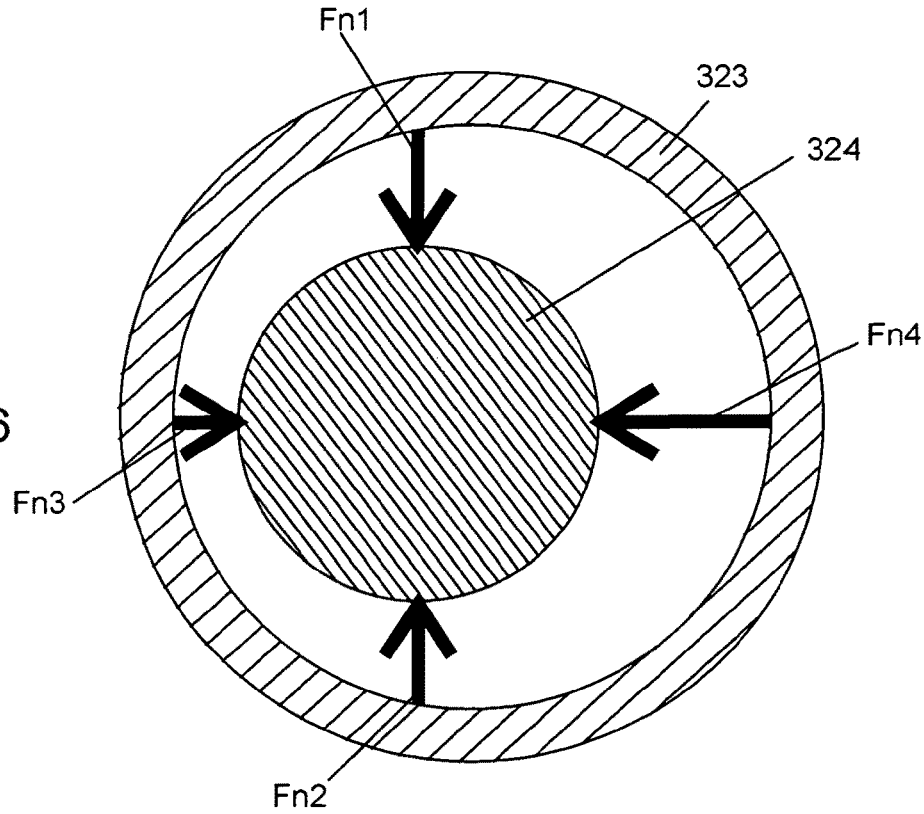
FIG. 26 a schematic representation of radial forces which are exerted by actuators on a controllable roller, with displacement of the controllable roller.

In the embodiment shown in FIGS. 23 and 24, each roller socket 257 has four actuators 322 arranged in a circular pattern around the axis 319 of the roller 28; 34; 41; 43. The actuators 322 are preferably distributed, evenly spaced, around the axis 319 of the roller 28; 34; 41; 43, which is to be controllable in terms of its contact force. The actuators 322 are remotely controllable. They can be actuated via a control unit, and are preferably configured as pneumatic actuators 322. A compressed gas, preferably compressed air, may be used, for example, as the pressure medium. An alternative to the preferred pneumatic actuators 322 is presented especially by hydraulic actuators 322 that can be pressurized with a fluid, or even by electromotive actuators 322. As is shown in FIG. 25 and in FIG. 26 in a schematic representation, each actuator 322, when acted upon by pressure medium, exerts a radial force Fn1; Fn2; Fn3; Fn4, directed toward the interior of its roller socket 257, on the roller 28; 34; 41; 43, which is connected to that roller socket 257 and is controllable in terms of its contact force. The actuators 322 are preferably supported radially on, or in the frame holder 323 of the roller socket 257, and, with the surface pressure exerted on the roller holder 324, which is arranged in the frame holder 323 so as to be radially displaced, exert the radial force Fn1; Fn2; Fn3; Fn4 on the roller 28; 34; 41; 43, which is attached in the roller holder 324 and is controllable in terms of its contact force. The pressure which is exerted by the pressure medium in the respective actuator 322 and the radial force Fn1; Fn2; Fn3; Fn4 of this actuator 322 accordingly correspond with one another. Radial forces Fn1; Fn2; Fn3; Fn4 exerted simultaneously by actuators 322 in the same roller socket 257 form an opening angle γ with one another, which is different from 0° and 180°, preferably lying between 45° and 135°, and measuring, for example, 90°. The contact force exerted by a roller 28; 34; 41; 43, which is controllable, in terms of its contact force, on an adjacent rotational body in a roller strip is then calculated as a vector sum of the simultaneously exerted radial forces Fn1; Fn2; Fn3; Fn4 of actuators 322 in the same roller socket 257, if applicable, taking into account a force of weight exerted at least in part on the adjacent rotational body by the controllable roller 28; 34; 41; 43 by virtue of its own mass.

With a characteristic identifier n in the symbol for the radial force Fn1; Fn2; Fn3; Fn4, a specific roller socket 257 can be characterized and accordingly identified. Preferably, each roller socket 257 that is allocated to a controllable roller 28; 34; 41; 43 and is integrated into the printing press is preferably assigned an identifier that can be used in the control system as an address, with which identifier the roller socket 257 can be clearly identified in the printing press or at least in a printing couple 04, and can thereby be selected in the control system. Likewise, each actuator 322, that is allocated to a roller socket 257, that is assigned an identifier, with which identifier each actuator 322 in one of the roller sockets 257, that is arranged in the printing press or in the respective printing couple 04 can be clearly identified, selected and controlled. Furthermore, as with the previously described identifiers, the pressure chamber 329 allocated to the immobilization device of each roller socket 257 is assigned an identifier, with which identifier ultimately each immobilization device of the roller sockets 257 arranged in the printing press or in the printing couple 301 can be clearly identified. The respective identifiers for the roller sockets 257, their actuators 322 and their immobilization device are preferably machine readable and can be stored in the control unit, preferably in an electronic control unit that processes digital data.

Each of the actuators 322, in each roller socket 257, in each preferred pneumatic embodiment, is connected to a pressure medium source, such as, for example, to a compressor, via a pressure medium line 341 that has a pressure level.

The control unit is embodied, for example, as a component of a control console or of a control console computer, which belongs to the printing press or at least to a printing couple 04, and is therefore allocated to the printing press or to the printing couple 04.

In a manner similar to the control of the rollers 28; 34; 41; 43, the actuator 82 or the actuators 82 of the respective bearing units 14 or bearing units 252 of the cylinders 06; 07 or of the rollers 28; 34; 41; 43 arranged in a printing couple 04 of a printing unit 01, can preferably be identified and can be addressed from the control console or from a control console computer, and can be controlled, for example, with at least one valve 93, in that an unambiguous identifier can be assigned to the actuator 82 or the actuators 82 of each of the respective bearing units 14.

Figure 27:
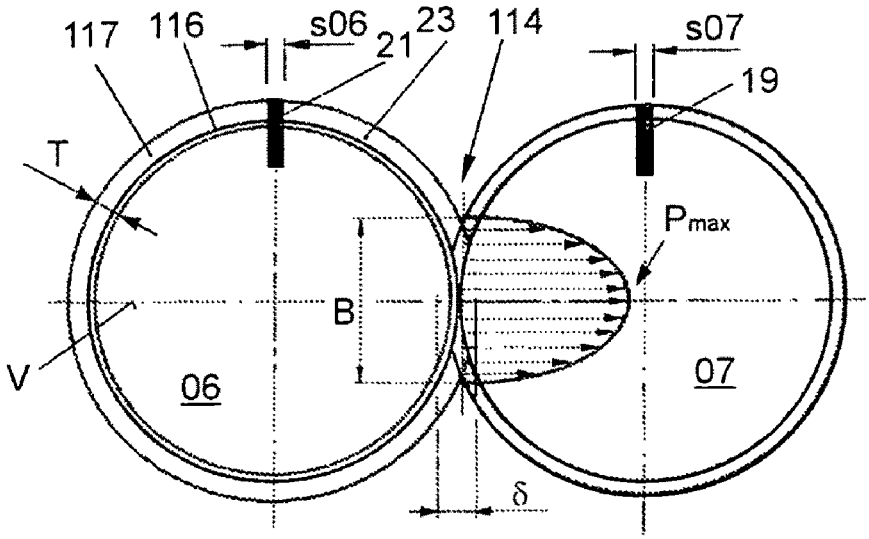
FIG. 27 a schematic representation of a nip point with a "soft" printing blanket.

In FIG. 27, a profile of a surface compression P in the print position of the forme cylinder 07 and the transfer cylinder 06 is represented. The surface compression P extends over an entire region of the contact zone. When in idle mode, at the height of a plane of connection V of the rotational axes, the surface compression P achieves a maximum surface compression $P_{max}$. During production, this is shifted to the incoming gap side as a result of the viscous component of the force. When projected onto a plane that is perpendicular to the plane of connection V, the contact zone, and therefore also the profile, has a width B. The maximum surface compression $P_{max}$ is ultimately responsible for ink transfer and must be adjusted appropriately.

Figure 28:
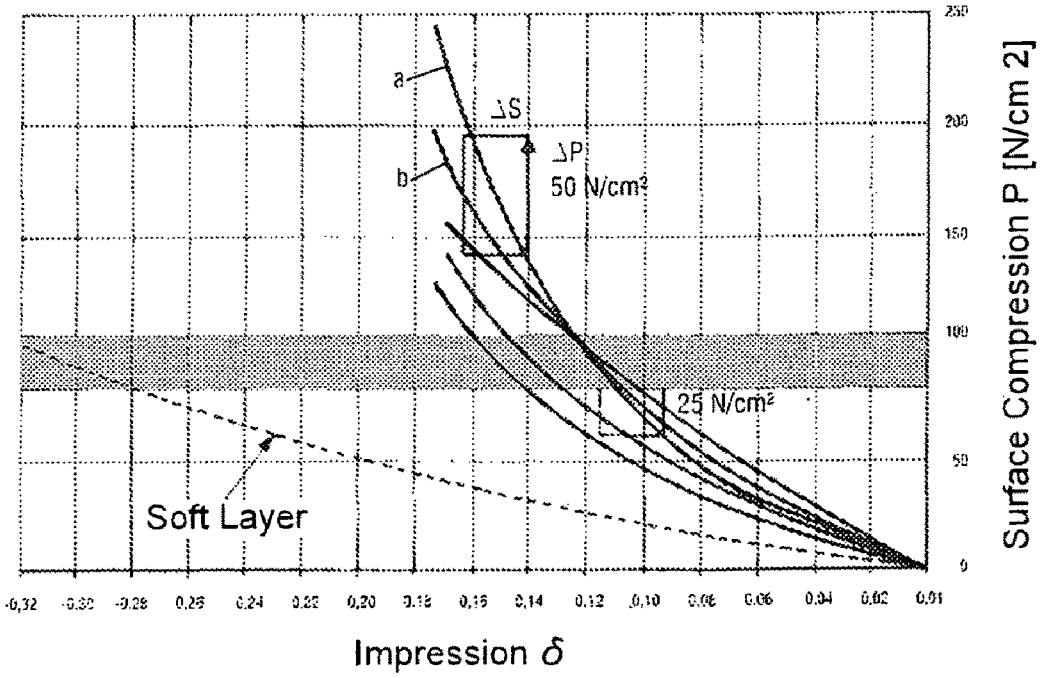
FIG. 28 a representation of characteristic curves of a spring for different printing blanket layers.

The absolute level of the surface compression P in the roller gap 114, and its fluctuation with the variation of the impression is substantially determined by a characteristic curve of the dressing 23, especially the metal printing blanket 23, especially the rubber printing blanket 23, on the transfer cylinder 07. The characteristic curve represents the surface compression P based upon the impression 6. In FIG. 28, a number of characteristic curves of customary dressings 23, and especially of metal printing blankets 23, with a fixed support plate 116 and an elastic layer, such as, for example, a rubber layer 117, are represented by way of example. The values are determined in the laboratory using a quasi-static stamping test apparatus. They can be transferred, in a suitable manner, to values that have been determined via different means.

As is shown in FIG. 28, an increase ΔP/Δδ in the characteristic curve determines the fluctuation in the surface compression P with a change in the impression δ. In the case of a variation Δδ of the impression by an average impression value δ, the degree of fluctuation ΔP of the necessary maximum surface compression $P_{max}$ in the roller gap 114 by the average surface compression is nearly proportional to the increase ΔP/Δδ in the characteristic curve at the point δ. Thus, for example, in the case of a dressing "a," in FIG. 28, a decrease in the impression S from −0.16 mm to −0.14 mm is effected by a decrease in the surface compression P of approximately 50 N/cm$^2$, and a decrease in the impression δ of −0.11 mm to −0.99 mm is effected by a decrease in the surface compression P of approximately 25 N/cm$^2$. A dressing "b" has a less steep slope.

Dressings 23, either as a whole unit, or only their rubber layer 117, which have a steep upward slope ΔP/Δδ, especially in the area of the necessary maximum surface compression $P_{max}$ in the pressure-relevant area, are referred to here as "hard", as shown by curve a, and those having a gradual upward slope ΔP/Δδ are referred to as "soft," as shown by curve b.

The dressing 23, or the rubber layer 117, is embodied here as the soft dressing "b" or as a soft layer. As compared with a hard dressing "a" or a hard layer, the same relative movement of the cylinder 06; 07 in the case of a soft dressing "b" results in a less significant change in the surface compression P, and therefore to a reduction in the fluctuations in ink transfer. The soft dressing "b" therefore results in less sensitivity of the printing process with respect to fluctuations and/or deviations in distances from a target value. With smaller changes in the surface compression P, caused by relative movements of the cylinders 06; 07, using the same dressings 23 or dressings 23 that have a soft layer, striations are visible in the printed product only with greater vibration amplitudes, for example.

In one advantageous embodiment of the present invention, the surface compression P varies, in the print-on position, at most within a range between 60 and 220 N/cm$^2$. For fluids, for example printing inks, having very different rheological properties, different ranges within the above-specified range for the surface compression may be preferred. Thus, the range for wet offset printing varies, for example, between 60 and 120 N/cm$^2$, and especially varies from 80 to 100 N/cm$^2$, whereas in the case of dry offset printing, no dampening solution, and with only ink application to the forme cylinder, for example, it amounts to between 100 and 220 N/cm$^2$, and especially to 120 to 180 N/cm$^2$.

The pressure-based range for the surface compression $P_{max}$ advantageously lies between 60 and 220 N/cm$^2$. For fluids, for example printing inks, having very different rheological properties, different ranges within the above-specified range for the surface compression P may be preferred. Thus, the range for wet offset printing varies, for example, between 60 and 120 N/cm$^2$, and especially from 80 to 120 N/cm$^2$. In FIG. 28, this is represented by shading. In the case of dry offset it varies, for example, between 100 and 220 N/cm$^2$, and especially from 120 to 180 N/cm$^2$. For instance, in one advantageous embodiment, a soft dressing 23 has, at least in the range from 80 to 120 N/cm$^2$, an upward slope $\Delta P/\Delta\delta$ of, for example, $\Delta P/\Delta\delta<700$ (N/cm$^2$)/mm, especially $\Delta P/\Delta\delta<500$ (N/cm$^2$)/mm, especially $\Delta P/\Delta\delta<400$ (N/cm$^2$)/mm.

In one variation which is advantageous, for example, with respect to service life, a pressure-based range of 40-60 N/cm$^2$ is selected. The printing blanket should then have, in this range for surface compression P of 40-60 N/cm$^2$, an upward slope of less than 350 (N/cm$^2$)/mm, and especially at most a slope of 300 (N/cm$^2$)/mm. The characterization of the printing blanket 23 in this working area, can be applied alone, or in addition to the above-mentioned characterization at the listed areas, so that the rubber blanket is characterized by a plurality of support points.

In one advantageous embodiment of the present invention, as is represented only schematically in FIG. 27, the layer 117 has a greater thickness "t," or the dressing 23 has a greater overall thickness T, than has been customary in the past. The thickness "t" of the layer 117, which is functional in terms of its elasticity or compressibility, extends, for example from 1.3 to 6.3 mm, preferably from 1.7 to 5.0 mm, and especially more than 1.9 mm. Added to this, if applicable, is the thickness of one or more layers, which are not specifically shown and which, under certain circumstances, may be attached to the layer 117, and which layers are substantially incompressible and inflexible, on the side that faces the cylinder body, which one or more layers are attached to the layer 117 for the purpose of form and/or dimensional stability. Furthermore, support layers characterized as inflexible, and made, for example, of fabric, can be added here, for example, in the area of the surface of the dressing 23. The support layer 116 or support layers 116 or supporting layers, which function not to affect the "softness" of the dressing, but to affect its form stability, can also be arranged between the "soft" layers. It can be embodied, for example, as a metal plate, and especially as a noble steel plate, approximately 0.1 to 0.3 mm thick. When embodied as a fabric, this layer may be between 0.1 and 0.6 mm thick, depending upon the configuration of the dressing 23. In the case of a plurality of layers 117, the indicated thickness "t" of the layer 117 refers to the sum of the "layer sections" that are functionally responsible for the above-described set of characteristics, dependence of surface compression/impression, and the elasticity or compressibility. A dressing, together with a support layer or support layers, then has, for example, a total thickness T of 2.0 to 6.5 mm, especially 2.3 to 5.9 mm.

The flexible layer 117, or its thickness "t," is understood as the layer 117, or the sum of the layers 117, the materials of which have an elasticity modulus in the radial direction of less than 50 N/mm$^2$. In contrast to this, the layers that are optionally provided for support, such as fabric, or for dimensional stability, such as metal bases, have a significantly greater elasticity modulus, for example greater than 70, especially greater than 100 N/mm$^2$, or even greater than 300 N/mm$^2$. In one advantageous embodiment, at least one layer section of the layer 117, characterized here as a flexible layer, is embodied as a porous material.

The flexible layer 117 can also have a cover layer, which is not shown in FIG. 27, the elasticity modulus of which is less than 50 N/mm$^2$ in the radial direction. As a rule, a cover layer is used to form a closed surface, and in this case contributes to providing the "softness". In other cases, cover layers having a greater elasticity modulus, for example greater than 70 N/mm$^2$, especially greater than 100 N/mm$^2$, or even greater than 300 N/mm$^2$, are used, and for this reason are not counted here as part of the flexible and/or compressible layer.

The "soft" dressing is preferably operated with a greater impression 6, as compared with customary impressions 8. The transfer cylinder 06 and the forme cylinder 07 are thus placed closer against one another in terms of their respective effective, but undistorted, diameter. In this manner, despite the gradual slope $\Delta P/\Delta\delta$, an optimal maximum surface compression $P_{max}$ is achieved. The placement of the cylinders 06; 07 against one another is accomplished, in one advantageous embodiment, such that the impression $\delta$ extends to at least 0.18 mm, for example between 0.18 mm and 0.6 mm, especially between 0.25 mm and 0.5 mm.

A relative impression S*, which is the impression S based upon the thickness "t" of the layer 117, lies, without accounting for the special embodiment of the rollers, for example, between 10% and 35%, but especially between 13% and 30%.

As has been described above, the embodiment and/or arrangement of the "soft" dressing is particularly advantageous if one of the two cooperating cylinders 06; 07, or even both cylinders has, or have at least one impediment that affects their rolling off against one another. In particular, the impediment can be caused by a groove 21 for use in fastening ends of one or more dressings 23, which groove 21 extends axially. The groove 21 has an opening, which faces the circumferential surface of the cylinder 06; 07, and which has a width s06 or s07, into which the ends of the dressings 23 are guided. On its interior, the groove 21, 19 can have a device for clamping and/or tightening the dressing 23 or dressings 23.

When the groove 21, 19 or grooves 21, 19 are rolled over, vibrations are created. If a width s06, s07 of the opening of the groove 21, 19, viewed in a circumferential direction, is greater than the width B of the contact zone, then when the groove 21, 19 passes through, a vibration having an increased amplitude is generated. This is because, due to the above-mentioned greater width B of the contact zone, a greater linear force acts between the two rollers 06; 07. Nevertheless, the increase in the vibration amplitudes caused by the greater linear force is less than the decrease in vibration sensitivity which is caused by the softness of the rubber layer, so that overall, a reduction in the sensitivity to vibrations results.

It is particularly advantageous to select the width s06, s07 of the groove 21, 19 to be smaller than the width B of the contact zone. In this case, at least areas of the cooperating circumferential surfaces always support themselves against one another in the contact zone, and a weakening in the height and a flatter shape or a widening of the pulse, for the force that triggers impact, result. With narrow openings s06, s07, softer dressings 23 or softer rubber layers 117 thus lead to a weakening and a lateral lengthening of the groove impact. The engagement is preferably accomplished such that the contact zone, which is created as a result of deformation, in a projected area perpendicular to a plane of connection V of the rotational axes of the two cylinders is at least three times as wide as the slit width of the opening on the cooperating forme cylinder 07 in a circumferential direction.

In the case of the transfer cylinder 06, ends of a metal printing blanket 23 can be arranged in the groove 21, as seen in FIG. 27. In this case, the rubber layer 117 is attached to the dimensionally stable support layer 116, the angled ends of which support layer 116 are arranged in the groove 21. The opening s06 of the groove 21 can then be configured to be extremely narrow in the circumferential direction, for example, s06$\leqq$5 mm, especially $\leqq$3 mm.

As was mentioned above, in one advantageous operational embodiment, the extremely soft and thick rubber blanket 23 permits a significant decrease in the operational surface compression of 80 to 100 N/cm$^2$ in the forme cylinder/transfer cylinder nip to the range of 40-60 N/cm$^2$, or even to 25 to 60 N/cm$^2$, wherein the layer 117 then has a slope of less than 350 (N/cm$^2$)/mm, especially at most 300 (N/cm$^2$)/mm. Due to the softness of the dressing 23, the surface undulation, that is customary for transfer cylinders 06, does not lead to problems in the evenness of ink transfer.

In FIG. 1, an embodiment of a printing press is represented, in which a plurality of printing towers, each comprised of two printing units 01 arranged one above another, are provided.

In one embodiment, which is advantageous in terms of the provision of an uncomplicated web lead, the former structure 241 is not located between the printing towers that are based upon this former structure 241 with respect to the webs, but instead is located at one end of an alignment of the printing towers that are based upon this former structure 241. Thus the webs can be supplied to the former structure from the same side.

The former structure 241 preferably has at least one group of three fold formers which are arranged side by side. In FIG. 1, two such groups of fold formers are arranged one above another vertically.

It can also be advantageous for a collating device 240, such as, for example, a group of web guide rollers arranged one above another, and over which the webs to be combined on the fold formers can be diverted, to be arranged not above the former structure 241, but spatially next to the former structure 241. In this way, the collating device 240 can be arranged at a lower machine height, rather than above the former structure 241, as is otherwise customary. The former structure 241 preferably has at least two former levels, each with three fold formers arranged side by side.

While preferred embodiments of printing couples of a printing press, in accordance with the present invention, have been set forth fully and completely hereinabove, it will be apparent to one of skill in the art that various changes in, for example, the specific inks and dampening fluids used, the sources of the fluids under pressure, and the like could be made without departure from the true spirit and scope of the present invention which is accordingly to be limited only by the appended claims.

What is claimed is:

1. A printing couple of a web-fed rotary printing press, comprising a transfer cylinder (06), a forme cylinder (07), a roller (41) which roller (41) cooperates with the forme cylinder (07) as a dampening forme roller (41) of a dampening unit (09), and a single roller (28) of an inking unit (08), wherein said single roller (28) of the inking unit cooperates with the forme cylinder (07) as a single ink forme roller (28) which contacts the forme cylinder, wherein the inking unit (08) is configured with two axially oscillating distribution cylinders (33; 33'), arranged in series in an inking path between an ink supply system of the inking unit and the forme cylinder (07), wherein the rotational axes of the forme cylinder (07) and of the allocated transfer cylinder (06), when their rotational axes are in an operational position, define a plane (E), and wherein two of the printing couples (04), consisting of two cooperating transfer cylinders (06) and two allocated forme cylinders (07), together form a blanket-to-blanket printing unit (03), characterized in that the single ink forme roller (28) has substantially the same diameter as the cooperating forme cylinder (07), that, in the operational position, a plane (A) through the rotational axes of the single ink forme roller (28) and of the forme cylinder (07) forms a maximum angle δ of 15° with the plane (E) through the rotational axes of the cooperating forme cylinder (07) and the transfer cylinder (06) and that the single ink forme roller is rotationally driven by an ink forme roller drive motor that is independent of the forme cylinder.

2. The printing couple according to claim 1, wherein the dampening forme roller (41), which cooperates with the forme cylinder (07), is provided below the plane (E).

3. The printing couple according to claim 2, characterized in that the dampening forme roller (41) is arranged below the forme cylinder (07) in such a way that a plane of connection (F) between the rotational axes of forme cylinder (07) and the dampening forme roller (41') forms an angle of 70-110° with the plane (E) of the rotational axes of forme cylinder (07) and the single ink forme roller (28).

4. The printing couple according to claim 2, characterized in that the dampening forme roller (41) is embodied as a support roller (41).

5. The printing couple according to claim 4, characterized in that the support roller (41) is arranged without a direct contact connection to the ink forme roller train.

6. The printing couple according to claim 1, characterized in that one of the axially oscillating distribution cylinders (33; 33') is arranged substantially vertically below the single ink forme roller (28).

7. The printing couple according to claim 1, characterized in that the one of the two axially oscillating distribution cylinders (33; 33') is arranged below the single ink forme roller (28) in such a way that a plane of connection (V) between the rotational axes of the single ink forme roller (28) and the one of the two axially oscillating distribution cylinders (33; 33') forms an angle of 70- 110° with the plane (E) of the rotational axes of forme cylinder (07) and the single ink forme roller (28).

8. The printing couple according to claim 1, characterized in that at least one of the forme cylinder and the transfer cylinder (06; 07) are mounted in a bearing unit (14) which is assigned to it for adjustment between a print-on position and a print-off position.

9. The printing couple according to claim 1, characterized in that the printing couple (04) further has at least one of a partially and a fully automatic plate changing system.

10. The printing couple according to claim 1, characterized in that the printing couple is embodied as printing couple (04) for wet offset printing.

11. The printing couple according to claim 10, characterized in that the printing couple is embodied with pre-dampening wherein once a point on the forme cylinder (07) has passed through the nip point with the transfer cylinder (06), this point comes first into active contact with the dampening forme roller (41), and then comes into active contact with the single ink forme roller (28) of the inking unit (08).

12. The printing couple according to claim 1, characterized in that the forme and transfer cylinders (06; 07) of the printing couple (04) are driven by at least one drive motor (121), which is mechanically independent.

13. The printing couple according to claim 1, characterized in that the forme and transfer cylinders (06; 07) of the printing couple (04) are each driven by its own separate drive motor (121), which is mechanically independent.

14. The printing couple according to claim 12, characterized in that the at least one drive motor (121) is embodied as a permanent magnet synchronous motor (121).

15. The printing couple according to claim 1, characterized in that the inking unit (08) is configured as a long inking unit (08).

* * * * *